US005212054A

United States Patent [19]

Tashiro et al.

[11] Patent Number: 5,212,054

[45] Date of Patent: May 18, 1993

[54] SILVER HALIDE COLOR PHOTOGRAPHIC LIGHT-SENSITIVE MATERIAL

[75] Inventors: Koji Tashiro; Hideaki Haraga; Atsuo Ezaki; Hiroshi Ideda; Katsutoyo Suzuki; Satoru Shimba; Miki Kon; Kenji Michiue; Yasushi Irie; Toshihiko Yagi; Syoji Matsuzaka; Keisuke Tobita, all of Hino, Japan

[73] Assignee: Konica Corporation, Tokyo, Japan

[21] Appl. No.: 652,048

[22] Filed: Feb. 7, 1991

[30] Foreign Application Priority Data

| | | | |
|---|---|---|---|
| Feb. 9, 1990 | [JP] | Japan | 2-30730 |
| Feb. 15, 1990 | [JP] | Japan | 2-24785 |
| Feb. 15, 1990 | [JP] | Japan | 2-34786 |
| Feb. 16, 1990 | [JP] | Japan | 2-36613 |
| Feb. 19, 1990 | [JP] | Japan | 2-37764 |
| Feb. 19, 1990 | [JP] | Japan | 2-37765 |

[51] Int. Cl.[5] ..... G03C 1/08

[52] U.S. Cl. ..... 430/509; 430/505; 430/506; 430/567

[58] Field of Search ..... 430/506, 505, 509, 567

[56] References Cited

U.S. PATENT DOCUMENTS

| | | | |
|---|---|---|---|
| 3,672,898 | 6/1972 | Schwan et al. | 430/505 |
| 3,843,369 | 10/1974 | Kumai et al. | 430/509 |
| 4,028,115 | 6/1977 | Hinata et al. | 96/124 |
| 4,668,614 | 5/1987 | Tadaka et al. | 430/567 |
| 4,762,778 | 8/1988 | Yamazaki et al. | 430/505 |
| 4,880,726 | 11/1989 | Shiba et al. | 430/376 |
| 4,952,485 | 8/1990 | Shibahaya et al. | 430/506 |
| 5,024,925 | 6/1991 | Deguchi | 430/505 |
| 5,037,728 | 8/1991 | Shiba et al. | 430/505 |
| 5,053,324 | 10/1991 | Sasaki | 430/506 |

FOREIGN PATENT DOCUMENTS

| | | |
|---|---|---|
| 309119 | 3/1989 | European Pat. Off. . |
| 106306 | 4/1989 | European Pat. Off. . |
| 324471 | 7/1989 | European Pat. Off. . |

*Primary Examiner*—Charles L. Bowers, Jr.
*Assistant Examiner*—Thomas R. Neville
*Attorney, Agent, or Firm*—Jordan B. Bierman

[57] ABSTRACT

A silver halide color photographic light-sensitive material of which the color reproducibility and printing suitability are kept improved against the variation of photographing conditions, such as a change in light source, is disclosed. The photographic material comprises a support and provided thereon a red-sensitive silver halide emulsion layer, a green-sensitive silver halide emulsion layer and a blue-sensitive silver halide emulsion layer, wherein at least one of said emulsion layers is of three-layer structure comprising a low-speed elemental emulsion layer, a medium-speed elemental emulsion layer and a high speed emulsion layer arranged in this sequence from the side facing the support, and a maximum color density of said medium-speed emulsion layer is not more than 0.35.

15 Claims, 6 Drawing Sheets

SILVER HALIDE COLOR PHOTOGRAPHIC LIGHT-SENSITIVE MATERIAL

BACKGROUND OF THE INVENTION

The present invention relates to a silver halide color photographic light-sensitive material, more specifically to a silver halide color photographic light-sensitive material of which the color reproducibility and printing suitability are kept improved against the variation of photographing conditions, such as a change in light source.

In recent years, silver halide multilayer color photographic light-sensitive materials have been significantly improved in image quality. The light-sensitive materials now on the market are excellent in graininess, sharpness and color reproducibility, which are the determinants of image quality, and, it seems that photoprints and slide films obtained from these materials almost satisfy users' requirements.

However, there is yet room for improvement in color reproducibility. Conventional light-sensitive materials are improved in the purity of color, but cannot reproduce colors that have been regarded as difficult to be reproduced by photographing.

When photographing is conducted with conventional light-sensitive materials, users are sometimes disappointed with the fact that purple and bluish purple that reflect a light of not less than 600 nm in wavelength or the colors of green family such as bluish green and yellowish green are reproduced to be colors entirely different from original ones.

Meanwhile, color reproducibility is greatly affected by the following two factors—the spectral sensitivity distribution and the inter-image effect.

In forming a silver halide color photographic light-sensitive material, it is known to add a compound capable of releasing a development inhibitor or a precursor thereof upon a coupling reaction with an oxidized product of a color developing agent (the so-called DIR compound). A development inhibitor released from such DIR compound suppresses the color development of other color-sensitive layers to cause the inter-image effect which contributes to the improvement of color reproducibility In the case of a color negative, an effect similar to the inter-image effect can be obtained by the use of a colored coupler in an amount larger than that needed to cancel an obstructive negative image formed by unnecessary absorption.

However, the use of a large amount of a colored coupler increases the minimum density of a film. The increased minimum density makes the judgment on color correction in printing extremely difficult, and eventually leads to the formation of a photoprint with deteriorated color quality. These techniques are effective only in improving color purity.

Diffusible DIR compounds have been utilized widely in recent times. A diffusible DIR compound capable of releasing a development inhibitor or its precursor of high mobility greatly contributes to the improvement of color purity. However, it is difficult to control the direction in which the inter-image effect will extend, and hence, the use of such diffusible DIR compound involves such a risk that it may change the tone of color. U.S. Pat. No. 4,725,529 contains a description as to the control of the direction of the inter-image effect.

Meanwhile, U.S. Pat. No. 3,672,898 discloses a spectral sensitivity distribution effective in suppressing the variation of color reproduction due to a change in light source.

This technique, however, is not aimed at improving the reproducibility for colors which are regarded as difficult to be reproduced. The combination of the spectral sensitivity distribution technique and the inter-image effect technique is also known. For instance, Japanese Patent Publication Open to Public Inspection (hereinafter referred to as Japanese Patent O.P.I. Publication) No. 034541/1986 discloses a method of improving reproducibility for colors which are difficult to be reproduced. This method, aiming at improving color reproducibility not only by the effects of blue-, green- and red-sensitive layers but also by bringing about the inter-image effect from wavelengths other than the central wavelength in the spectral sensitivity distribution of each color-sensitive layer, is considered to be effective to some extent in improving reproducibility for colors with specific tones. However, this method is accompanied by such a problem that the production cost is high due to an increased coating weight of silver and more complicated production procedures which are ascribable to the provision of an inter-image effect manifesting layer and the use of other kinds of silver halide than those employed in color-sensitive emulsion layers. The effects obtained by this method are not satisfactory.

U.S. Pat. No. 3,672,898 discloses a spectral sensitivity distribution effective in preventing color reproducibility from varying by a change in light source. In this disclosure, the spectral sensitivity distributions of the blue- and red-sensitive layers are brought into the proximity of the spectral sensitivity distribution of the green-sensitive layer, thereby to prevent color from varying against a change in light source, more specifically, to prevent the sensitivity balance of each layer from varying against a change in color temperature. In this case, by the adjacency of the spectral sensitivity distributions of three color-sensitive layers, their spectral sensitivity distributions overlap one another, thus lowering the purity of color. Such lowering of color purity can be prevented to some extent by bringing about the inter-image effect by the use of the preceding diffusible DIR compound. However, for photographing under light sources other than day light, which has been widely conducted recently, the combination of the above techniques is not effective in obtaining sufficient color reproduction.

Generally, users' attention is paid to positives, rather than negatives. Therefore, the quality of a color negative is evaluated by the quality of a positive printed on color paper.

In the case of a color negative, the imbalance of color or density can be corrected to some extent by manipulating a printer when printing on color paper, and the quality of a color negative depends on the extent to which such correction can be made. Therefore, to obtain improved image quality, a negative is required to be excellent in suitability for printing (this quality will be referred to as "printing suitability"), besides the three important factors as graininess, sharpness and color reproducibility. Laboratory examination revealed that print yield was poor in photographing under a light source other than day light (e.g., fluorescent lamp), under a mixed light source of day light and other sources than day light, or under day light but in such a condition that a specific color stands out. Improvement in printing suitability in such conditions is strongly desired.

As stated above, in spite of the efforts made by experts, none of the known techniques can improve color reproducibility, in particular, color reproducibility under various light sources other than day light which differ in color temperature.

Meanwhile, the utilization of a color photographic light sensitive material for photographing has been more diversified than ever with the spread of high-speed light-sensitive materials, throwaway cameras and large prints. The development of high-speed light-sensitive materials has permitted photographing of in-door sports, a stage drama or babies without a stroboscope. However, an image obtained without a stroboscope has poor graininess in the shadow part of a subject or in the case of underexposure, and light-sensitive materials are strongly required to be improved in this respect. Similar requirement is also being made for throwaway cameras which do not require exposure control.

Conventionally, a silver halide color photographic light-sensitive material (hereinafter often referred to as a color photographic light-sensitive material or a light-sensitive material) has been demanded to have improved sensitivity and graininess, and many proposals have been made to satisfy such demand.

For instance, British Patent No. 923,045 discloses a method of improving sensitivity without imparing graininess, in which a light-sensitive emulsion layer is divided into a high-speed emulsion layer and a low-speed emulsion layer which each contain a non-diffusible coupler, these layers form colors of substantially the same tone, and the maximum color density of the high-speed layer is adjusted to be low. This method, however, is still insufficient in respect of graininess.

U.S. Pat. No. 3,843,469 discloses a high-speed multilayer color photographic light-sensitive material with improved sensitivity, in which at least one of the red-, green- and blue-sensitive emulsion layers consists of three elemental layers. The three elemental layers (the uppermost layer, the intermediate layer and the lowermost layer) are arranged in sequence of sensitivity in such a manner that a layer of the lowest sensitivity becomes the lowermost layer. Graininess obtained by this light-sensitive material is still far from a satisfactory level.

Meanwhile, the use of two-equivalent coupler which is excellent in color forming property is known as the method of improving sharpness. German Patent No. 1121470 contains a description that sharpness can be improved by dividing each light-sensitive layer into two elemental layers and by adding a two-equivalent coupler to each elemental layer. This technique can improve sharpness to some extent, but is accompanied by significantly deteriorated graininess and increased fogging.

U.S. Pat. No. 3,516,831 discloses a light-sensitive material improved in graininess and sharpness comprising at least two emulsion layers having sensitivity to the same spectral region, in which said emulsion layer is divided into a high-speed elemental layer and a low-speed elemental layer containing a four-equivalent coupler and a two-equivalent coupler, respectively. This technique, however, cannot obtain improved sensitivity.

A technique of improving graininess by adding a DIR compound in a color photographic light-sensitive material is also known in the art. This method encounters such a problem that an increase in the amount of a DIR compound significantly lowers sensitivity and color forming property, and graininess obtained by this method is not sufficient enough to gain users' satisfaction.

Japanese Patent Examined Publication No. 15495/1974 and Japanese Patent Publication O.P.I. Publication No. 91945/1987 each disclose a technique of improving graininess by dividing at least one silver halide emulsion layer into three elemental layers (a low-speed emulsion layer, a medium-speed emulsion layer and a high-speed emulsion layer) and by controlling the maximum color density of each elemental layer delicately. Graininess obtained by this technique is still insufficient.

As is evident from the foregoing, image quality cannot be improved only by the provision of a silver halide emulsion layer of multilayer structure, and what is worse, the provision of a multilayer emulsion layer results in not only an increased production cost due to an increase in the coating amount of silver, coupler or gelatin, but also deteriorated sharpness and developability ascribable to an increased dry thickness.

The so-called "pressure fogging" may occur if the amount of gelatin contained in a light-sensitive material is decreased carelessly to solve the above problems.

Generally, a light-sensitive material is often under mechanical stresses. For instance, a negative film for photographing may be rolled up in a Patrone, be folded as it is loaded in a camera, or be pulled as it is advanced in a camera. In addition, a large mechanical stress tends to be imposed on a negative film in its manufacturing process that involves cutting and processing procedures. Such mechanical stresses, through a binder (gelatin) and a support (a plastic film), are imposed on silver halide grains, and eventually impair photographic properties.

This problem is described in detail in K. B. Mather; J. Opt. Soc. Am., 38, 1054 (1948) and P. Faelens and P. de. Smet; Sci. et. Ind. Phot., 25, No. 5, 178 (1954) and P. Faelens; J. Photo. Sci. 2, 105 (1954).

The portion of a light-sensitive material under mechanical stresses is desensitized. Such desensitization causes unnecessary sensitization and fogging, leading to a significant lowering in image quality. As the method for solving this problem, the following two are known:

(1) To add a plasticizer such as a polymer and an emulsified product; and (2) To decrease the amount ratio of a silver halide to gelatin.

These methods are aiming at preventing pressure from being applied on silver halide grains.

Regarding the method (1), as the plasticizer, British Patent No. 738,618 discloses the use of a heterocyclic compound; British Patent No. 738,637 an alkylphthalate; British Patent No 738,639 an alkylester; U.S. Pat. No. 2,260,404 a polyvalent alcohol; U.S. Pat. No. 3,121,060 a carboxyalkylcellulose; Japanese Patent O.P.I. Publication No. 5017/1974 paraffin and a carboxylate; and Japanese Patent Examined Publication No. 28086/1978 an alkylacrylate and an organic acid.

The use of a plasticizer cannot produce satisfactory results, since a certain limit has to be placed on the amount of a plasticizer to prevent the mechanical strength of an emulsion layer from lowering.

The method (2) is also defective, since an increased amount of gelatin causes various problems such as a decrease in development rate.

Besides the above methods, efforts have been made to render silver halide grains strongly resistant to mechanical stresses. For instance, Japanese Patent O.P.I. Publication Nos. 116025/1975 and 1071129/1976 each suggest the addition of iridium or thallium salts in forming silver halide grains, and Japanese Patent O.P.I. Publication Nos. 178447/1983 and 35726/1984 each disclose the use of a core/shell type emulsion. These methods can make silver halide grains resistant to pressure to some extent, but are not yet satisfactory. Today, there is a strong demand for a color photographic light-sensitive material improved not only in image quality but also in resistance to pressure.

A silver halide photographic light-sensitive material is required to be improved in various respects, such as sensitivity, image quality and gradation. Fogging, storage and processing stabilities are also important factors determining the quality of a light-sensitive material, and significant improvement in these points has been demanded in recent years. However, there is not yet a method for simultaneously improving fogging property, storageability and processing stability without lowering sensitivity.

Various techniques have been employed for sensitizing a silver halide light-sensitive material. The examples include spectral sensitization in which a sensitizing dye is used; noble metal sensitization in which a salt of a noble metal such as gold, platinum and iridium is used; sulfur sensitization in which active-gelatin, sodium thiosulfate, thioacetamide or allylisothiourea is used; selenium sensitization in which colloidal selenium or selenourea is used; reduction sensitization in which a monovalent salt of tin, a polyamine or a hydrazine derivative is used; and development acceleration in which a polonium salt of nitrogen, phosphor and sulfur or a polyalkylene glycol is used.

In the photographic industry, these techniques are appropriately combined according to purpose to obtain an intended silver halide photographic light-sensitive material. However, even when combined, these techniques are still insufficient for improving processing stability (stability against fluctuations in processing conditions) and storageability, in particular, storageability at a high temperature or a high humidity.

To improve sensitivity, Japanese Patent O.P.I. Publication Nos. 138538/1985, 143331/1985, 99433/1984 and 35726/1984, and U.S. Pat. No. 4,444,877 each disclose the use of a silver halide emulsion comprising monodispersed, tabular core/shell type grains. In this disclosure, elaboration is made in the process of forcing a latent image, so that light absorbed in the core of a silver halide grain can be effectively transformed to a development nucleous. This technique, however, is defective in storage stability.

To overcome this defect, the addition of various antifoggants was proposed. U.S. Pat. Nos. 1,758,576, 2,304,962, 2,697,040, 2,697,099, 2,824,001, 2,476,536, 2,843,491, 3,251,691, British Patent Nos. 403,789 and 893,428 and Japanese Patent Examined Publication No. 9939/1983 each disclose the addition of a mercapto compound as the antifoggant. A mercapto compound, though effective in suppressing fogging, significantly lowers sensitivity. In addition, sensitivity and fogging property of a light-sensitive material containing such mercapto compound tend to deteriorate with the lapse of time.

As the method for obtaining a photographic light-sensitive material improved in both sensitivity and image quality, Japanese Patent O.P.I. Publication No. 113934/1983 discloses the use of a silver halide emulsion comprising tabular silver halide grains with an average aspect ratio of not less than 8. However, it is extremely difficult to obtain desired gradation by using this emulsion, since the development activity of tabular grains with a high aspect ratio is too high due to the morphological properties, regardless the average silver iodide content of the grains. In addition, a light-sensitive material prepared from this emulsion is insufficient in processing stability.

Meanwhile, for the improvement of developability, Japanese Patent O.P.I. Publication No. 156059/1985 discloses the provision of a layer containing silver halide grains which are substantially not sensitive to light between two silver halide light-sensitive emulsion layers differing in light sensitivity. Japanese Patent O.P.I. Publication No. 128429/1985 discloses the addition of non-light-sensitive silver halide grains to a silver halide emulsion layer that is most distant from the support, which is aimed at preventing a light-sensitive material from being affected by fluctuations in processing conditions.

These techniques are still insufficient to improve processing stability.

Further, with the spread of small-sized compact laboratories (development apparatus), quality deterioration and heterogeneity of a processing liquid has attracted users' attention as the problems that need urgent solution. The heterogeneity of a processing liquid, which is caused by insufficient stirring, results in considerable variance in photographic properties.

SUMMARY OF THE INVENTION

The present invention has been made to solve the above problems.

One object of the invention is to provide a silver halide color photographic light sensitive material of which the color reproducibility and printing suitability are kept improved under light sources other than day light which differ in color temperature, as well as a method of forming a color photographic image with said light-sensitive material.

Another object of the present invention is to provide a silver halide color photographic light-sensitive material improved in sensitivity, graininess and resistance to mechanical stresses.

Still another object of the invention is to provide a silver halide color photographic light-sensitive material improved in sensitivity, processing stability and resistance to heat and humidity.

In their extensive studies to obtain a color photographic light-sensitive material improved in color reproduction, sensitivity, graininess and image quality, the inventors have found that the maximum density of the medium-speed layer is a key to the attainment of these objects. That is, the inventors have found that the above objects can be attained by a silver halide color photographic light-sensitive material having a support and provided thereon a red-sensitive silver halide emulsion layer, a green-sensitive silver halide emulsion layer and a blue-sensitive emulsion layer, wherein at least one of said emulsion layers is of three-layer structure comprising a low-speed elemental emulsion layer, a medium-speed elemental emulsion layer and a high-speed elemental emulsion layer arranged in this sequence from the side facing the support, and the maximum color density of said medium-speed elemental emulsion layer is not more than 0.35.

BRIEF EXPLANATION OF THE DRAWINGS

FIG. 1 shows a characteristic curve obtained by adding Compound C which will be explained later to the medium-speed elemental emulsion layers of the blue-, green- and red-sensitive emulsion layer (a dotted line), and that obtained by adding a conventional coupler to said medium-speed elemental emulsion layers (a solid line). FIG. 2 shows the maximum densities of said medium-speed elemental emulsion layers, which are represented by a difference between said solid line and said dotted line.

DETAILED DESCRIPTION OF THE INVENTION

The silver halide color photographic light-sensitive material of the present invention has a red-sensitive emulsion layer, a green-sensitive emulsion layer and a blue-sensitive emulsion layer on a support, and at least one of these emulsion layers consists of a low-speed elemental emulsion layer, a medium-speed emulsion layer and a high-speed emulsion layer. It is preferred that the red- and green-sensitive emulsion layers each consist of at least three layers; a low-speed elemental emulsion layer, a medium-speed elemental emulsion layer and a high-speed elemental emulsion layer arranged in this sequence from the side facing the support. To minimize optical loss and to increase developability are the purposes for this arrangement.

In a preferred embodiment, each of the red-, green- and blue-sensitive emulsion layers is of three-layer structure of a low-speed elemental emulsion layer, a medium-speed elemental emulsion layer and a high-speed elemental emulsion layer.

In the invention, the maximum color density of a medium-speed elemental emulsion layer is obtained by the following method:

A non-color-forming layer is prepared by adding to the medium-speed layer of at least one of the blue-, green- and red-sensitive emulsion layers of a light-sensitive material Compound C which will be explained later in an amount of 0.08 g per square meter in stead of a silver halide and a color-forming coupler. The amount of gelatin in said layer is appropriately adjusted to prevent the total thickness of the light-sensitive material from changing.

Figure 1:
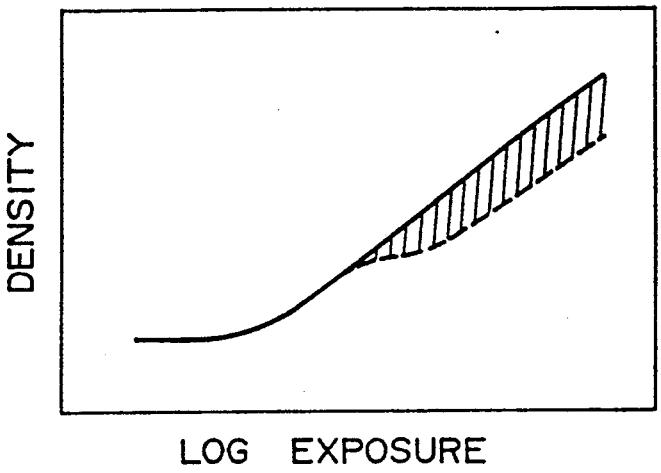
FIGS. 1 and 2 are views explanatory of the maximum color density of a medium-speed emulsion layer.
Figure 2:
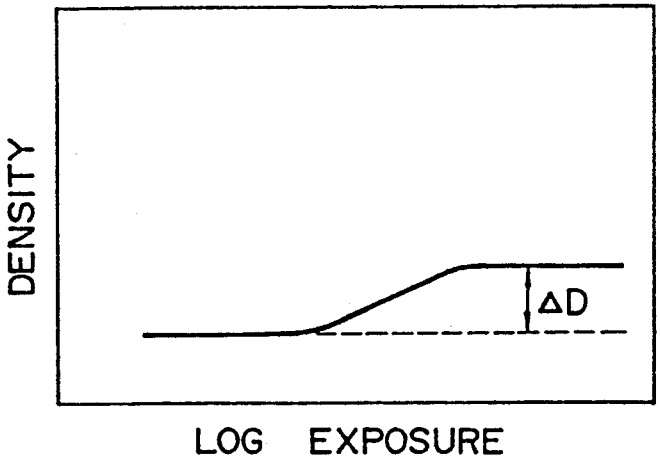

When the medium-speed elemental emulsion layer of the red-sensitive layer becomes such non-color-forming layer, the light-sensitive material is exposed to white light through an optical wedge and W-26 (a filter manufactured by Eastman Kodak Co., Ltd.) for 1/100 seconds, and then processed by the following photographic processing [P]. Color development time [A] is one minute and 45 seconds. The light-sensitive material is then subjected to sensitometry to obtain a characteristic curve (a dotted line in FIG. 1). A conventional light-sensitive material is also exposed, processed and subjected to sensitometry in the same manner as mentioned above to obtain a characteristic curve (a solid line in FIG. 1). Then, a difference between the two samples (an oblique line portion in FIG. 1) is obtained. This difference is the maximum color density of the medium-speed elemental emulsion layer of the red-sensitive layer (FIG. 2).

The maximum color density of the medium-speed elemental emulsion layer of the green-sensitive layer is obtained in the same manner as in the case of the red-sensitive layer, except that exposure is conducted by using W-99 (a filter manufactured by Eastman Kodak Co., Ltd.), and that color development time [A] is 2 minutes and 50 seconds.

The maximum density of the medium-speed elemental emulsion layer of the blue-sensitive layer is obtained in the same manner as in the case of the red-sensitive layer, except that exposure is conducted by using W-47 (a filter manufactured by Eastman Kodak Co., Ltd.) and that color development time [A] is 3 minutes and 15 seconds.

Thus, the maximum color density of the medium-speed elemental emulsion layer of each of the blue-, green- and red-sensitive layers is obtained.

Compound C

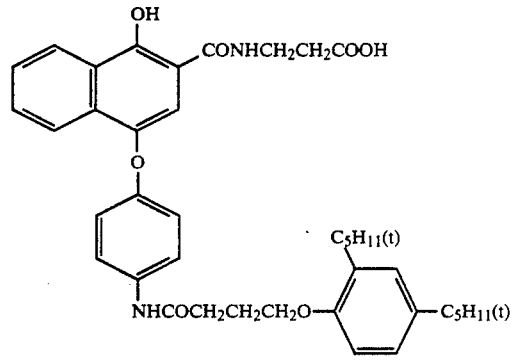

Processing [P]:

| Processing steps (38° C.) | |
|---|---|
| Color development | A |
| Bleaching | 6 min. 30 sec. |
| Rinsing | 3 min. 15 sec. |
| Fixing | 6 min. 30 sec. |
| Rinsing | 3 min. 15 sec. |
| Stabilizing | 1 min. 30 sec. |
| Drying | |

The compositions of the processing liquids employed in the processing procedures are as follows:

| | |
|---|---|
| [Color developer] | |
| 4-Amino-3-methyl-N-ethyl-N (β-hydroxyethyl)aniline sulfate | 4.75 g |
| Anhydrous sodium sulfite | 4.25 g |
| Hydroxylamine ½ sulfate | 2.0 g |
| Anhydrous potassium carbonate | 37.5 g |
| Sodium bromide | 1.3 g |
| Trisodium nitrilotriacetate (monohydrate) | 2.5 g |
| Potassium hydroxide | 1.0 g |
| Water is added to make the total quantity (pH = 10.0) | 1 l. |
| [Bleacher] | |
| Ferric ammonium ethylenediaminetetraacetate | 100.0 g |
| Diammonium ethylenediaminetatraacetate | 10.0 g |
| Ammonium bromide | 150.0 g |
| Glacier acetate acid | 10.0 g |
| Water is added to make the total quantity and pH is adjusted with aqueous ammonia. | 1 l, |
| [Fixer] | |
| Ammonium thiosulfate | 175.0 g |
| Anhydrous sodium sulfite | 8.5 g |
| Sodium metasulfite | 2.3 g |

-continued

| | |
|---|---|
| Water is added to make the total quantity and pH is adjusted with acetic acid. | 1 l, |
| [Stabilizer] | |
| Formalin (an aqueous 37% solution) | 1.5 ml |
| Konidax (manufactured by Konica Corp) | 7.5 ml |
| Water is added to make the total quantity | 1 l. |

In the present invention, the maximum color density of the medium-speed elemental emulsion layer of each of the blue-, green- and red-sensitive emulsion layer is not more than 0.35, preferably not more than 0.3, more preferably not more than 0.25.

Maximum color density can be adjusted, for example, by controlling the amounts of a coupler and a silver halide.

A maximum density of the medium-speed elemental emulsion layer exceeding 0.35 results in deteriorated graininess.

The objects of the present invention can be attained most satisfactorily by a silver halide color photographic light-sensitive material having a support and provided thereon a red-sensitive silver halide emulsion layer, a green-sensitive emulsion layer and a blue-sensitive emulsion layer, wherein said green-sensitive emulsion layer is of three-layer structure of a low-speed elemental emulsion layer, a medium-speed elemental emulsion layer and a high-speed elemental emulsion layer, and said medium-speed elemental emulsion layer has a maximum color density of not more than 0.35 and the following spectral sensitivity distribution:

$0.55S_{560} < S_{570} < 1.20S_{560}$, and $0.20S_{560} < S_{580} < 0.60S_{560}$, and $S_{590} < 0.30S_{560}$ wherein $S_x$ represents the reciprocal of an exposure amount required to obtain a minimum density (D min)+0.1 at a wavelength of X nm.

With this light-sensitive material, it is possible to obtain high color reproducibility and printing suitability under not only day light but also other light sources than day light.

Sensitivity in the preceding specific wavelength region is determined by the following method:

(1) Preparation of Sample

A sample is obtained by providing a single layer of the following constitution on a support (the amounts of ingredients are given in terms of gram per square meter, unless otherwise indicated. The amount of a silver halide is the amount converted to the amount of silver).

| | |
|---|---|
| Silver halide | 3.3 |
| Magenta coupler (Ma-1) | 0.36 |
| Magenta coupler (Ma-2) | 0.09 |
| Colored magenta coupler (CMa-1) | 0.12 |
| DIR coupler (Da-1) | 0.054 |
| High boiling solvent (Oila-1) | 0.90 |
| Gelatin | 5.0 |

Besides the above ingredients, a coating aid SUa-1, a dispersion aid SUa-2, a viscosity controller and a hardener Ha-1 were added.

Ma-1

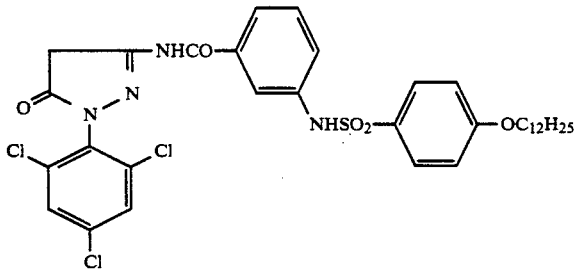

Ma-2

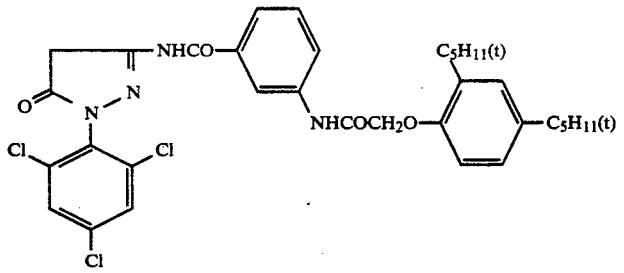

CMa-1

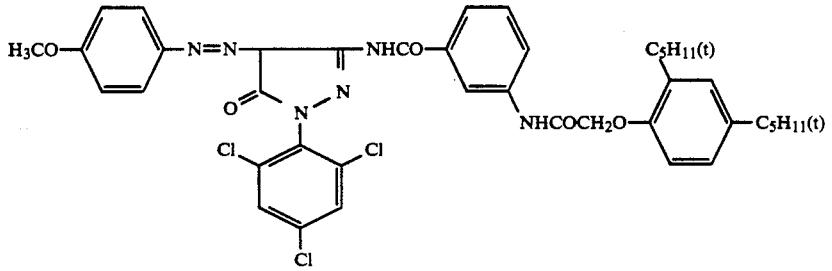

-continued

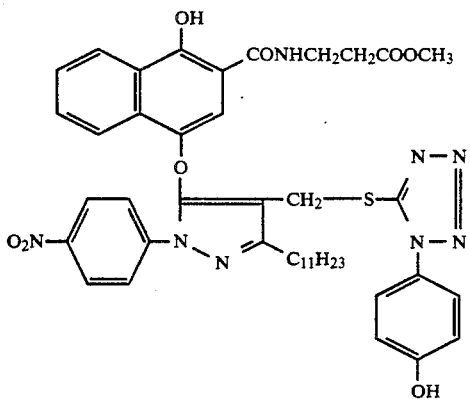

Da-1

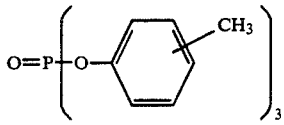

Oila-1

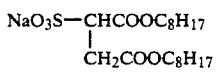

SUa-1

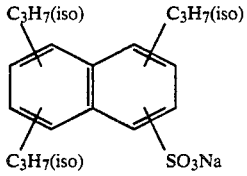

SUa-2

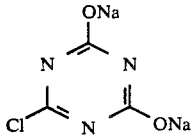

Ha-1

(2) Exposure and Development

The sample is then exposed to white light through an optical wedge and interference filters (KL-56, KL-57, KL-58 and KL-59 (manufactured by Toshiba Glass Co., Ltd.) for 1/100 second, and processed according to the preceding processing procedures [P]. Color development time is 2 minutes and 50 seconds.

The interference filters employed had the following characteristics. The amount of exposure is so adjusted as will not be affected by the change of filter.

| Filter | Maximum wavelength transmitted | Energy ratio of transmitted |
|---|---|---|
| KL-56 | 558.5 nm | 1.000 |
| KL-57 | 571.0 nm | 1.006 |
| KL-58 | 577.0 nm | 0.945 |
| KL-59 | 587.0 nm | 1.187 |

For the obtained sample, density is measured by using green light, and the reciprocal of an exposure amount required to obtain a fogging density+0.1 is obtained.

This reciprocal value is obtained for each exposure light wavelength, and the value obtained at a wavelength of 560 nm is designated as $S_{560}$ set as the standard Sensitivities at other wavelengths than 560 nm are calculated as the relative sensitivities to $S_{560}$, and a relationship between sensitivity and wavelength (spectral sensitivity distribution) is obtained.

In the present invention, the medium-speed elemental emulsion layer preferably has the following spectral sensitivity distribution:

$0.55\ S_{560} < S_{570} < 1.20\ S_{560}$ and $0.20\ S_{560} < S_{580} < 0.60\ S_{560}$ and $S_{590} < 0.30\ S_{560}$ and more preferably has the following spectral sensitivity distribution:

$0.65\ S_{560} < S_{570} < 1.85\ S_{560}$ and $0.25\ S_{560} < S_{580} < 0.40\ S_{560}$ and $S_{590} < 0.15\ S_{560}$ To obtain the preceding spectral sensitivity distribution, any known technique, such as the addition of a spectral sensitizer, is usable.

Though the kind of spectral sensitizer is not limitative, satisfactory results can be obtained by using the following dyes represented by Formulae $[I_A]$ to $[I_F]$ singly or in combination. Alternatively, supersensitizers represented by Formula $[I_G]$ can also be employed.

Formula [$I_A$]

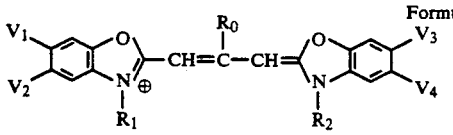

$(M_1^{\oplus})_{n1}$ wherein $R_1$ and $R_2$ each represent an alkyl group, an alkenyl group or an aralkyl group, provided that at least one of $R_1$ and $R_2$ substitutes a sulfo or carboxy group; $R_0$ represents a lower alkyl group, a phenyl group or an aralkyl group; $V_1$ to $V_4$ each represent a hydrogen atom, a lower alkyl group, a halogen atom, a lower alkoxy group, a hydroxy group or an aryl group;

$M_1^{\oplus}$ represents a cation; and $n_1$ represents 0 or 1, and when the compound forms an intramolecular salt, $n_1$ represents 0.

Formula [$I_B$]

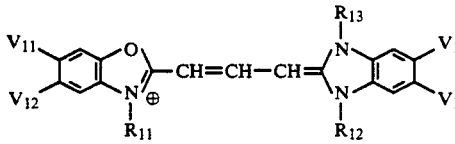

$(M_{11}^{\oplus})_n$ wherein $R_{11}$ and $R_{12}$ have the same meaning as $R_1$ and $R_2$; $R_{13}$ represents an alkyl group, an alkenyl group, an aralkyl group or an aryl group; $V_{11}$ and $V_{12}$ have the same meaning as $V_1$ and $V_2$; $V_{13}$ and $V_{14}$ each represent a hydrogen atom, a halogen atom, a carbamoyl group, an alkoxycarbonyl group, an aryloxycarbonyl group, an acyl group, a sulfonyl group, a sulfamoyl group, a trifluoromethyl group or a cyano group; and $M_{11}$ and $n_{11}$ respectively have the same meaning as $M_1$ and $n_1$.

Formula [$I_C$]

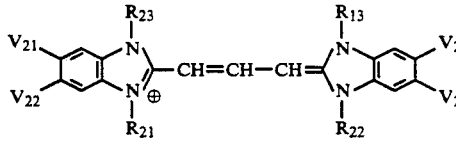

$(M_{21}^{\oplus})_{n21}$ wherein $R_{21}$ and $R_{22}$ have the same meaning as $R_1$ and $R_2$; $R_{23}$ and $R_{24}$ each have the same meaning as $R_{13}$; $V_{21}$ to $V_{24}$ each have the same meaning as $V_{13}$ and $V_{14}$; and $M_{21}$ and $n_{21}$ respectively have the same meaning as $M_1$ and $n_1$.

Formula [$I_D$]

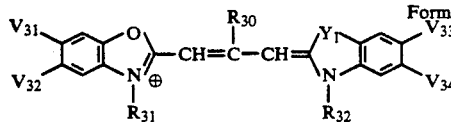

$(M_{31}^{\oplus})_{n31}$ wherein $R_{30}$ has the same meaning as $R_0$; $R_{31}$ and $R_{32}$ have the same meaning as $R_1$ and $R_2$; $V_{31}$ to $V_{34}$ have the same meaning as $V_1$ to $V_4$; $M_{31}$ and $n_{31}$ respectively have the same meaning as $M_1$ and $n_1$; and $Y_1$ represents a sulfur atom or a selenium atom.

Formula [$I_E$]

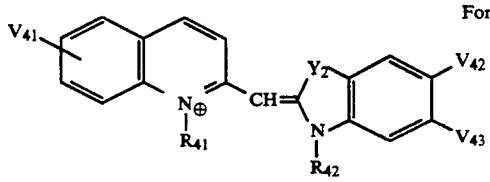

$(M_{41}^{\oplus})_{n41}$ wherein $R_{41}$ and $R_{42}$ have the same meaning as $R_1$ and $R_2$; $V_{41}$ to $V_{43}$ have the same meaning as $V_1$ to $V_4$; $Y_2$ represents a sulfur atom or a selenium atom; and $M_{41}$ and $n_{41}$ respectively have the same meaning as $M_1$ and $n_1$.

Formula [$I_F$]

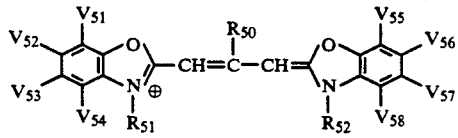

$(M_{51}^{\oplus})_{n51}$ wherein $R_{50}$ has the same meaning as $R_0$; $R_{51}$ and $R_{52}$ have the same meaning as $R_1$ and $R_2$; $V_{51}$ to $V_{58}$ represent a hydrogen atom, a lower alkyl group, a lower alkoxy group, a halogen atom, a hydroxy group or an aryl group, provided that at least one pair selected from $V_{51}$ and $V_{52}$, $V_{52}$ and $V_{53}$, $V_{53}$ and $V_{54}$, $V_{55}$ and $V_{56}$, $V_{56}$ and $V_{57}$ and $V_{57}$ and $V_{58}$ forms a condensed benzene ring by linkage; and $M_{51}$ and $n_{51}$ respectively have the same meaning as $M_1$ and $n_1$.

Formula [$I_G$]

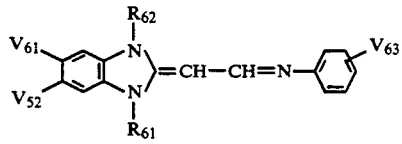

$R_{61}$ and $R_{62}$ each represent an alkyl group, an aralkyl group or an aryl group; $V_{61}$ and $V_{62}$ have the same meaning as $V_{13}$ and $V_{14}$; and $V_{63}$ has the same meaning as $V_1$ to $V_4$.

The examples of the alkyl group represented by $R_1$, $R_2$, $R_{11}$, $R_{21}$, $R_{22}$, $R_{31}$, $R_{32}$, $R_{41}$, $R_{42}$, $R_{51}$, $R_{52}$, $R_{61}$ and $R_{62}$ in Formulae [$I_A$] to [$I_G$] include an unsubstituted alkyl group, an alkyl group substituted by a halogen atom (fluorine, chlorine), a hydroxyl group, an alkoxyl group (ethoxycarbonyl), an acyl group (acetyl, benzoyl), a carbonyl group, a sulfonyl group (methanesulfonyl, ethanesulfonyl), a sulfamoyl group (N-methylsulfamoyl, sulfamoyl) or a carbamoyl group (carbamoyl, N,N-dimethylcarbamoyl). The specific examples include 2-hydroxyethyl, 2-methoxyethyl, 2-(2-hydroxyethoxy)ethyl, 3-oxobutyl, 2-carbamoylethyl, ethoxycarbonylmethyl, 2-sulfamoylethyl, methasulfonylethyl, 2,2,3,3,-tetrafluoropropyl, carboxymethyl, carboxyethyl, sulfoethyl, 2-hydroxysulfopropyl, sulfopropyl, 4-sulfobutyl, 3-sulfobutyl, methyl, ethyl, i-butyl and pentyl.

The examples of the alkenyl group include allyl and 3-sulfopropenyl.

The examples of the aralkyl group include that containing a substituent on a benzene ring, such as p-hydroxybenzyl, p-sulfobenzyl, p-carboxybenzyl, m-sulfamoylbenzyl and p-sulfophenethyl, m-carboxyphenethyl, benzyl and phenethyl.

The examples of the lower alkyl group represented by R0, $R_{30}$ and $R_{50}$ include an alkyl group havlng 1 to 5 carbon atoms, such as methyl, ethyl and propyl.

The examples of the aralkyl group include benzyl and phenethyl.

As to the group or atom represented by $V_1$ to $V_4$, $V_{11}$ to $V_{12}$, $V_{41}$ to $V_{43}$, $V_{51}$ to $V_{58}$, and $V_{61}$ to $V_{63}$, the examples of the lower alkyl group include an alkyl group having 1 to 3 carbon atoms, such as methyl, ethyl and propyl; those of the halogen atom include fluorine, chlorine and bromine; those of the lower alkoxy group include an alkoxy group having 1 to 3 carbon atoms such as methoxy and ethoxy; and those of the aryl group include phenyl The cations represented by $M_1\oplus$, $M_{11}\oplus$, $M_{21}\oplus$, $M_{31}\oplus$, $M_{41}\oplus$ and $M_{51}\oplus$ include those needed to neutralize the electric charge of the cyanine structure, specifically those selected from the group consisting of a hydrogen ion, an organic ammonium ion (triethyl ammonium, pyridium, triethanol ammonium) and an inorganic metal ion (sodium, potassium, lithium, carcium).

As to the group represented by $V_{13}$, $V_{14}$, $V_{21}$ to $V_{24}$, $V_{61}$ and $V_{62}$, the carbamoyl groups include carbamoyl, N,N-dimethylcarbamoyl, N-methylcarbamoyl and morpholinocarbonyl; the alkoxycarbonyl groups include ethoxycarbonyl and butoxycarbonyl the aryloxycarbonyl groups include phenoxycarbonyl; the acyl groups include acetyl and benzoyl; the sulfonyl groups include methanesulfonyl, benzenesulfonyl and trifluoromethylsulfonyl; the sulfamoyl groups include sulfamoyl, N-methylsufamoyl, morpholinosulfonyl, N,N-tetramethylenesulfamoyl, N,N-dimethylsulfamoyl and N-phenylsulfamoyl.

The representative examples of the sensitizing dyes represented by Formulae [$I_A$] to [$I_F$] and the supersensitizers represented by Formula [$I_G$] are given below, but should not be construed as limiting the scope of the invention:

$I_A$-1

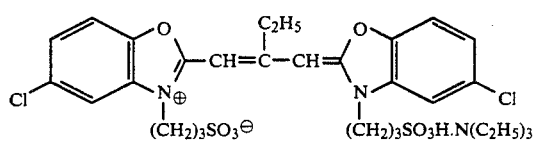

$I_A$-2

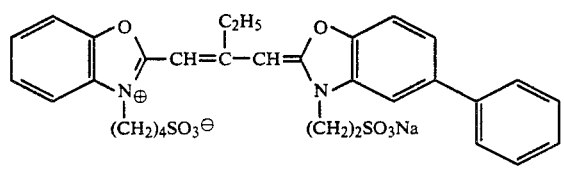

$I_A$-3

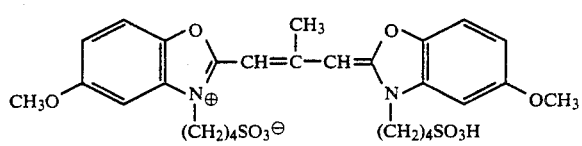

$I_A$-4

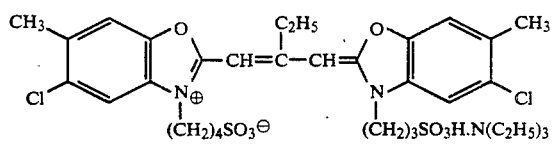

$I_A$-5

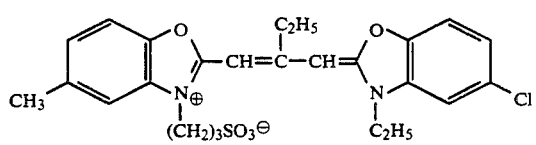

$I_A$-6

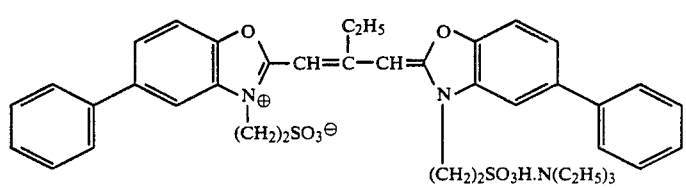

-continued
$I_A$-7
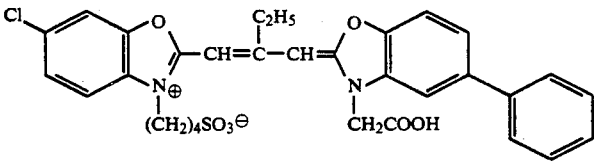
$I_A$-8
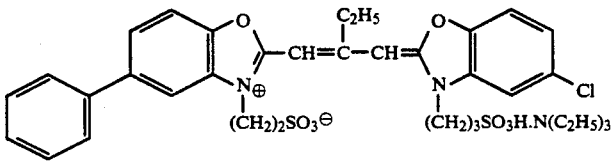
$I_A$-9
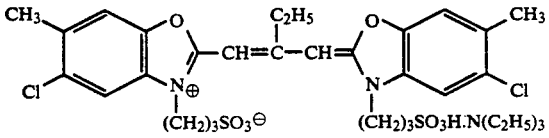
$I_A$-10
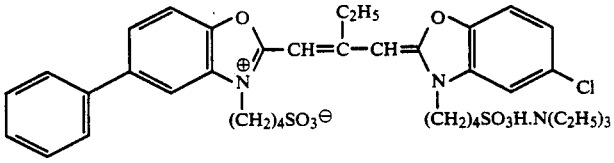
$I_A$-11
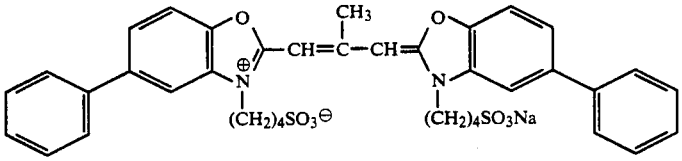
$I_A$-12
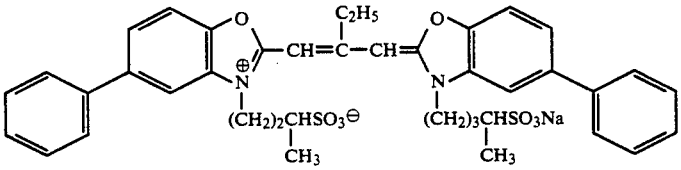
$I_A$-13
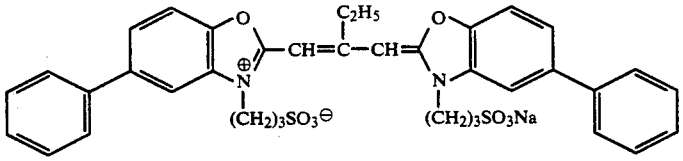
$I_A$-14
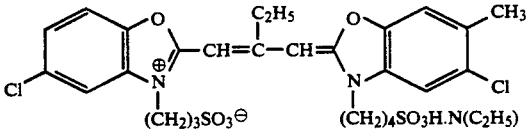
$I_A$-15
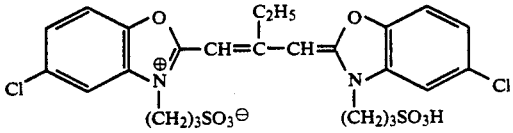

-continued
$I_A$-16
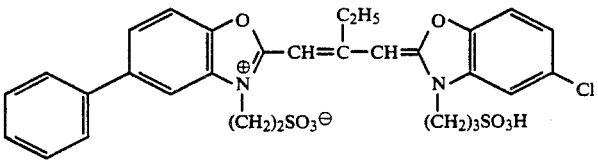
$I_A$-17
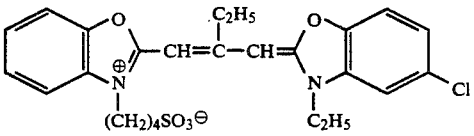
$I_A$-18
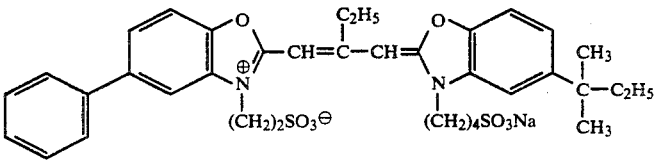
$I_A$-19
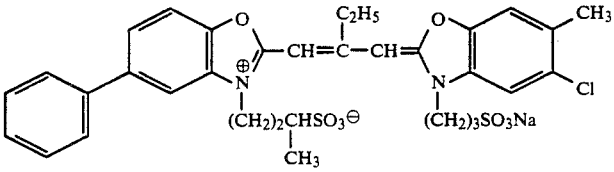
$I_A$-20
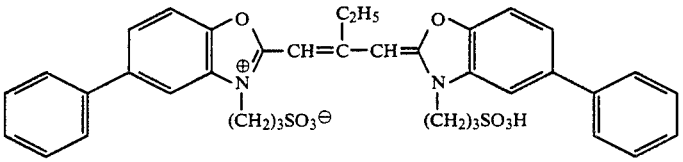
$I_A$-21
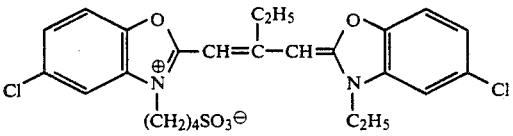
$I_B$-1
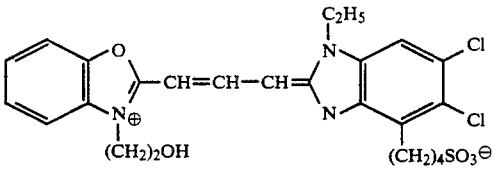
$I_B$-2
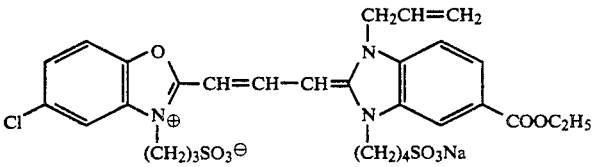
$I_B$-3
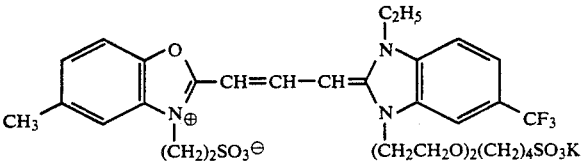

-continued
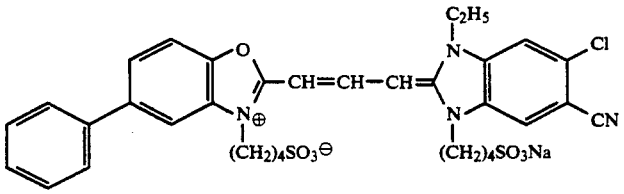
$I_B$-4
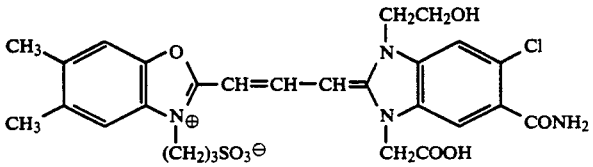
$I_B$-5
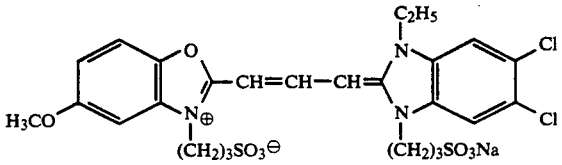
$I_B$-6
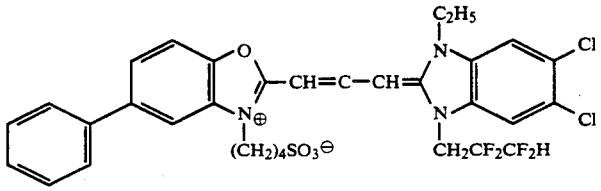
$I_B$-7
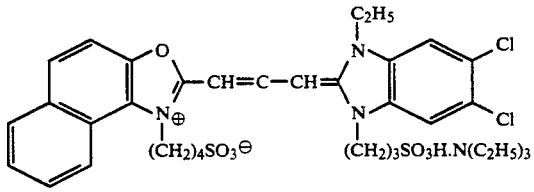
$I_B$-8
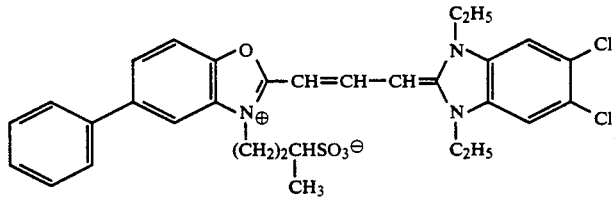
$I_B$-9
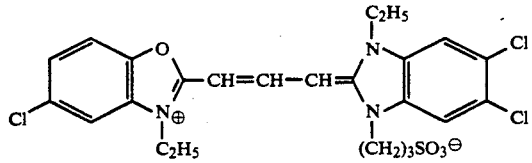
$I_B$-10
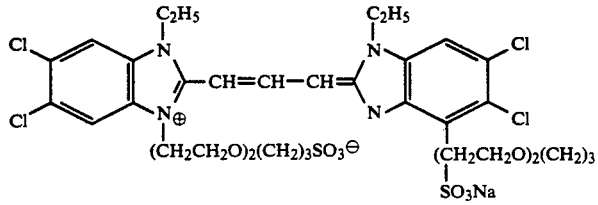
$I_c$-1

-continued
$I_c$-2
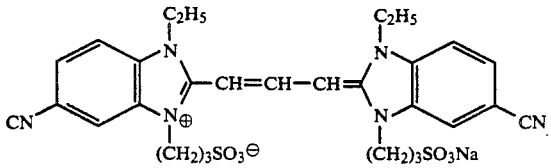
$I_c$-3
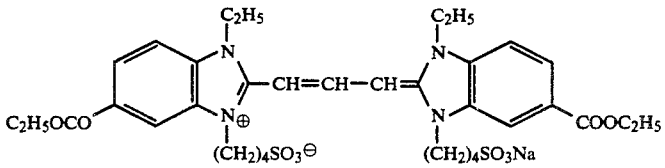
$I_c$-4
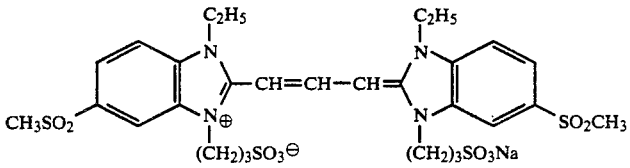
$I_c$-5
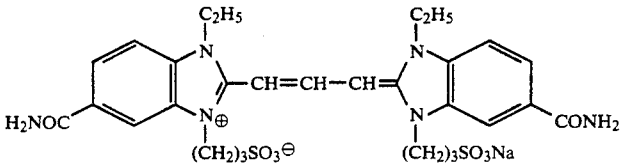
$I_c$-6
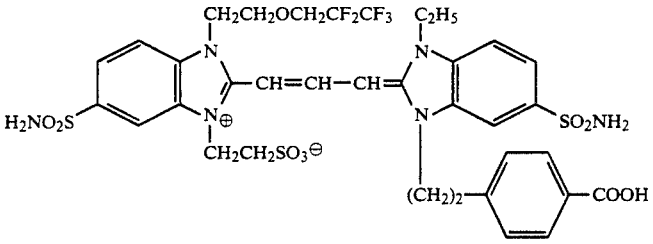
$I_c$-7
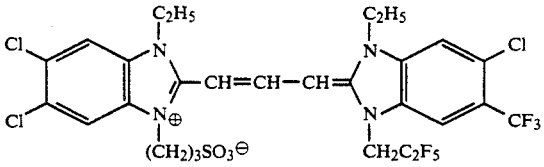
$I_c$-8
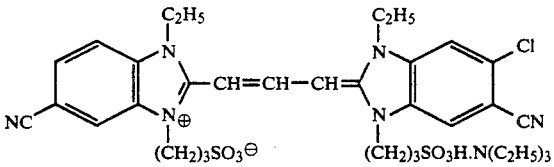
$I_c$-9
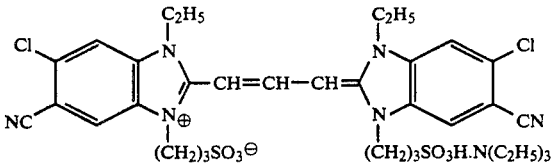
$I_D$-1
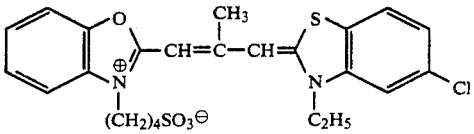

-continued
$I_D$-2
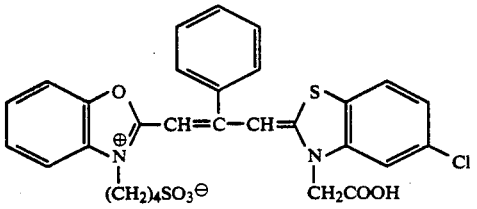
$I_D$-3
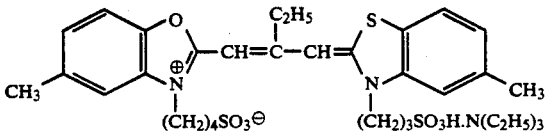
$I_D$-4
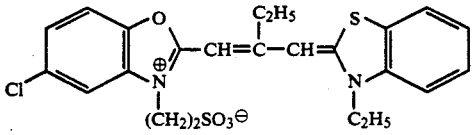
$I_D$-4
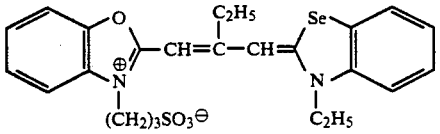
$I_D$-5
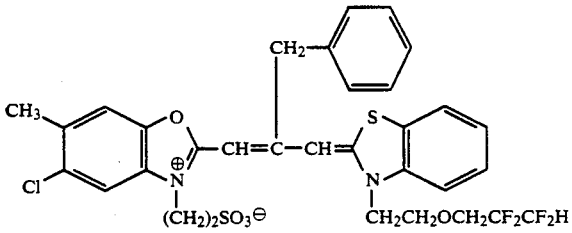
$I_D$-7
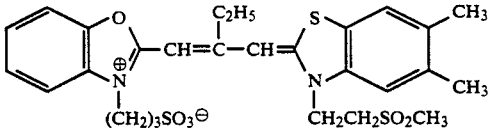
$I_D$-8
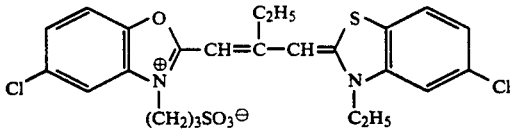
$I_D$-9
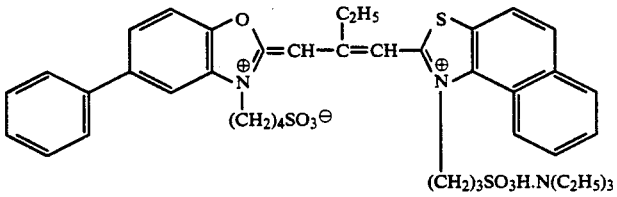
$I_D$-10
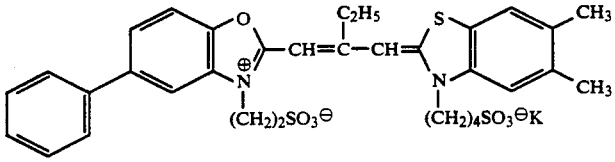

-continued
$I_E$-1
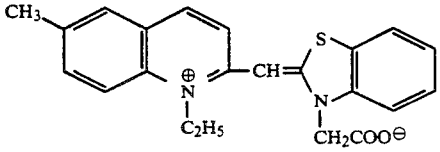
$I_E$-2
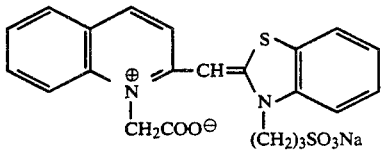
$I_E$-3
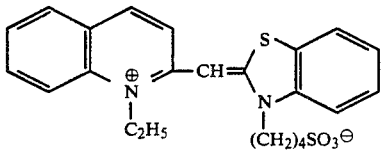
$I_E$-4
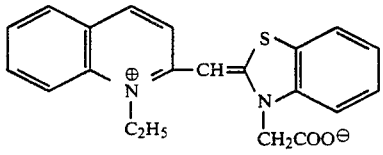
$I_E$-5
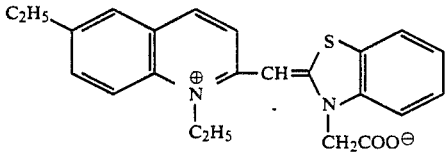
$I_E$-6
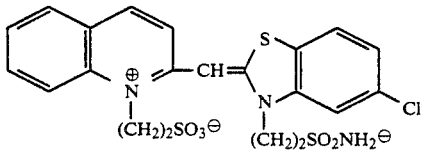
$I_E$-7
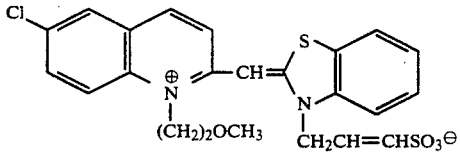
$I_F$-1
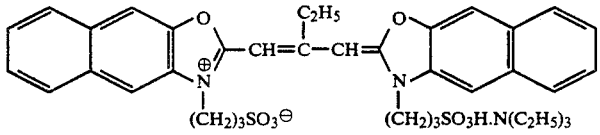
$I_F$-2
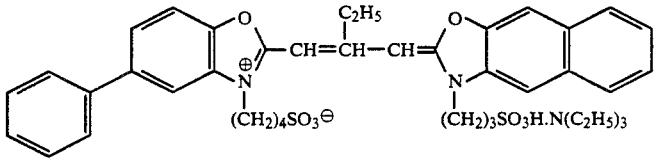

-continued
$I_F$-3
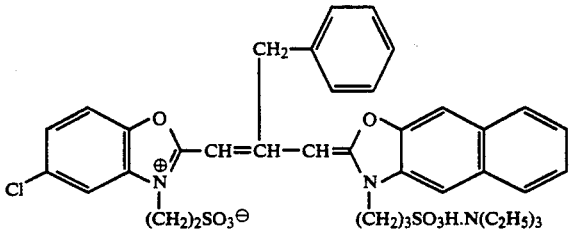
$I_F$-4
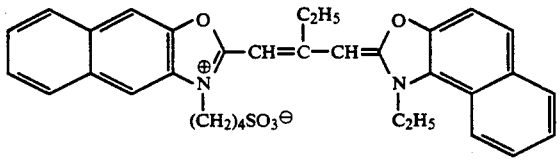
$I_F$-5
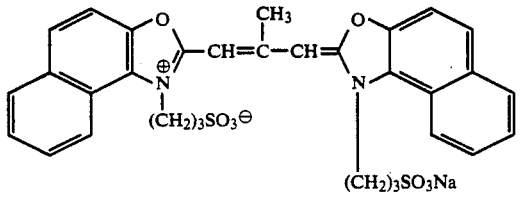
$I_F$-6
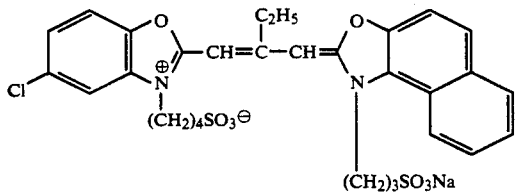
$I_F$-7
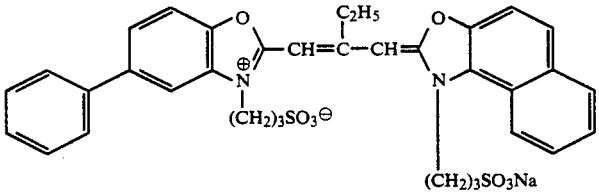
Ig-1
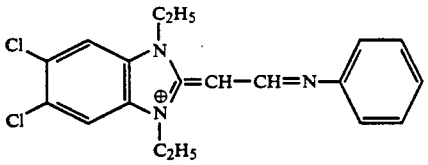
Ig-2
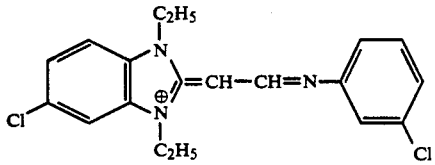
Ig-3
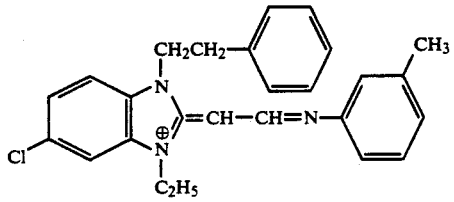

-continued

Ig-4

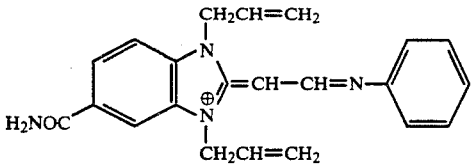

Ig-5

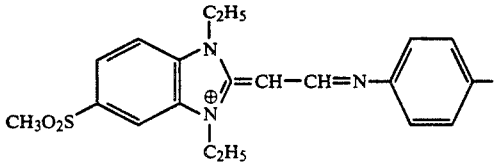

Ig-6

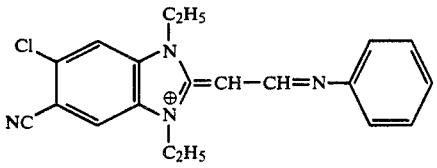

Ig-6

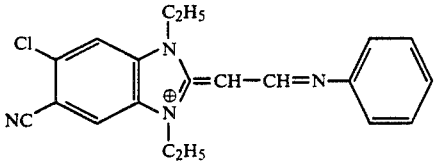

Ig-7

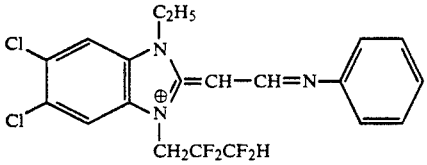

Ig-8

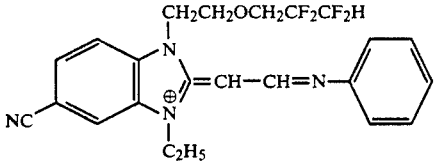

The objects of the invention can be attained further more satisfactorily by a silver halide color photographic light-sensitive material having a support and provided thereon a red-sensitive silver halide emulsion layer, a green-sensitive silver halide emulsion layer and a blue-sensitive silver halide emulsion layer, wherein said red-sensitive silver halide emulsion layer is of three-layer structure in which a low-speed elemental emulsion layer, a medium-speed elemental emulsion layer and a high-speed elemental emulsion layer are provided in this sequence from the side facing the support; wherein the sensitivities of said low-speed elemental emulsion layer that give a minimum density (D min)+0.1 at wavelengths of 600 nm, 620 nm, 640 nm, 660 nm and 680 nm respectively satisfy the following relationships:

$$0.5S_{640}<S_{600}<0.9S_{640},$$

$$0.7S_{640}<S_{620}<1.2S_{640},$$

$$0.4S_{640}<S_{660}<0.9S_{640}, \text{ and}$$

$$S_{680}<0.4S_{640}$$

provided that the reciprocals of an amount of exposure that give a minimum density (D min)+0.1 at wavelengths of 600 nm, 620 nm, 640 nm, 660 nm and 680 nm are $S_{600}$, $S_{620}$, $S_{640}$, $S_{660}$ and $S_{680}$, respectively; and wherein the maximum color density of said low-speed elemental emulsion layer of said red-sensitive silver halide emulsion layer is not more than 0.35.

The sensitivies of the low-speed elemental emulsion layer of the red-sensitive emulsion layer at the preceding specific wavelengths are determined by the following method, as in the case of the preceding medium-speed elemental emulsion layer of the green-sensitive emulsion layer.

PREPARATION OF SAMPLE

A single layer of the following constitution is formed on a support (the amounts of ingredients were expressed in terms of gram per square meter, unless otherwise indicated. The amount of a silver halide was the amount converted to the amount of silver).

| | |
|---|---|
| Silver halide | 1.0 |
| Cyan coupler (C-34) | 0.70 |
| Colored cyan coupler (CC-1) | 0.066 |
| DIR compound (D-23) | 0.04 |

-continued

| | |
|---|---|
| High boiling point solvent (Oil-1) | 0.64 |
| Gelatin | 4.0 |

Besides the above ingredients, a coating aid (SUa-1), a dispersion aid (SUa-2) and a hardener (Ha-1) were added to the layer. The chemical formulae of these additives are given later.

EXPOSURE AND DEVELOPMENT

The sample obtained is exposed to white light through optical wedge and interference filters (KL-59 to KL-70 ; manufactured by Toshiba Glass Co., Ltd.) for 1/100 seconds, and processed according to the following procedures [P]. Color development time is 1 minute and 45 second. The peak wavelength and transmittance of each filter is measured prior to the exposure by means of a spectrophotometer (Type 320; manufactured by Hitachi Ltd.), and the results are summarized as follows:

| Filter | λ (nm) | Relative transmittance |
|---|---|---|
| KL-59 | 587.0 | 0.974 |
| KL-60 | 598.0 | 0.962 |
| KL-61 | 606.5 | 1.188 |
| KL-62 | 616.5 | 1.011 |
| KL-63 | 625.5 | 0.768 |
| KL-64 | 635.0 | 1.000 |
| KL-65 | 647.0 | 0.813 |
| KL-66 | 660.0 | 1.093 |
| KL-67 | 668.0 | 0.860 |
| KL-68 | 675.0 | 0.841 |
| KL-69 | 687.0 | 1.308 |
| KL-70 | 695.0 | 0.741 |

*Relative transmittance, obtained when the transmittance of KL-64 is set at 1.000.

The density of the portion on which the wedge is put is measured by means of a densitometer (X-rite). The reciprocal of an exposure that gives a minimum density+0.1 (sensitivity) is obtained, and the value is corrected with the transmittance of each filter. Such reciprocal is obtained for each exposure wavelength, thereby to obtain a spectral sensitivity distribution.

When the sensitivities at wavelengths of 640 nm, 600 nm, 620 nm, 660 nm and 680 nm are designated as $S_{640}$, $S_{600}$, $S_{620}$, $S_{660}$ and $S_{680}$, respectively, it is more preferred that they satisfy the following relationships:

$$0.6S_{640}<S_{600}<0.8S_{640},$$

$$0.8S_{640}<S_{620}<1.1S_{640},$$

$$0.5S_{640}<S_{660}<0.7S_{640}, \text{ and}$$

$$0.05S_{640}<S_{680}<0.3S_{640}$$

The preceding spectral sensitivity distribution can be obtained by the combined use of at least one of the sensitizing dyes represented by Formula (I) and at least one of the sensitizing dyes represented by Formulae (II) and (III). It is especially preferred that at least one of the sensitizing dyes represented by Formula (I), at least one of the sensitizing dyes represented by Formula (II), and at least one of the sensitizing dyes represented by Formula (III) be employed in combination.

A supersensitizer can be used besides the sensitizing dyes represented by Formulae (I), (II) and (III). As the supersensitizer, use can be made of benzothiazoles and quinolones described in Japanese Patent Examined Publication No. 24533/1982. Quinoline derivatives described in Japanese Patent Examined Publication No. 24899/1982 can be also employed according to purpose.

The sensitizing dyes represented by Formulae (I), (II) and (III) will be described in detail below:

Formula (I)

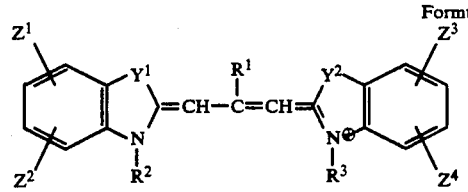

$(X_1^{\oplus})_{m-1}$ wherein $R^1$ represents a hydrogen atom, an alkyl group or an aryl group; $R^2$ and $R^3$ each represent an alkyl group; $Y^1$ and $Y^2$ each represent a sulfur atom or a selenium atom; $Z^1$, $Z^2$, $Z^3$ and $Z^4$ each represent a hydrogen atom, a halogen atom, a hydroxy group, an alkoxy group, an amino group, an acyl group, an acylamino group, an acyloxy group, an aryloxy group, an alkoxycarbonyl group, an aryloxycarbonyl group, an alkoxycarbonylamino group, a sulfonyl group, a carbamoyl group, an aryl group, an alkyl group or a cyano group, and $Z^1$ and $Z^2$ and/or $Z^3$ and $Z^4$ may combine with each other to form a ring; $X_1^{\oplus}$ represents an cation; and m represents an integer of 1 or 2, and when the sensitizing dye forms an intramolecular salt, m is 1.

Formula (II)

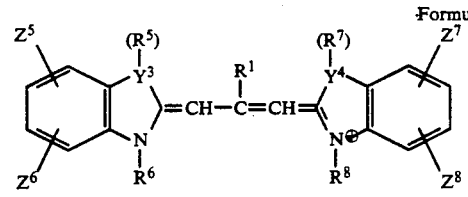

$(X_2^{\oplus})_{n-1}$ wherein $R^4$ represents a hydrogen atom, an alkyl group or an aryl group; $R^5$, $R^6$, $R^7$ and $R^8$ each represent an alkyl group; $Y^3$ and $Y^4$ each represent a nitrogen atom, an oxygen atom, a sulfur atom or a selenium atom, and the sensitizing dye does not contain $R^5$ when $Y^3$ is a sulfur atom, an oxygen atom or a selenium atom, and $Y^3$ and $Y^4$ cannot be nitrogen simultaneously; $Z^5$, $Z^6$, $Z^7$ and $Z^8$ each represent a hydrogen atom, a halogen atom, a hydroxy group, an alkoxy group, an amino group, an acylamino group, an acyloxy group, an aryloxy group, an alkoxycarbonyl group, an aryloxycarbonyl group, an alkoxycarbonylamino group, a carbamoyl group, an aryl group, an alkyl group, a cyano group or a sulfonyl group; $Z^5$ and $Z^6$ and/or $Z^7$ and $Z^8$ may combine with each other to form a ring; $X_2^{\oplus}$ represents an cation; and n represents an integer of 1 or 2, when the sensitizing dye forms an intramolecular salt, n is 1.

Formula (III)

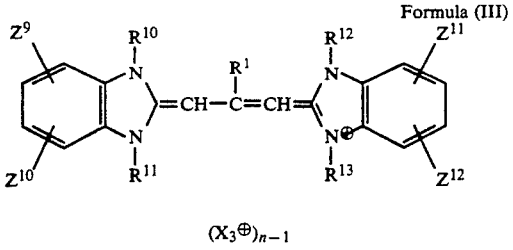

wherein $R^9$ represents a hydrogen atom, an alkyl group or an aryl group; $R^{10}$, $R^{11}$, $R^{12}$ and $R^{13}$ each represent an alkyl group; $Z^9$, $Z^{10}$, $Z^{11}$ and $Z^{12}$ each represent a hydrogen atom, a halogen atom, a hydroxyl group, an alkoxy group, an amino group, an acyl group, an acylamino group, an acyloxy group, an aryloxy group, an alkoxycarbonyl group, an aryloxycarbonyl group, an alkoxycarbonylamino group, a carbamoyl group, an aryl group, an alkyl group, a cyano group or a sulfonyl group, and $Z^9$ and $Z^{10}$ and/or $Z^{11}$ and $Z^{12}$ may combine with each other to form a ring; $X_3\oplus$ represents an cation; and n represents an integer of 1 or 2, and when the sensitizing dye forms an intramolecular salt, n is 1.

(I-1)

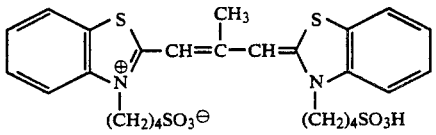

(I-2)

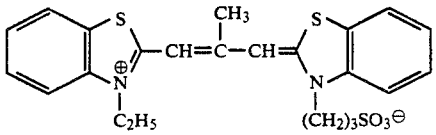

(I-3)

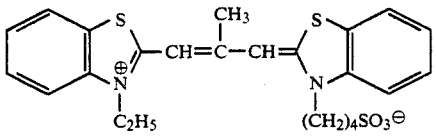

(I-4)

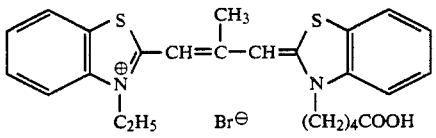

(I-5)

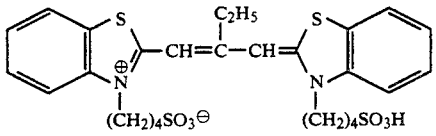

(I-6)

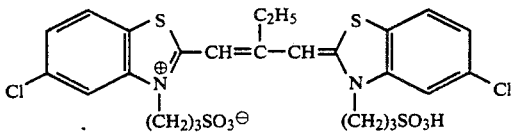

(I-7)

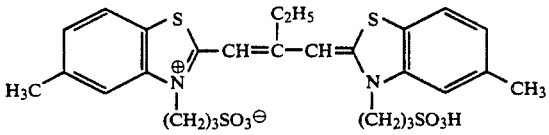

(I-8)

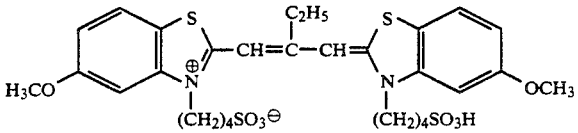

-continued
(I-9)
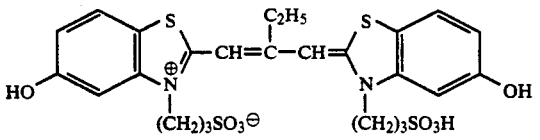
(I-10)
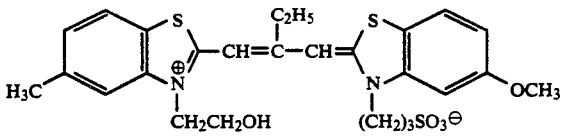
(I-11)
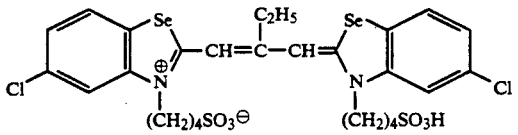
(I-12)
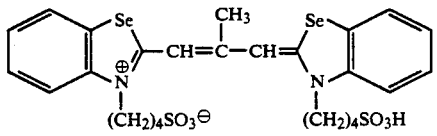
(I-13)
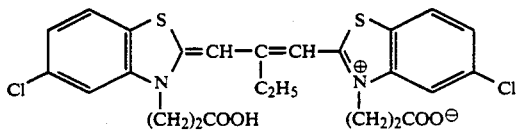
(I-14)
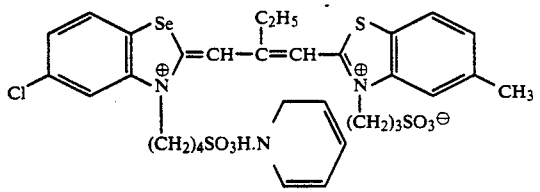
(I-15)
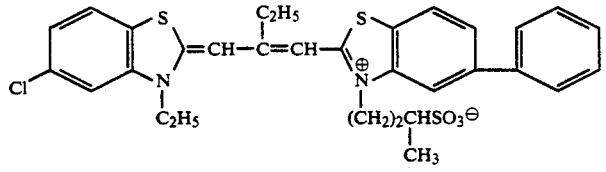
(I-16)
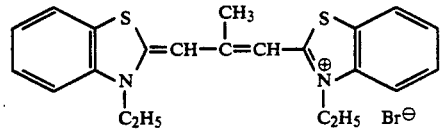
(I-17)
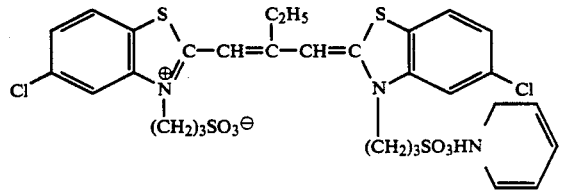

-continued
(I-18)
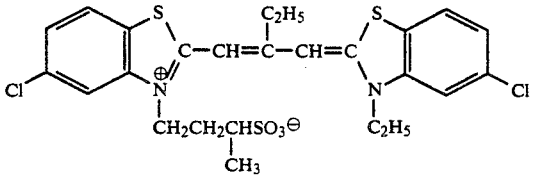
(I-19)
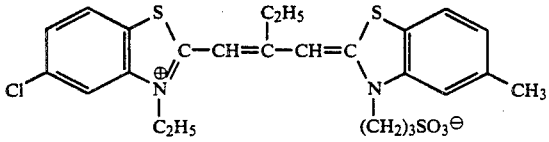
(I-20)
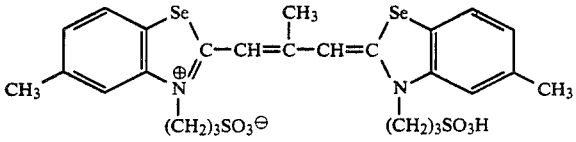
(I-21)
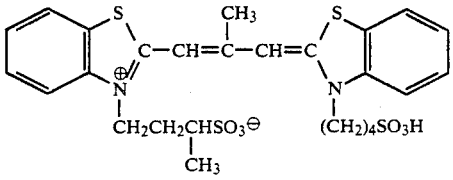
(I-22)
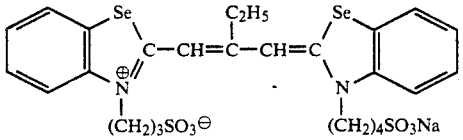
(I-23)
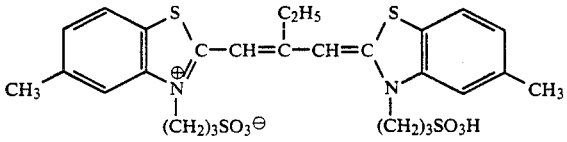
(I-24)
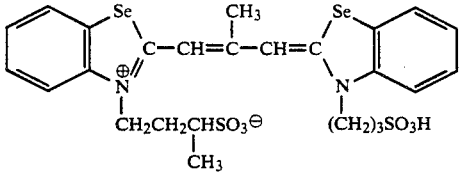
(I-25)
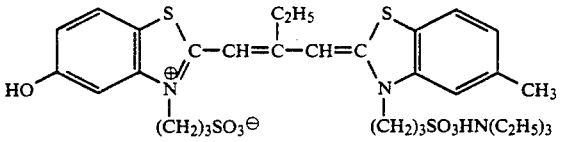
(I-26)
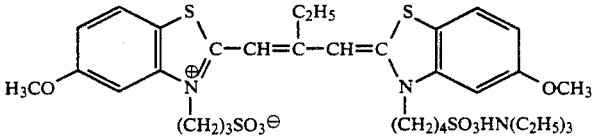

-continued
(I-27)
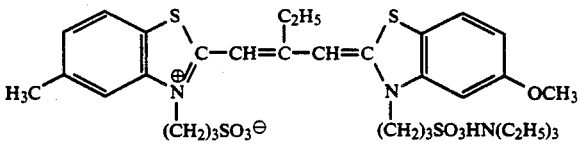
(I-28)
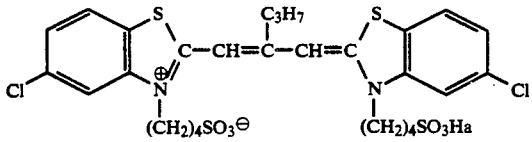
(I-29)
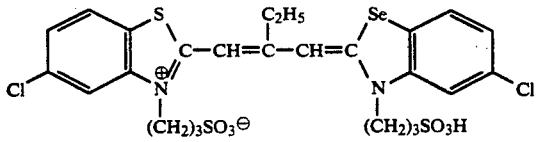
(I-30)
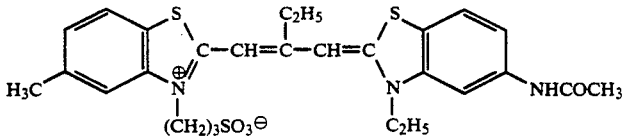
(I-31)
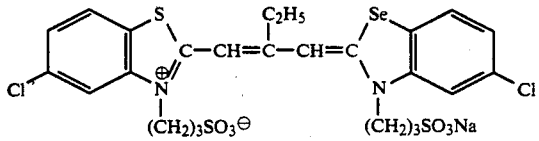
(I-32)
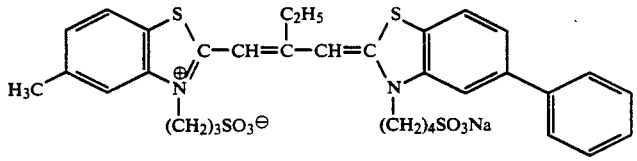
(I-33)
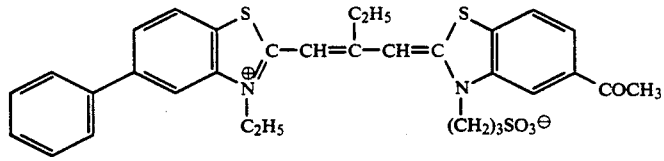
(I-34)
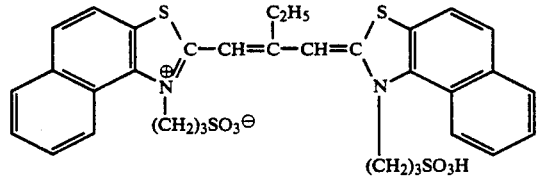
(I-35)
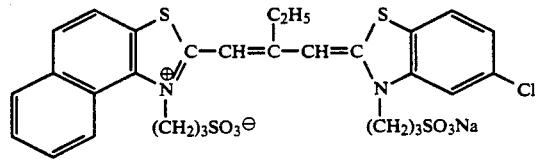

-continued
(I-36)
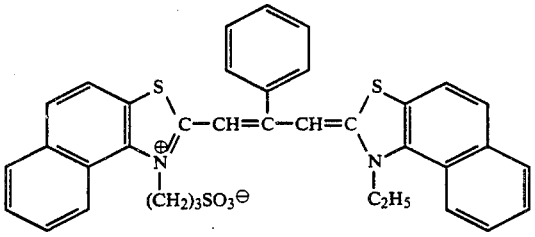
(I-37)
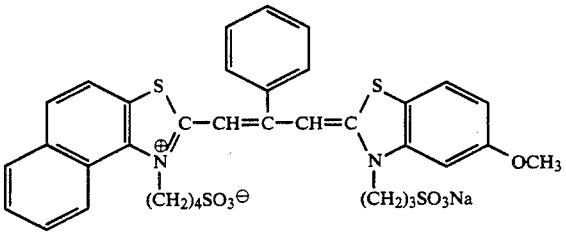
(I-38)
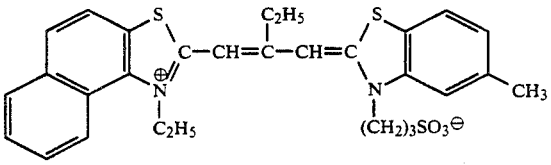
(I-39)
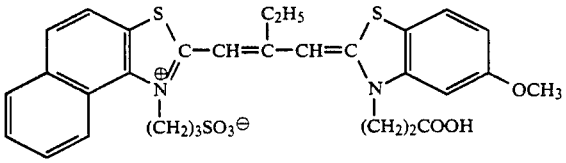
(I-40)
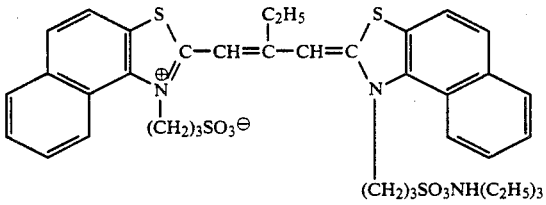
(I-41)
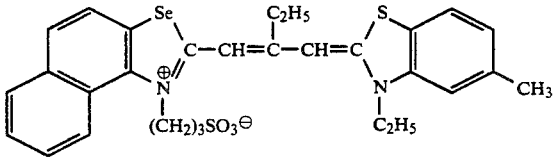
(I-42)
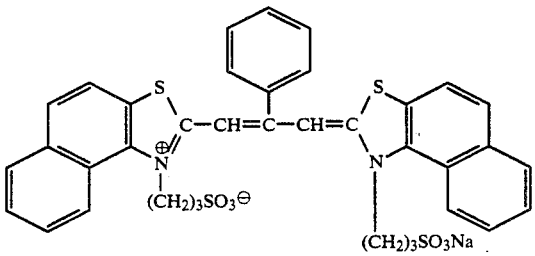

-continued
(I-43)
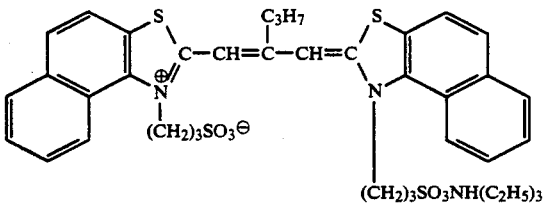
(I-44)
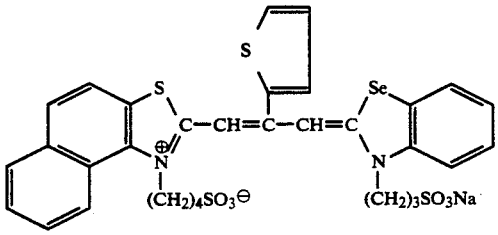
(I-45)
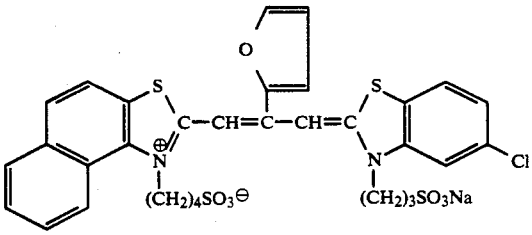
(I-46)
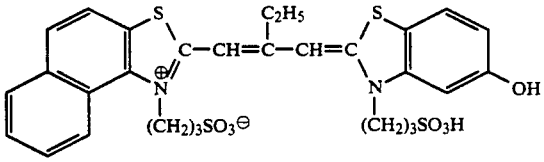
(II-1)
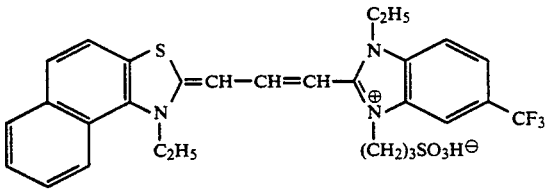
(II-2)
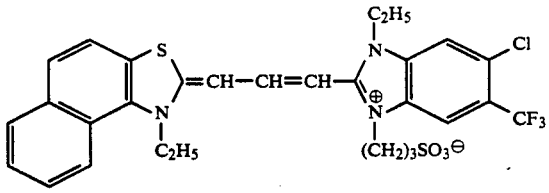
(II-3)
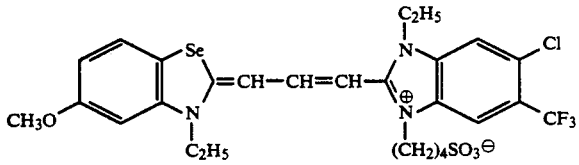
(II-4)
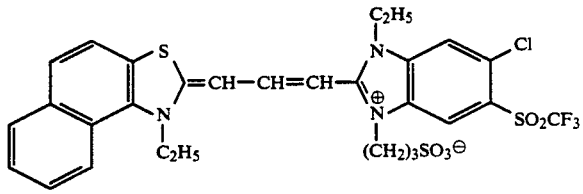

-continued
(II-5)
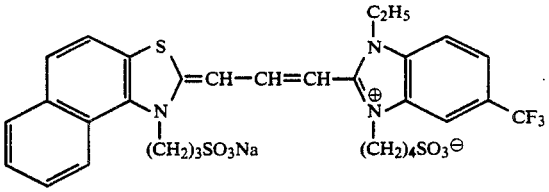
(II-6)
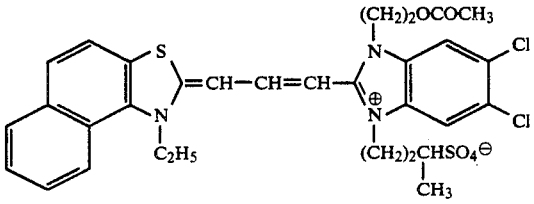
(II-7)
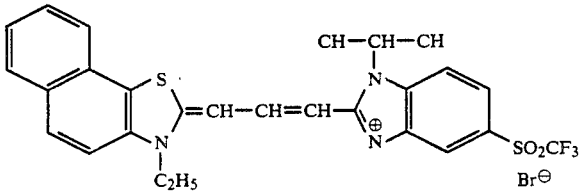
(II-8)
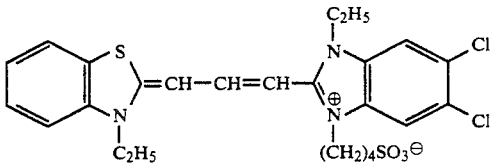
(II-9)
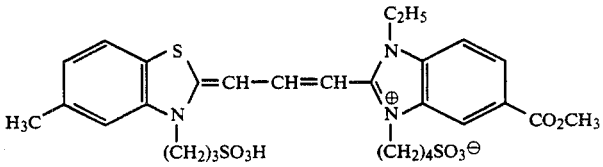
(II-10)
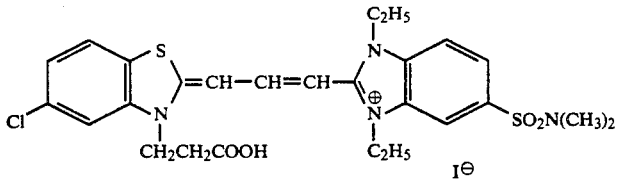
(II-11)
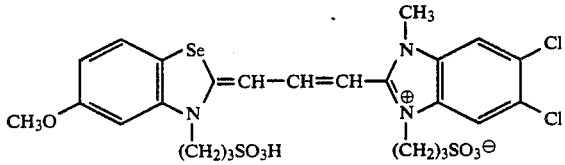
(II-12)
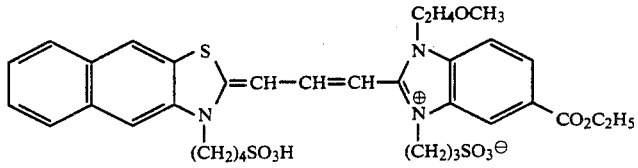

-continued
(II-13)
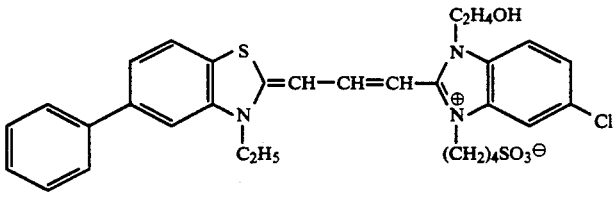
(II-14)
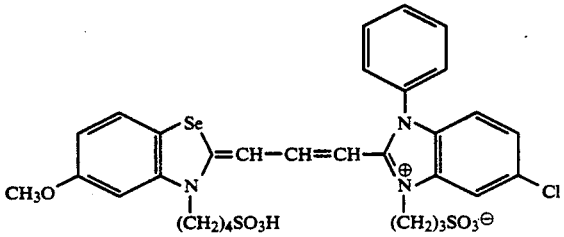
(II-15)
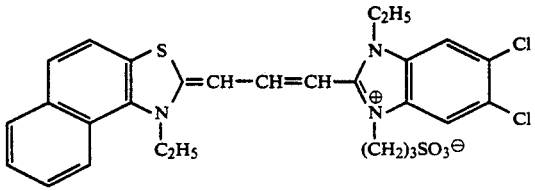
(II-16)
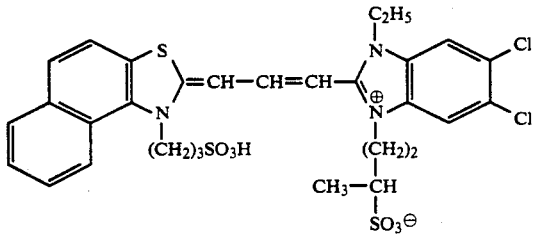
(II-17)
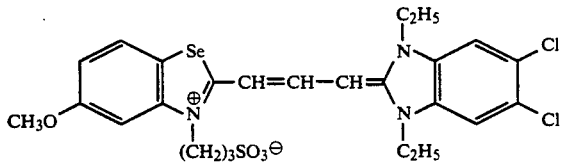
(II-18)
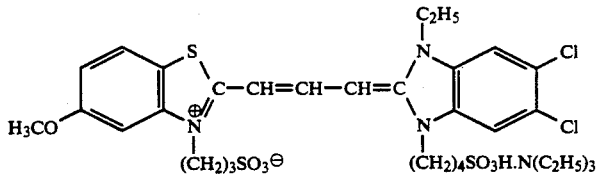
(II-19)
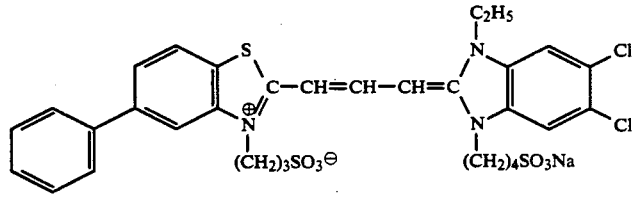
(II-20)
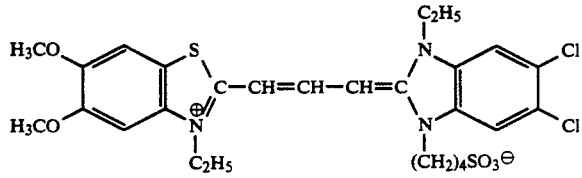

-continued
(II-21)
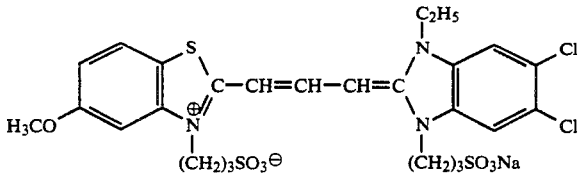
(II-22)
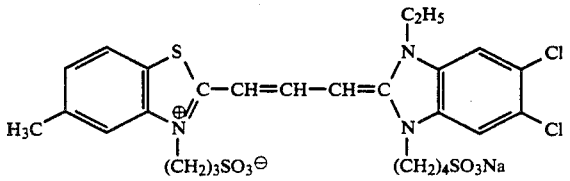
(II-23)
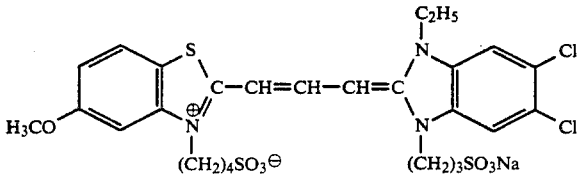
(II-24)
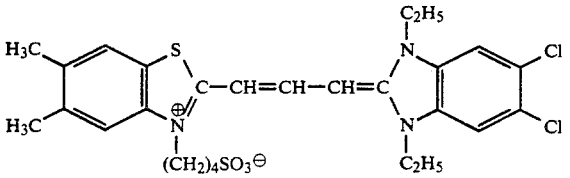
(II-25)
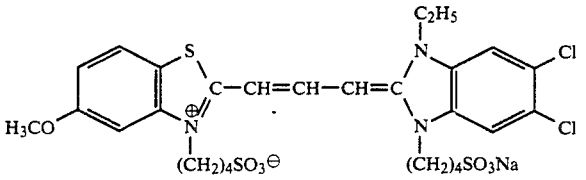
(II-26)
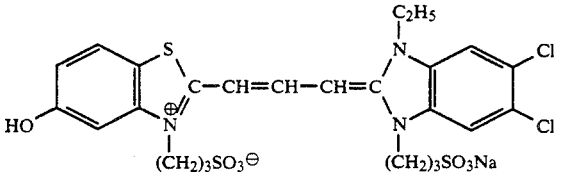
(II-27)
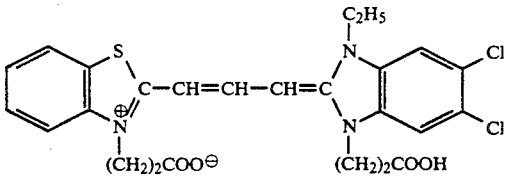
(II-28)
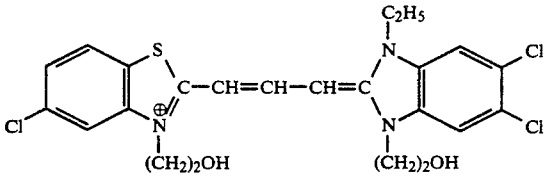
(II-29)
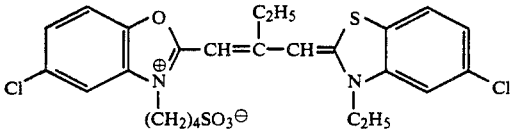

-continued
(II-30)
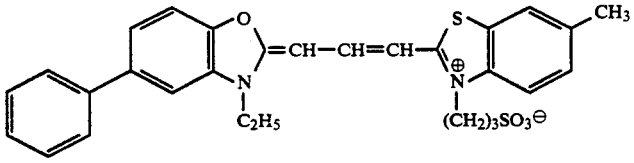
(II-31)
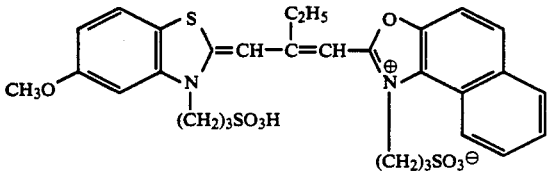
(II-32)
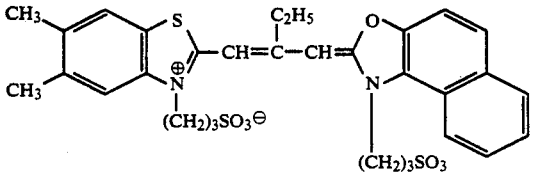
(II-33)
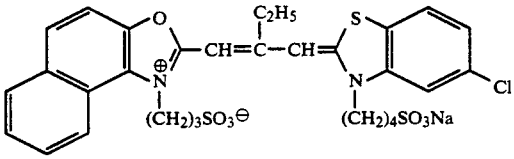
(II-34)
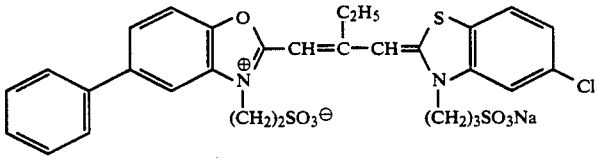
(II-35)
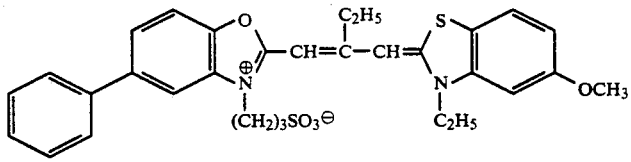
(II-36)
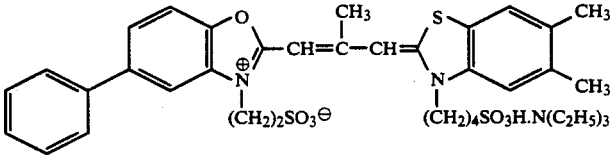
(II-37)
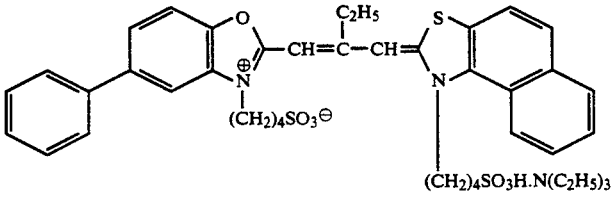

-continued
(II-38)
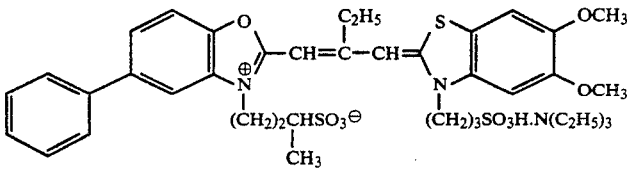
(II-39)
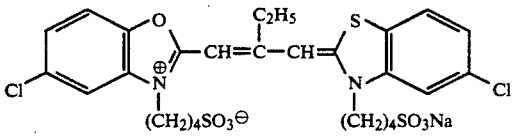
(II-40)
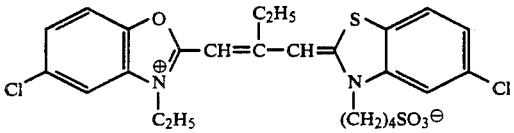
(III-1)
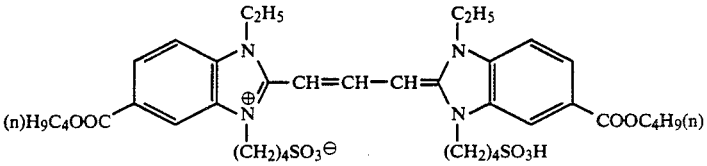
(III-2)
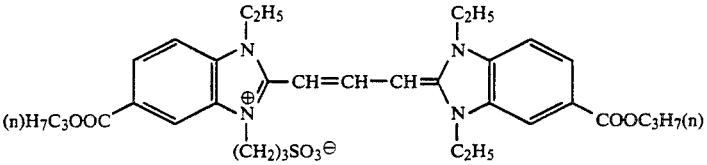
(III-3)
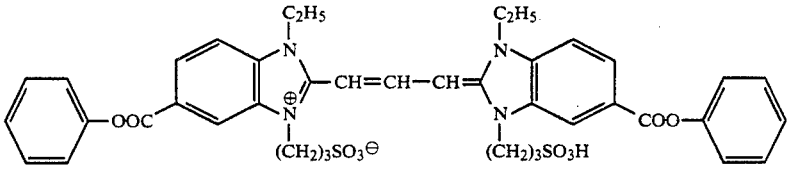
(III-4)
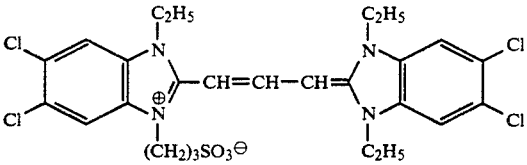
(III-5)
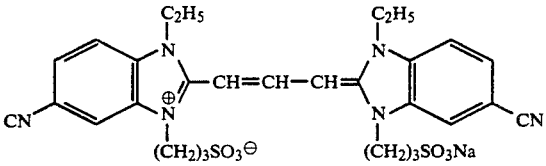
(III-6)
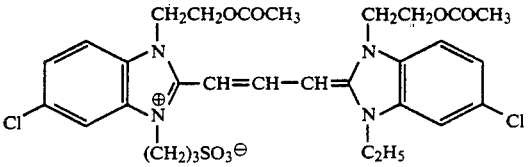

-continued
(III-7)
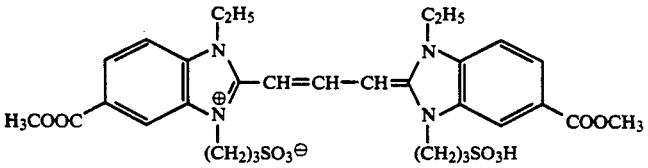
(III-8)
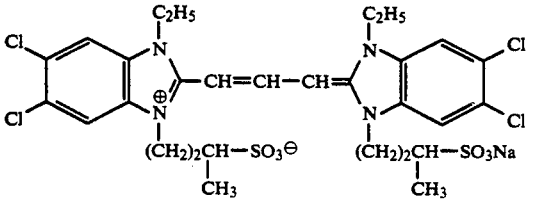
(III-9)
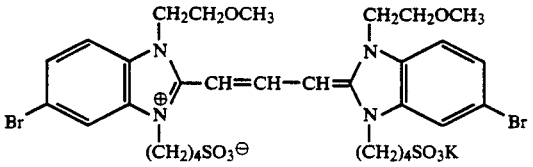
(III-10)
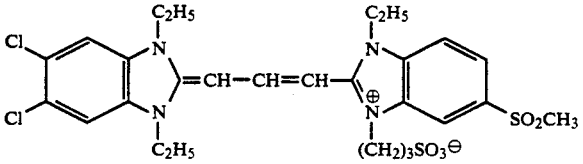
(III-11)
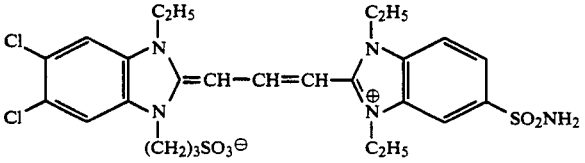
(III-12)
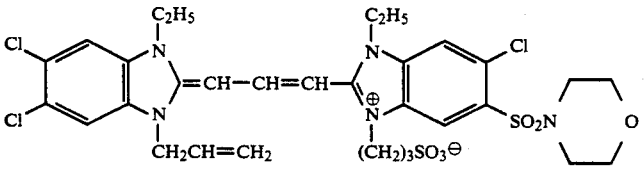
(III-13)
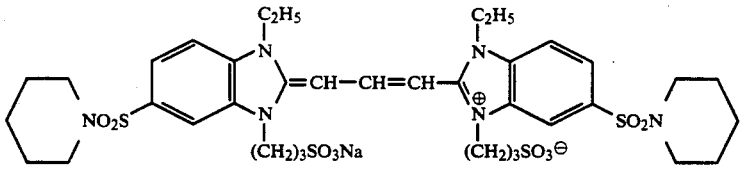
(III-14)
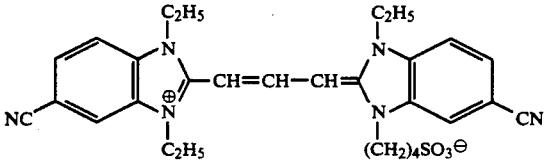
(III-15)
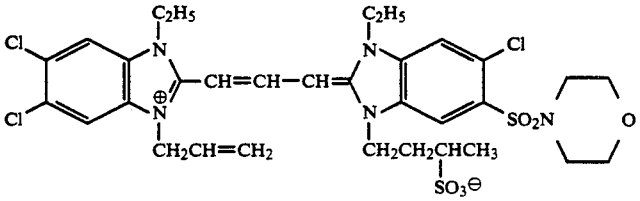

-continued
(III-16)
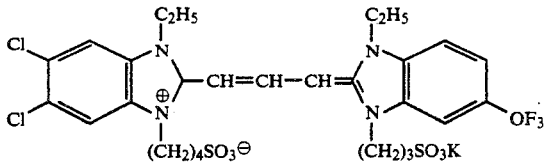
(III-17)
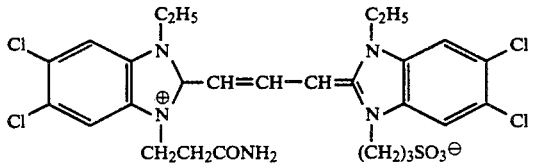
(III-18)
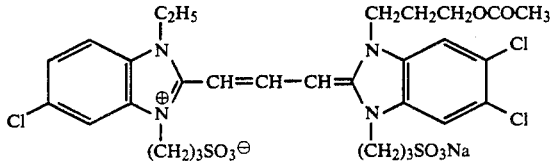
(III-19)
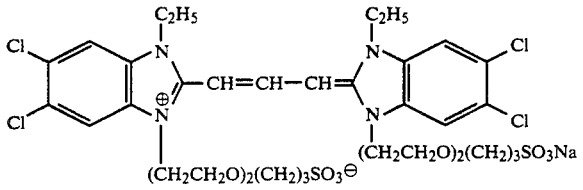
(III-20)
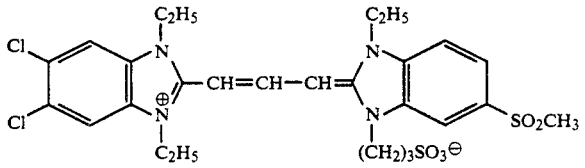
(III-21)
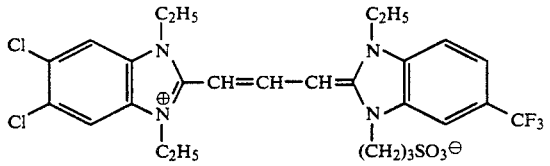
(III-22)
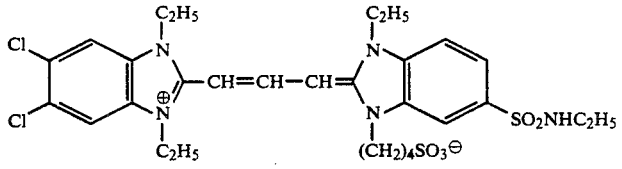
(III-23)
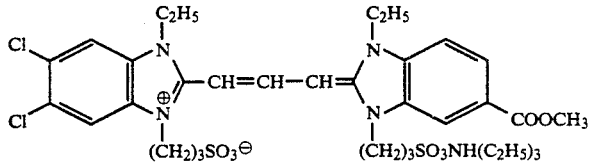
(III-24)
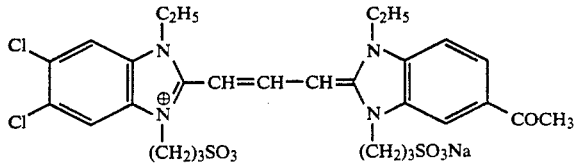

-continued

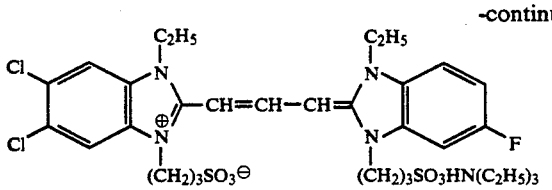
(III-25)

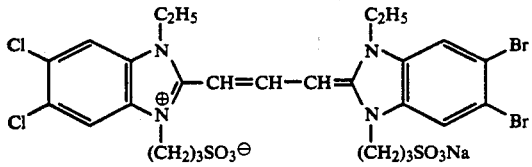
(III-26)

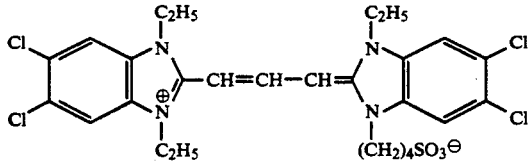
(III-27)

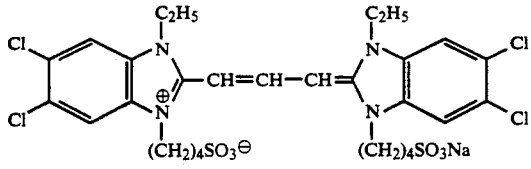
(III-28)

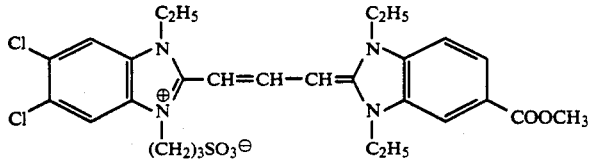
(III-29)

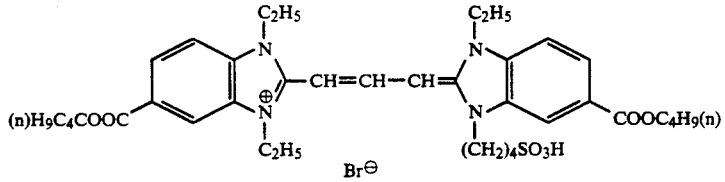
(III-30)

In the present invention, to improve graininess, it is preferred that the high-speed elemental emulsion layer of the red-sensitive emulsion layer contains a two-equivalent coupler. The combined use of a two-equivalent coupler and a four-equivalent coupler is also possible. In this case, it is preferred that the amount of a two-equivalent coupler account for 50 to 100 mol %, more preferably 80 to 100 mol %, of the total amount of couplers contained in the high-sensitive elemental emulsion layer and a four-equivalent coupler account for the rest of couplers. It is especially preferred that all of the couplers contained in this layer be two-equivalent couplers.

The total amount of couplers contained in said high-speed elemental layer is preferably $1\times10^{-4}$ to 1 mol, more preferably $1\times10^{-3}$ to 1 mol, most preferably $3\times10^{-3}$ to $8\times10^{-1}$ mol, per mol silver.

The usable two-equivalent couplers are represented by the following Formula [$C_2$-I]:

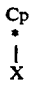

wherein Cp represents a coupler residue; * represents the coupling site of a coupler; and X represents a group capable of being split off when a dye is formed by a coupling reaction between a coupler and an oxidized product of an aromatic primary amine color developing agent.

The representative examples of the coupler residue represented by Cp are described in U.S. Pat. Nos. 2,367,531, 2,423,730, 2,474,293, 2,772,162, 2,895,826, 3,002,836, 3,034,892 and 3,041,236 and the preceding Agfa Mitteillung (Band II), pp 156 to 175 (1961).

Of them, preferred are phenols and naphthols.

The examples of the group represented by X include monovalent groups such as a halogen atom, an alkoxy group, an aryloxy group, a heterocyclic oxy group, an acyloxy group, an alkylthio group, an arylthio group, a heterocyclic thio group,

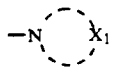

(wherein $X_1$ represents a group of atoms that is needed to form a 5- or 6-membered ring with at least one member selected from the nitrogen atom in the formula, a carbon atom, an oxygen atom, a nitrogen atom and a sulfur atom), an acylamino group and a sulfonamide group, and divalent groups such as an alkylene group. When X is a divalent group, a dimer is formed with X. The specific examples of the groups represented by X are given below:

Halogen atom: Chlorine, Bromine, Fluorine Alkoxy group:

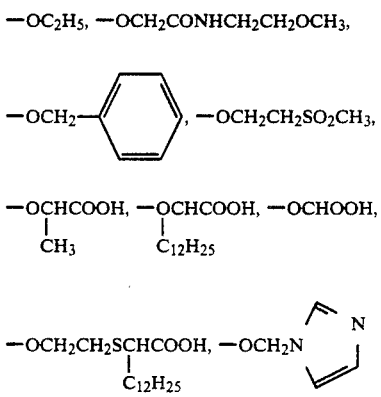

Aryloxy group:

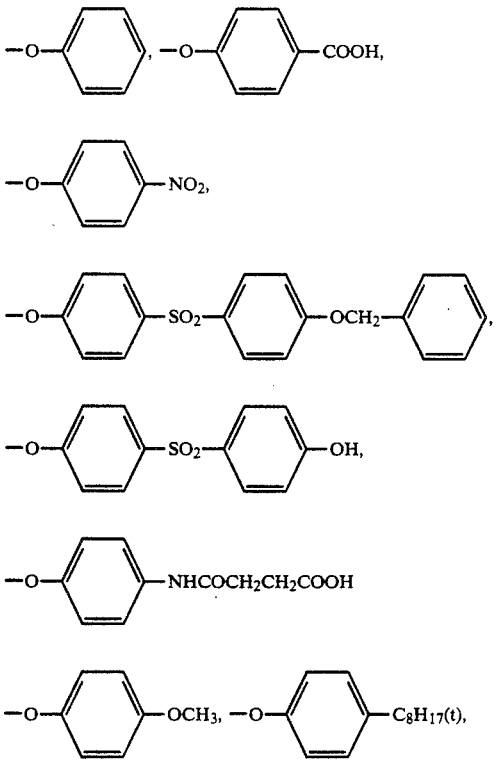

-continued

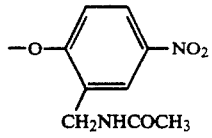

Heterocyclic oxy group:

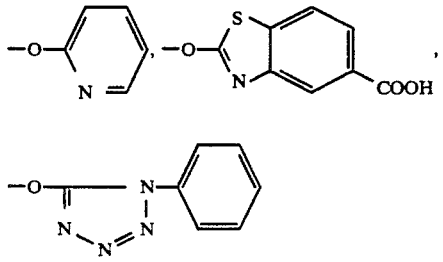

Acyloxy group:

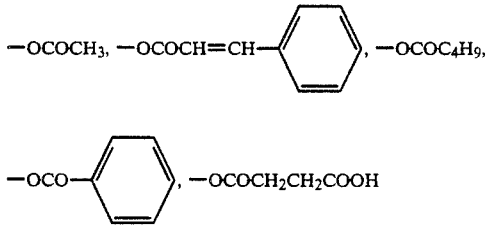

Akoylthio group:

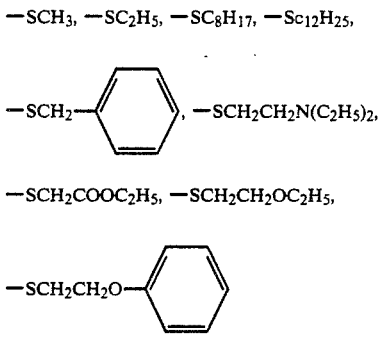

Arylthio group:

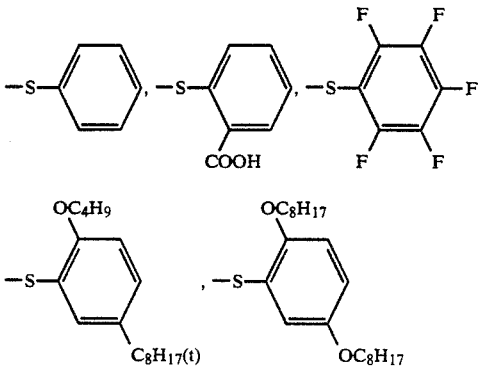

-continued
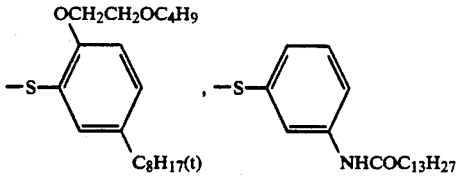
Heterocyclic thio group:
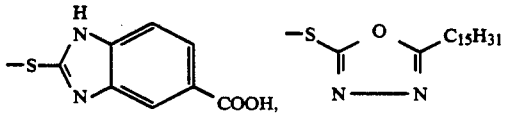
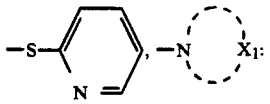
Pyrazolyl group, Imidazolyl group, Triazolyl group, Tetrazolyl group,
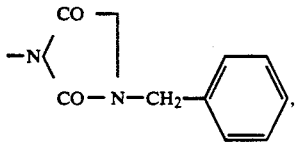
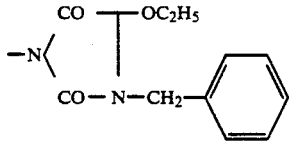
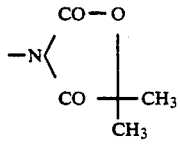
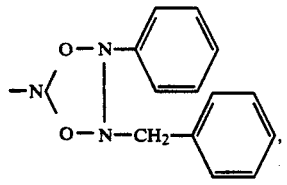
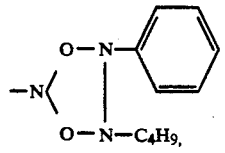
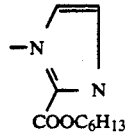
-continued
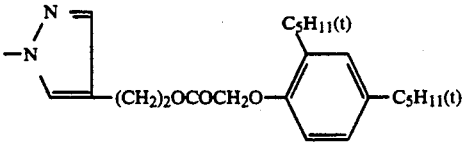
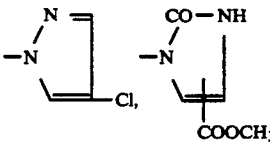
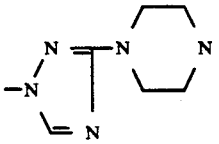
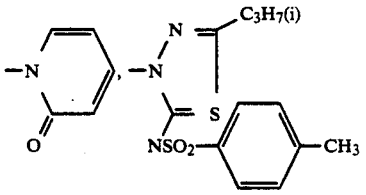
Acylamino group
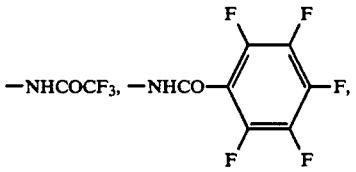
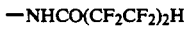
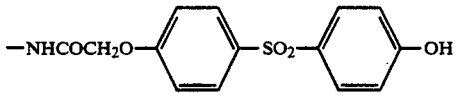
Sulfoneamide group
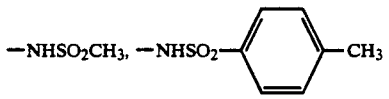
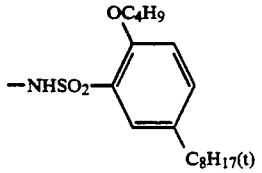
Alkyelene group:

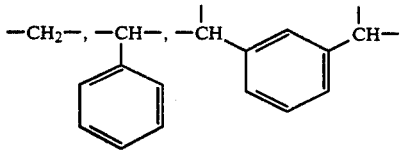

The following are the preferred examples of a two-equivalent cyan coupler:

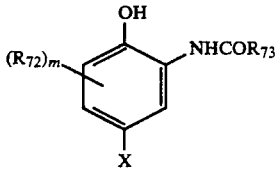

Formula [$C_2$-II]

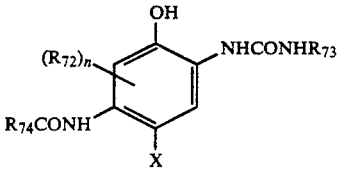

(Formula [$C_2$-III]

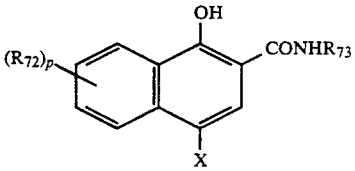

Formula [$C_2$-IV]

wherein $R_{72}$ and $R_{73}$ each represent a hydrogen atom or a substituent, $R_{74}$ represents a substituent, m represents 1 to 3, n represents 1 to 2, p represents 1 to 5, and $R_{72}$ in these formulae may be either identical or different when m, n and p are each not less than 2.

The substituents represented by $R_{72}$ include a halogen atom, and such groups as alkyl, cycloalkyl, aryl and heterocycle that combine directly or through a divalent atom or group.

The examples of the divalent atom or group include oxygen, nitrogen, sulfur, carbonylamino, aminocarbonyl, sulfonylamino, aminosulfonyl, amino, carbonyl, carbonyloxy, oxycarbonyl, ureylene, thioureylene, thiocarbonylamino, sulfonyl and sulfonyloxy.

The preceding alkyl, cycloalkyl, aryl and heterocycle each may have a substituent. The substituents include a halogen atom, nitro, cyano, alkyl, alkenyl, cycloalkyl, aryl, alkoxy, aryloxy, alkoxycarbonyl, aryloxycarbonyl, carboxy, sulfo, sulfamoyl, carbamoyl, acylamino, ureido, urethane, sulfoneamide, heterocycle, arylsulfonyl, alkylsulfonyl, arylthio, alkylthio, alkylamino, anilino, hydroxy, imide and acyl.

The examples of $R_{73}$ include alkyl, cycloalkyl, aryl and heterocycle, which each may have a substituent. The examples of the substituent include those represented by $R_{72}$. The examples of $R_{74}$ include those represented by $R_{73}$.

In the two-equivalent cyan coupler, the examples of X include those represented by the preceding Formula [$C_2$-I]. Of them, a halogen atom, an alkoxy group, an aryloxy group and a sulfoneamide group are especially preferable. The compounds represented by Formulae [$C_2$-II] and [$C_2$-IV] include dimers and polymers larger than dimers formed by $R_{72}$, $R_{73}$ or X, and the compounds represented by Formula [$C_2$-III] include dimers and polymers larger than dimers formed by $R_{72}$, $R_{73}$, $R_{74}$ or X.

The specific examples of the two-equivalent cyan coupler used in the present invention are given below, but they should not be construed as limiting the scope of the invention:

The following are the preferred examples of a two-equivalent cyan coupler:

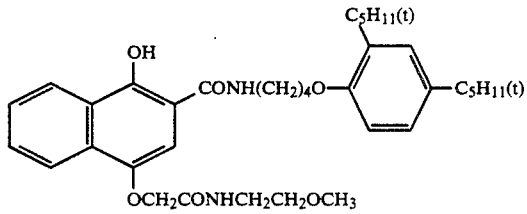

$C_2$-1

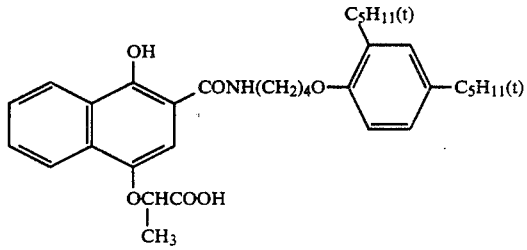

$C_2$-2

-continued
C2-3
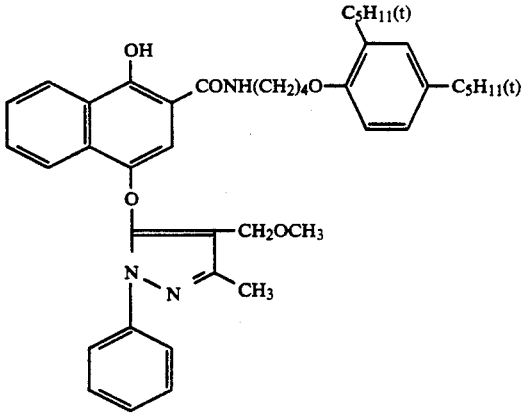
C2-4
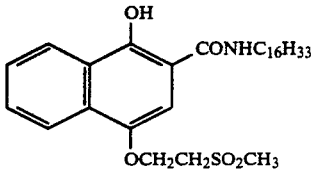
C2-5
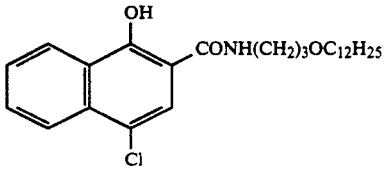
C2-6
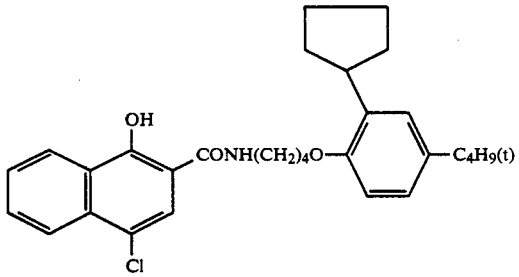
C2-7
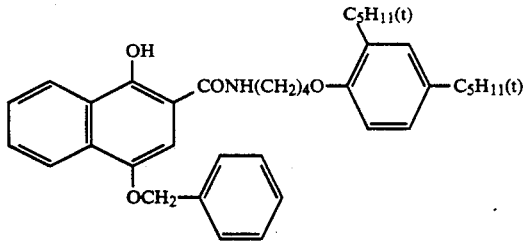
C2-8
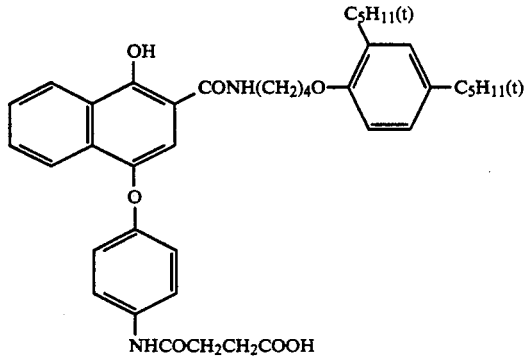

-continued
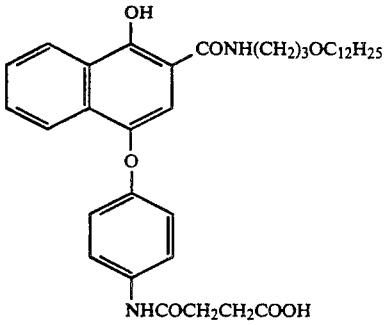
$C_2$-9
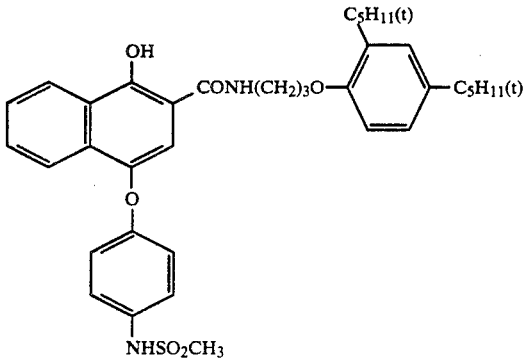
$C_2$-10
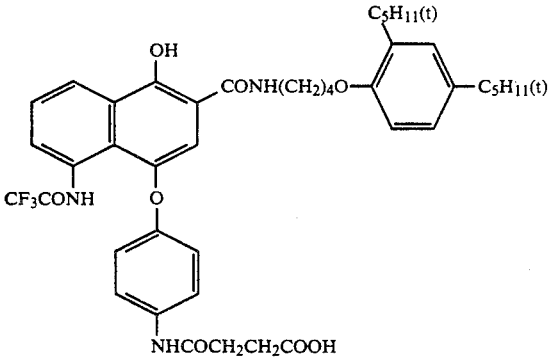
$C_2$-11
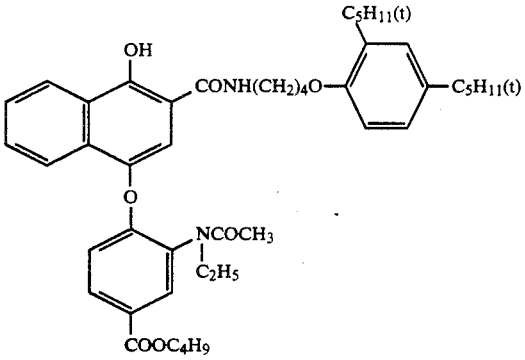
$C_2$-12
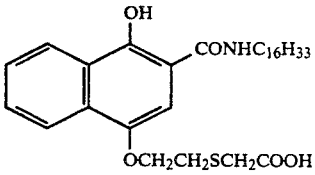
$C_2$-13

-continued
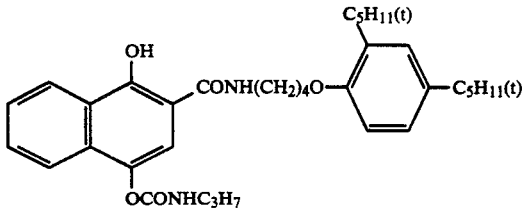
$C_2$-14
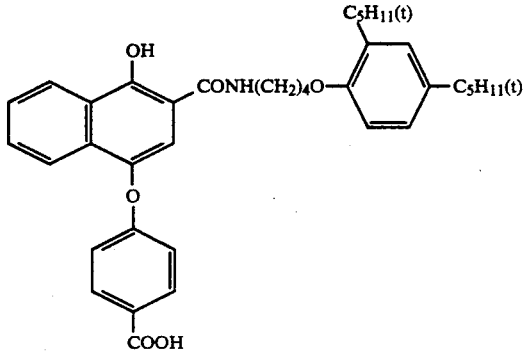
$C_2$-15
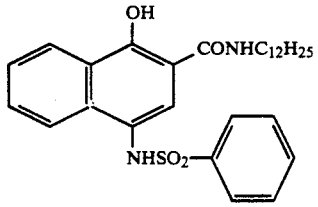
$C_2$-16
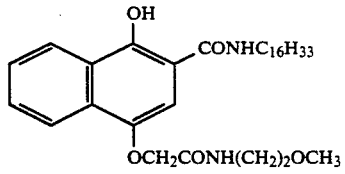
$C_2$-17
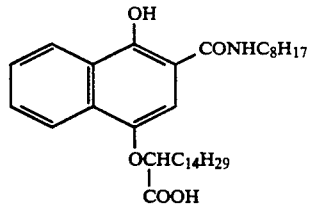
$C_2$-18
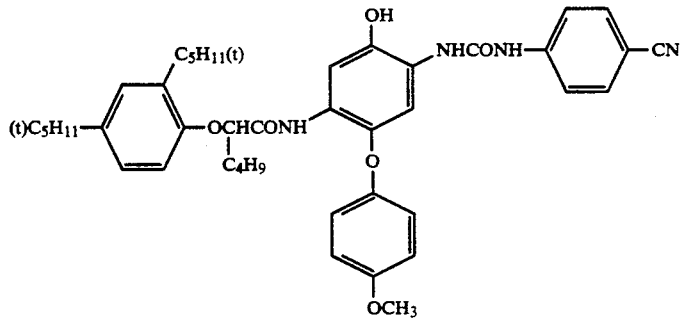
$C_2$-19

-continued
$C_2$-20
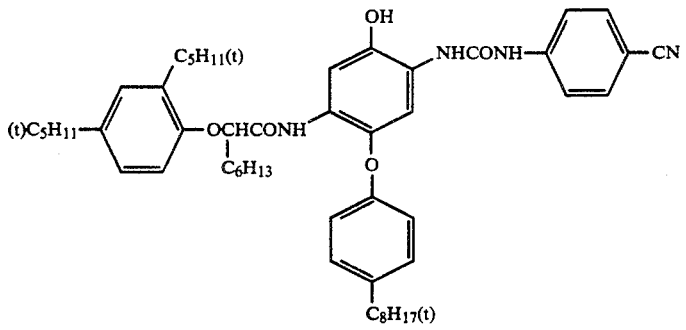
$C_2$-21
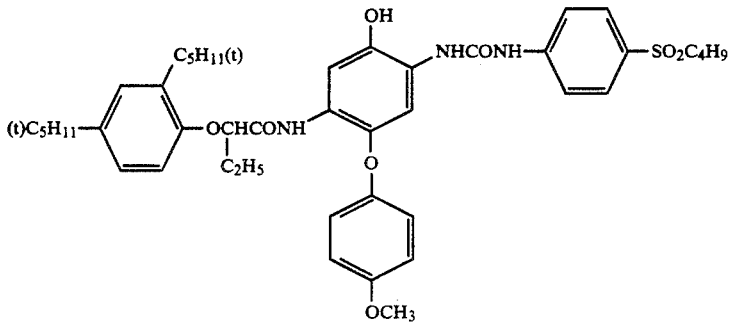
$C_2$-22
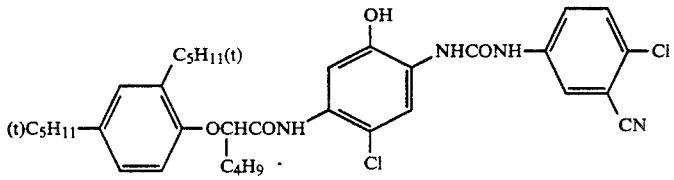
$C_2$-23
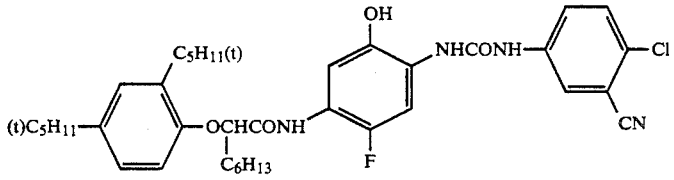
$C_2$-24
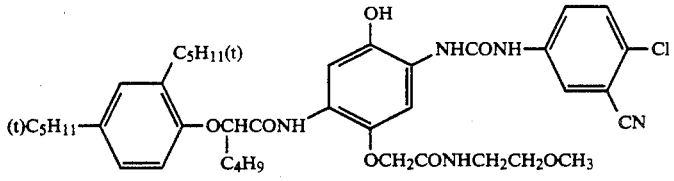
$C_2$-25
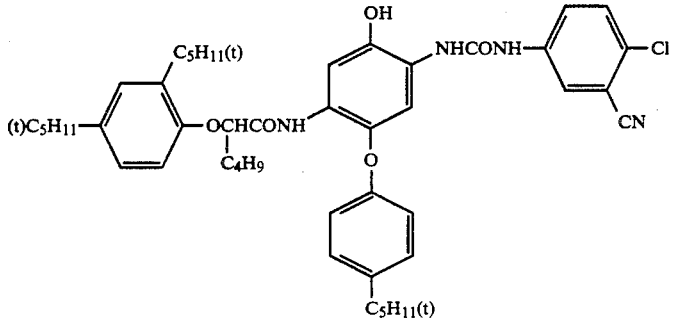

-continued
$C_2$-26
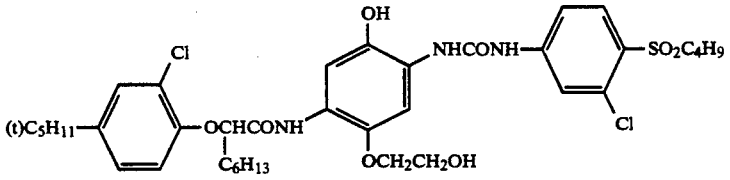
$C_2$-27
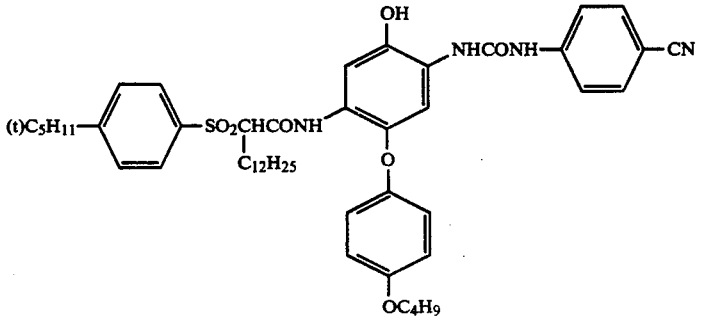
$C_2$-28
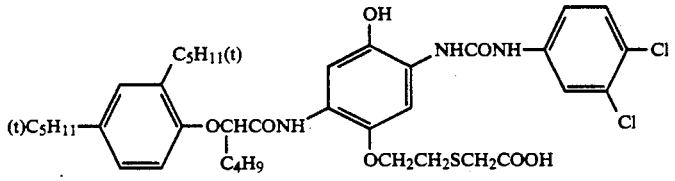
$C_2$-29
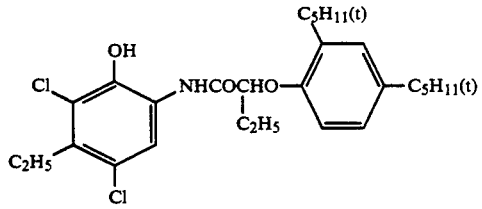
$C_2$-30
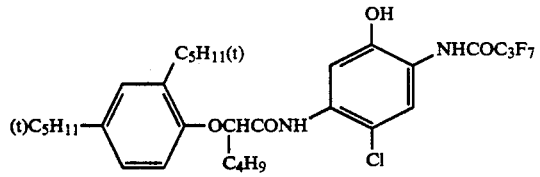
$C_2$-31
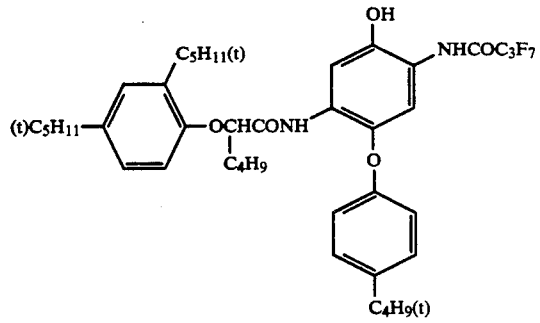

-continued

C2-32

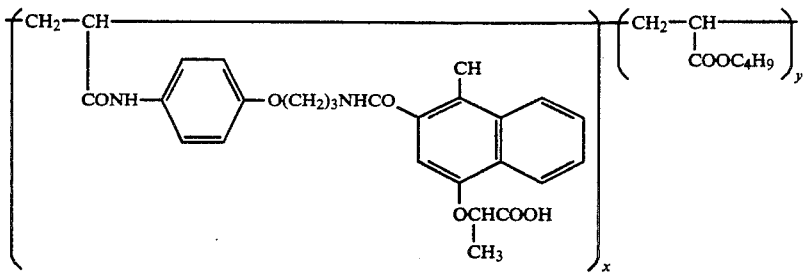

x:y = 40:60 (Weight ratio)

C2-33

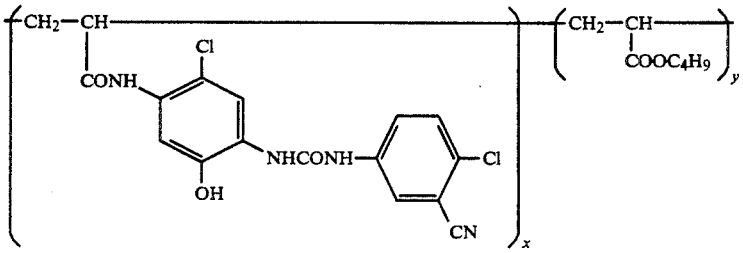

x:y = 50:50 (Weight ratio)

To improve graininess, at least one of the high-speed elemental emulsion layers of the light-sensitive material of the invention preferably contains a DIR compound. A DIR compound means a compound which allows a development inhibitor or a compound capable of releasing a development inhibitor to be split off upon a reaction with an oxidized product of a color developing agent.

The compound capable of releasing a development inhibitor may be either a compound which releases a development inhibitor imagewise or a compound which releases a development inhibitor non-imagewise.

The former compounds include compounds which release an inhibitor upon a reaction with an oxidized product of a color developing agent, and the latter compounds include compounds containing a TIME group which will be explained later.

The representative examples are given below:

A-(Y)m Formula (D-1)

wherein A represents a coupler residue; m represents 1 or 2; and Y represents a group which is combined with A at its coupling site, and capable of being split off upon a coupling reaction with an oxidized product of a color developing agent to release a development inhibiting group or a group capable of releasing a development inhibitor.

The representative examples of Y are given by the following formulae (D-2) to (D-20):

Formula (D-2)

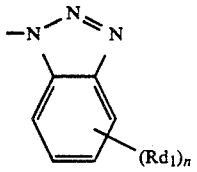

-continued

Formula (D-3)

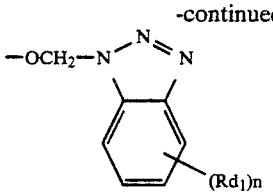

Formula (D-4)

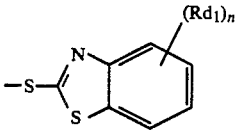

Formula (D-5)

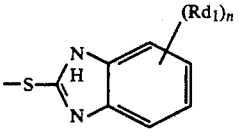

Formula (D-6)

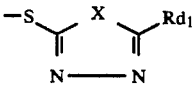

Formula (D-7)

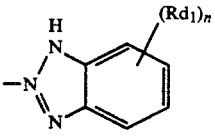

Formula (D-8)

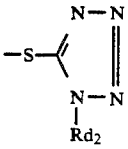

-continued

Formula (D-9)

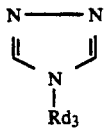

In the above formulae (D-2) to (D-7), $Rd_1$ represents a hydrogen atom, a halogen atom or groups such as alkyl, alkoxy, acylamino, alkoxycarbonyl, thiazolidinylideneamino, aryloxycarbonyl, acyloxy, carbamoyl, N-alkylcarbamoyl, N,N-dialkylcarbamoyl, nitro, amino, N-arylcarbamoyloxy, sulfamoyl, N-alkylcarbamoyloxy, hydroxy, alkoxycarbonylamino, alkylthio, arylthio, aryl, heterocycle, cyano, alkylsulfonyl and aryloxycarbonylamino.

n Represents 0, 1 or 2, and when n is 2, $Rd_1$ may be either identical or not. The total number of carbon atoms contained in $nRd_1$ is 0 to 10.

In Formula (D-6), the number of carbon atoms contained in $Rd_1$ is 0 to 15.

In Formula (D-6), X represents an oxygen atom or a sulfur atom.

In Formula (D-8), $Rd_2$ represents an alkyl group, an aryl group or a heterocyclic group.

In Formula (D-9), $Rd_3$ represents a hydrogen atom or groups such as alkyl, cycloalkyl, aryl or heterocycle and $Rd_4$ represents a hydrogen atom, a halogen atom or groups such as alkyl, cycloalkyl, aryl, acylamino, alkoxycarbonylamino, aryloxycarbonylamino, alkanesulfoneamide, cyano, heterocycle, alkylthio and amino.

When $Rd_1$, $Rd_2$, $Rd_3$ or $Rd_4$ represents an alkyl group, the examples of the alkyl group include those having a substituent. The alkyl group may be either linear or branched.

When $Rd_1$, $Rd_2$, $Rd_3$ or $Rd_4$ represents an aryl group, the examples of the aryl group include those having a substituent.

When $Rd_1$, $Rd_2$, $Rd_3$ or $Rd_4$ represents a heterocyclic group, the examples of the heterocyclic group include those having a substituent. The preferred examples include a 5- or 6-membered monocycle or condensed ring containing as the heteroatom at least one member selected from nitrogen, oxygen and sulfur, such as pyridyl, quinolyl, furyl, benzothiazolyl, oxazolyl, imidazolyl, thiazolyl, triazolyl, benzotriazolyl, imido and oxazine.

The number of carbon atoms contained in $Rd_4$ in Formula (D-8) is 0 to 15.

The total number of carbon atoms contained in $Rd_3$ and $Rd_4$ in Formula (D-9) is 0 to 15.

-(TIME)n-INHIBIT Formula (D-10)

wherein TIME represents a group which is combined with the coupling site of A, and capable of being split off therefrom upon a reaction with an oxidized product of a color development agent. The TIME group is split in sequence after being split off from a coupler, and finally releases an INHIBIT group with suitable control. n is 1 to 3, and where n is 2 or 3, TIME groups may be either identical or not.

INHIBIT represents a group which can be development inhibitor as it is released upon a reaction with an oxidized product of a color development agent, such as those represented by the preceding Formulae (D-2) to (D-9).

The representative examples of the TIME group are given below:

Formula (D-11)

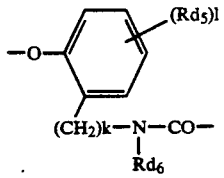

Formula (D12)

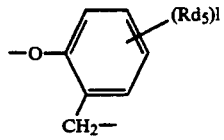

Formula (D-13)

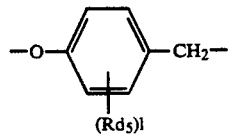

Formula (D14)

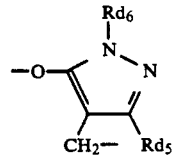

Formula (D-15)

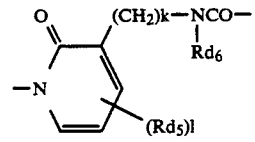

Formula (D16)

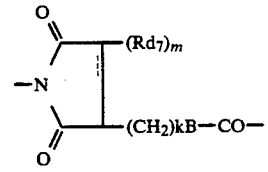

Formula (D-17)

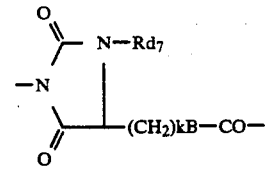

Formula (D18)

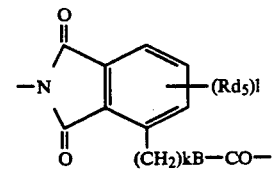

Formula (D-19)

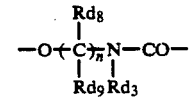

In Formulae (D-11) to (D-15) and (D-18), $Rd_5$ represents a hydrogen atom, a halogen atom, or groups such as alkyl, cycloalkyl, alkenyl, aralkyl, alkoxy, alkoxycarbonyl, anilino, acylamino, ureido, cyano, nitro, sulfonamido, sulfamoyl, carbamoyl, aryl, carboxy, sulfo, hydroxy and alkanesulfonyl. In Formulae (D-11) to D-13), (D-15) and (D-18), two or more $Rd_8$ may be combined with each other to form a condensed ring. In Formulae (D-11), (D-14), (D-15) and (D-19), $Rd_6$ represents alkyl, alkenyl, aralkyl, cycloalkyl, heterocycle or aryl. In Formulae (D-16) and (D-17). $Rd_7$ represents a hydrogen atom or groups such as alkyl, alkenyl, aralkyl, cycloalkyl, heterocycle and aryl. In Formula (D-19), $Rd_5$ and Rd9 each represent a hydrogen atom or an alkyl group (preferably, an alkyl group having 1 to 4 carbon atoms). In Formulae (D-11), (D-15) to (D-18), k represents an integer of 0, 1 or 2. In Formulae (D-11) to (D-13), (D-15), (D-18), l represents an integer of 1 to 4. In Formula (D-16), m represents an integer of 1 or 2. When l or m is not less than 2, $Rd_5$ to $Rd_7$ may be either identical or different. In Formula (D-19), n represent an integer of 2 to 4, $nRd_8$ and nRd9 each may be either identical or not. In Formulae (D-16) to (D-18), B represents an oxygen atom or

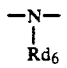

wherein $Rd_6$ is as defined above). =In Formula (D-16) means either a single bond or a double bond. In the case of a single bond, m is 2, and in the case of a double bond, m is 1.

$$\text{—}(T_1)_l\text{—SR—}(T_2)_m\text{—INHIBIT} \qquad \text{Formula (D-20)}$$

wherein $T_1$ represents a component that allows $SR—T_2)_m$ Inhibit to be split off; SR represents a component that forms $—T_z)_m$ INHIBIT upon a reaction with an oxidized product of a color developing agent after the formation of $SR—T_2)_m$ INHIBIT ; $T_2$ represents a component that allows INH to be split off after the formation of $—T_2)_m$ INHBIT ; INHIBIT represents a development inhibitor: and l and m each represent 0 or 1.

The components represented by SR are not limitative, as long as they form $—T_2)_m$ INHBIT upon a reaction with an oxidized product of a color developing agent, and the examples of which include a coupler component which is subjected to a coupling reaction with an oxidized product of a color developing agent and a redox component which is subjected to a redox reaction with an oxidized product of a color developing agent.

The examples of the coupler component include acylacetoanilides, 5-pyrazolones, pyrazolcazoles, phenols, naphthols, acetophenones, indanones, carbamoylacetoanilides, 2(5H)-imidazolones, 5-isoxazolones, uracils, homophthalimide, oxazolones, 2,5-thiadiazolines-1,1-dioxides, triazolothiazines, indoles, yellow couplers, magenta couplers, cyan couplers, and other dye-forming and non-dye-forming components.

It is preferred that $—T_1)_l SR—T_2)_m$ INHIBIT be combined with the active site of A in the preceding Formula (D-1).

When SR is a coupler component, SR is combined with $—T_1)_l$ and $—T_2)_m$ INHIBIT so that it cannot act as a coupler until it is split off from $—T_1)_l$. When the coupler component is a phenol or a naphthol, the oxygen atom of a hydroxy group is combined with $—T_1)_l$. When the coupler component is a 5-pyrazolone, the oxygen atom at the 5-position or the nitrogen atom at the 2-position of a hydroxyl group of a dynamic isomer is combined with $—T_1)_l$. When the coupler component is an acetophenone or an indanone, the oxygen atom of a hydroxyl group of a dynamic isomer is combined with $—T_1)_l$. It is preferred that $—T_2)_m$ INH be combined with the active site of a coupler.

When SR is a redox component, the examples of which include hydroquinones, catechols, pyrogallols, aminophenols (e.g., p-aminophenols, o-aminophenols), napthalenediols (e.g., 1,2-napthalenediols, 1,4-napthalenediols, 2,6-napthalenediols) and aminonaphthols (e.g., 1,2-aminonaphthols, 1,4-aminonaphthols, 2,6-aminonaphthols). When SR is a redox component, it is combined with $—T_1)$ and $—T_2)_m$ INHIBIT so that it cannot act as a redox component until it is split off from $—T_1—$.

The examples of the groups represented by $T_1$ and $T_2$ include those represented by the preceding Formulae (D-110 to (D-19).

The examples of the development inhibitors represented by INHIBIT include those represented by the preceding Formulae (D-2) to (D-9).

Preferred DIR compounds contain Y that is represented by Formula (D-2), (D-3), (D-8), (D-10) or (D-20). Of the groups represented by (D-10) and (D-20), preferred are those containing INHIBIT represented by Formula (D-3), (D-6) (especially preferred is a case where X is oxygen) or (D-8).

The examples of the coupler component represented by A in Formula (D-1) include yellow dye image-forming coupler residues, magenta dye image-forming coupler residues, cyan dye image-forming coupler residues and non-color-forming coupler residues.

The preferred examples of the DIR compound are given below, but they should not be construed as limiting the scope of the invention.

Example Compound

D-1

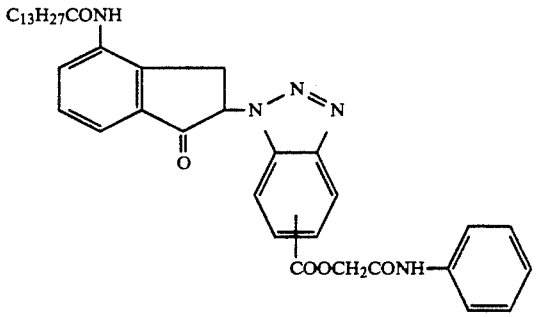

D-36

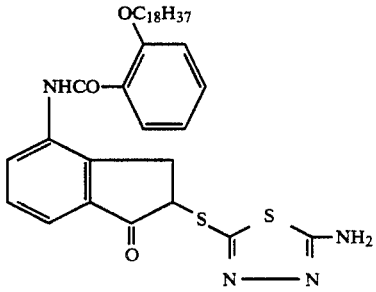

-continued
D-37
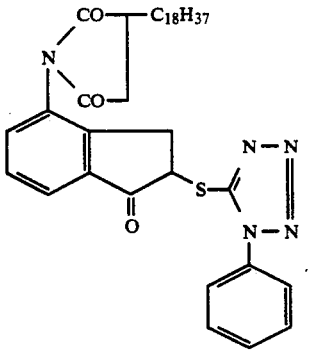
| Example Compound No. | $R_1$ | $R_2$ | Y |
|---|---|---|---|
| | $R_1-COCHCO-R_2$ (Y) | | |
| D-2 | (1) | (1) | (30) |
| D-3 | (2) | (3) | (30) |
| D-4 | (2) | (4) | (30) |
| D-5 | (5) | (6) | (31) |
| D-6 | (2) | (4) | (32) |
| D-7 | (2) | (3) | (32) |
| D-8 | (7) | (8) | (33) |
| D-33 | (2) | (4) | (55) |
| D-40 | (2) | (4) | (56) |
| D-43 | (2) | (25) | (59) |
| | 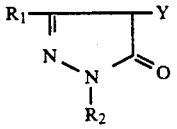 | | |
| D-9 | (9) | (10) | (30) |
-continued
| | | | |
|---|---|---|---|
| D-10 | (11) | (10) | (30) |
| D-11 | (12) | (7) | (34) |
| D-12 | (12) | (13) | (35) |
| D-13 | (9) | (14) | (36) |
| D-14 | (15) | (16) | (37) |
| D-35 | (56) | (24) | (23) |
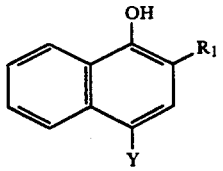
| Example Compound No. | $R_1$ | Y |
|---|---|---|
| D-15 | (17) | (38) |
| D-16 | (17) | (39) |
| D-17 | (18) | (40) |
| D-18 | (19) | (41) |
| D-19 | (18) | (42) |
| D-20 | (18) | (43) |
| D-21 | (18) | (44) |
| D-22 | (18) | (45) |
| D-23 | (18) | (46) |
| D-24 | (20) | (47) |
| D-25 | (20) | (48) |
| D-26 | (21) | (49) |
| D-27 | (21) | (50) |
| D-28 | (21) | (51) |
| D-29 | (22) | (52) |
| D-30 | (18) | (53) |
| D-31 | (18) | (54) |
| D-32 | (22) | (49) |
| D-34 | (18) | (56) |
| D-38 | (19) | (46) |
| D-39 | (18) | (57) |
| D-41 | (18) | (60) |
| D-42 | (18) | (48) |
| D-44 | (18) | (58) |
In the table $R_1$, $R_1$ and Y represent the following 1 to 60.
1
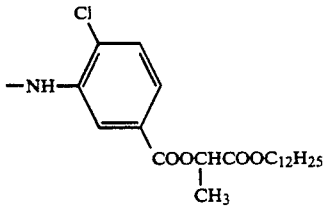
2
$-C(CH_3)_3$
3
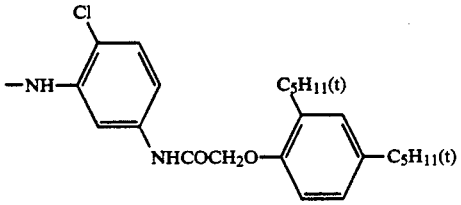
4
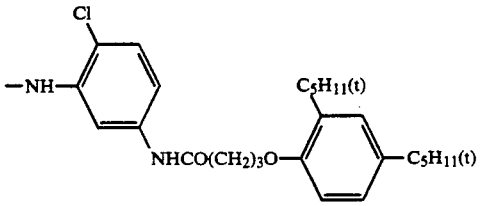

-continued
| | |
|---|---|
| $-OCH_3$ | 5 |
| 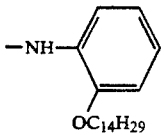 | 6 |
| 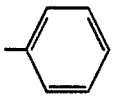 | 7 |
| 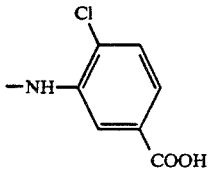 | 8 |
| 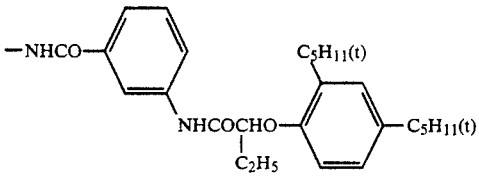 | 9 |
| 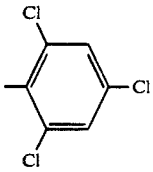 | 10 |
| 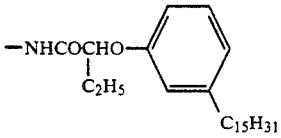 | 11 |
| $-C_{17}H_{35}$ | 12 |
| 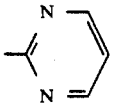 | 13 |
| 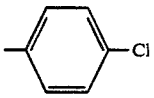 | 14 |
| $-CH_3$ | 15 |
| 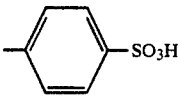 | 16 |
| $-CONHC_{18}H_{37}$ | 17 |
| 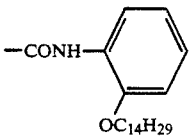 | 18 |

-continued
19
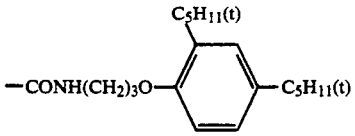
20
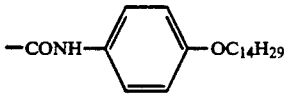
21 —$CONHCH_2CH_2COOH$
22 —$CONHCH_2CH_2COOCH_3$
23
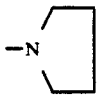
24
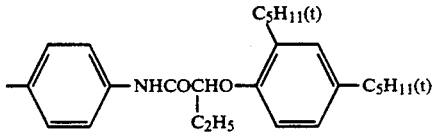
25
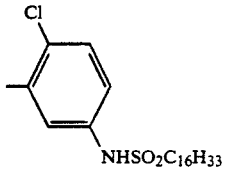
30
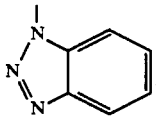
31
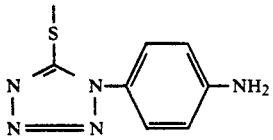
32
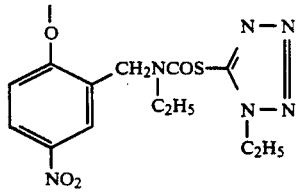
33
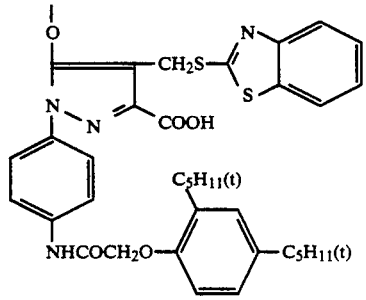

-continued
34
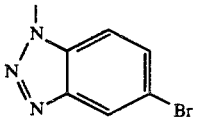
35
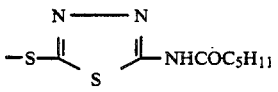
36
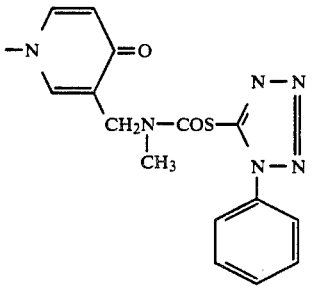
37
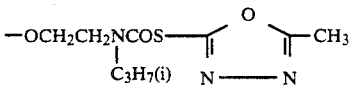
38
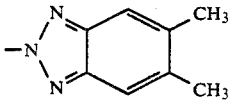
39
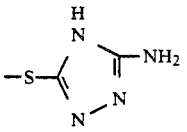
40
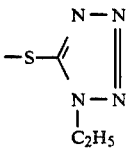
41
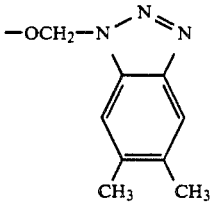
42
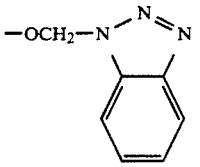

-continued
43
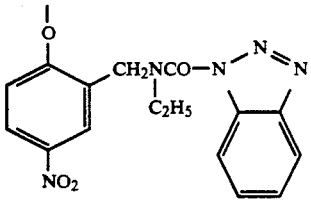
44
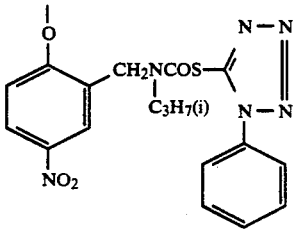
45
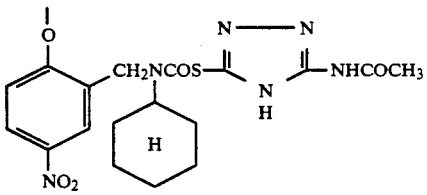
46
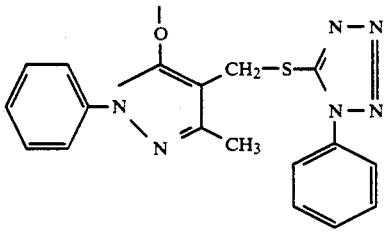
47
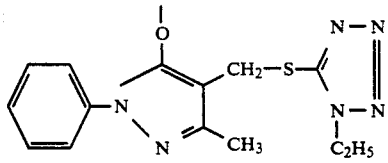
48
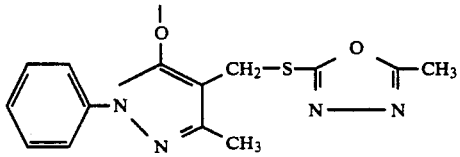
49
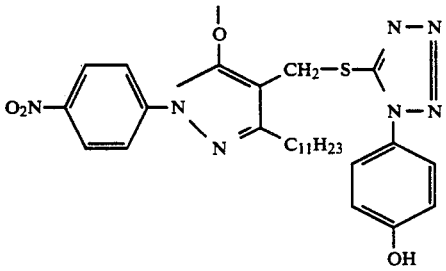

-continued
50
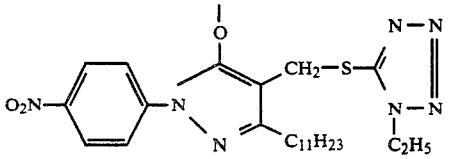
51
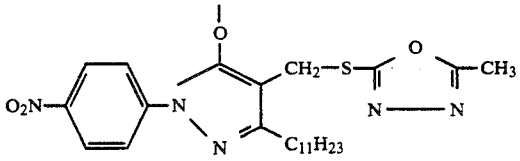
52
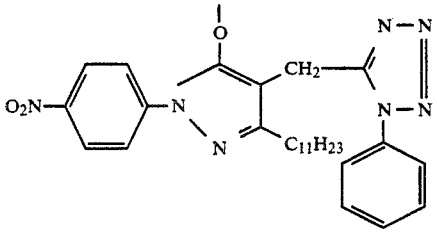
53
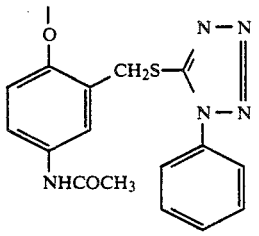
54
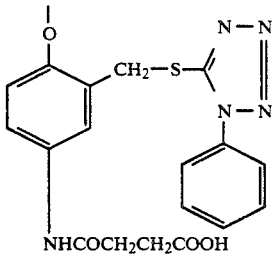
55
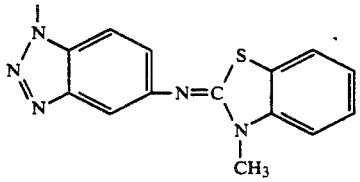
56
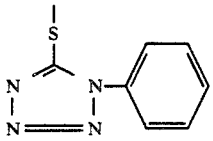

-continued

57

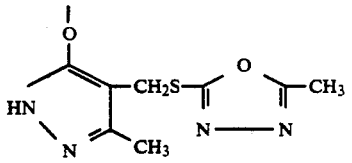

58

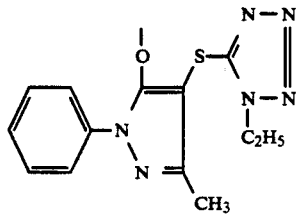

59

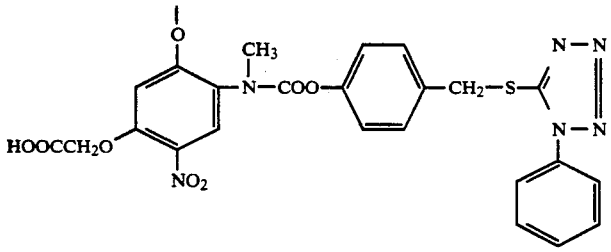

60

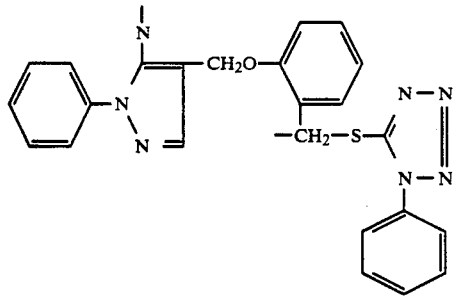

The representative examples of the DIR compounds usable in the invention, inclusive of the above, are described in U.S. Pat. Nos. 4,234,678, 3,227,554, 3,617,291, 3,958,993, 4,149,886, 3,933,500, 2,072,363 and 2,070,266, Japanese Patent O.P.I. Publication Nos. 56837/1982 and 13239/1976, and Research Disclosure (hereinafter referred to as RD) No. 21228 (December 1981).

The amount of the DIR compound is 0 to 0.005 mol, preferably 0 to 0.003 mol, more preferably 0 to 0.001 mol, per mol silver.

An amount exceeding 0.005 mol results in a significant lowering of sensitivity.

The light-sensitive material of the invention preferably has a ISO speed of not less than 100.

The ISO speed can be measured by the following method:

(1) Measurement Conditions

Measurement is conducted in a room at a temperature of 20±5° C. and a relative humidity of 60±10%. A sample is subjected to measurement after being allowed to stand under this condition for not less than one hour.

(2) Exposure

1. The relative spectral energy distribution of standard light at the exposure side is shown in Table 1.

TABLE 1

| Wave-length nm | Relative Spectral Energy(1) | Wavelength nm | Relative Spectral Energy(1) |
|---|---|---|---|
| 360 | 2 | 540 | 102 |
| 370 | 8 | 550 | 103 |
| 380 | 14 | 560 | 100 |
| 390 | 23 | 570 | 97 |
| 400 | 45 | 580 | 98 |
| 410 | 57 | 590 | 90 |
| 420 | 63 | 600 | 93 |
| 430 | 62 | 610 | 94 |
| 440 | 31 | 620 | 92 |
| 450 | 93 | 630 | 88 |
| 460 | 97 | 640 | 89 |
| 470 | 98 | 650 | 86 |
| 480 | 101 | 660 | 86 |
| 490 | 97 | 670 | 89 |
| 500 | 100 | 680 | 85 |
| 510 | 101 | 690 | 75 |
| 520 | 100 | 700 | 77 |
| 530 | 104 | | |

Note (1): Values obtained when the value at a wavelength of 560 nm is set at 100.

2. The exposure intensity is varied by means of an optical wedge that allows spectral transmittance density to vary within 10% at a wavelength shorter than 400 nm and within 5% at a wavelength of 400 nm or longer, in a wavelength region of 360 to 700 nm.

3. Exposure time is 1/100 seconds (3) Processing procedures

1. During a period from exposure to processing, the sample is kept at a temperature of 20±5° C. and a relative humidity of 60±10%.

2. Processing is conducted at the time of from 30 minutes to 6 hours after exposure.

3 Processing is conducted according to the aforesaid processing procedures [P].

(4) Measurement of density

Density is expressed in terms of log 10 ($\phi_0/\phi$), wherein $\phi_0$ represents an irradiation light flux for the density measurement and $\phi$ represents a transmitted light flux at the measurement portion. As the geometrical measurement conditions, a light flux parallel to the normal line is used as an irradiation light flux, and the entire flux of light transmitted and diffused in a half space is used as a transmitted light flux. When the measurement is conducted under other conditions than those mentioned above, correction with a standard density specimen is made. In the measurement, the emulsion layer of the sample is arranged to face a light-receiving apparatus. The status M density of each of blue, green and red colors is measured, and its spectral characteristics, which are the overall characteristics of a light source, an optical system, an optical filter and a light-receiving apparatus employed in a densitometer, are as shown in Table 2.

TABLE 2

Spectral Characteristics of Status M Density (expressed in terms of log and indicated by the relative value obtained when 5.00 is taken as a peak)

| Wave-length nm | Blue | Green | Red | Wave length nm | Blue | Green | Red |
|---|---|---|---|---|---|---|---|
| 400 | * | * | * | 580 | | 3.90 | |
| 410 | 2.10 | | | 590 | | 3.15 | |
| 420 | 4.11 | | | 600 | | 2.22 | |
| 430 | 4.63 | | | 610 | | 1.05 | |
| 440 | 4.37 | | | 620 | | ** | 2.11 |
| 450 | 5.00 | | | 630 | | | 4.48 |
| 460 | 4.95 | | | 640 | | | 5.00 |
| 470 | 4.74 | 1.13 | | 650 | | | 4.90 |
| 480 | 4.34 | 2.19 | | 660 | | | 4.58 |
| 490 | 3.74 | 3.14 | | 670 | | | 4.25 |
| 500 | 2.99 | 3.79 | | 680 | | | 3.88 |
| 510 | 1.35 | 4.25 | | 690 | | | 3.49 |
| 520 | ** | 4.61 | | 700 | | | 3.10 |
| 530 | | 4.85 | | 710 | | | 2.69 |
| 540 | | 4.98 | | 720 | | | 2.27 |
| 550 | | 4.98 | | 730 | | | 1.86 |
| 560 | | 4.80 | | 740 | | | 1.45 |
| 570 | | 4.44 | | 750 | | | 1.05 ** |

Note:
*Red slope 0.260/nm, Green slope 0.106/nm, Blue slope 0.250/nm
**Red slope −0.240/nm, Green slope −0.106/nm, Blue slope −0.250/nm (5) Determination of ISO speed Using the results obtained in the preceding processing and density measurement, the ISO speed of the sample is determined according to the following procedures:

1. For each of the blue-, green- and red-sensitive layer, the amount of exposure that gives a density larger by 0.15 than the minimum density is expressed in terms of lux sec, and designated as HB (blue), $H_G$ (green) and $H_R$ (red).

2. Of $H_B$ and $H_R$, larger (lower in sensitivity) one is designated as Es.

3. The ISO speed, S is determined by the following formula:

$$S = \sqrt{\frac{2}{H_G - H_S}}$$

In preparing the light-sensitive material of the invention, it is preferable to employ a monodispersed silver halide emulsion. The monodispersed emulsion is defined as an emulsion containing 70% by weight or more of silver halide grains with the grain sizes falling within the range of 80 to 120% of the average grain size $\bar{d}$. The above weight percentage is preferably not less than 80%, more preferably not less than 90% of all silver halide grains.

Here, the average grain size $\bar{d}$ is defined as a diameter d in which the product of $n_i$ and $d_i^3$ is maximized (wherein $n_i$ means the number of grains having a diameter of $d_i$). The significant figure is calculated down to the third decimal place and the fourth digit is rounded to the nearest whole number.

The grain size is defined as the diameter of a circle having the same area as that of a projected image of a grain.

The grain diameter can be calculated by taking an electron microphotograph of a grain (×10,000 to 50,000) and measuring the diameter or the projected area thereof (measurement is conducted for not less than 1,000 grains selected arbitrarily).

The silver halide emulsion used in the invention preferably has a degree of dispersion of not more than 20%, more preferably not more than 15%. Here, the degree of dispersion is defined by the following formula:

$$\frac{\text{Standard deviation of grain diameter}}{\text{Average grain size}} \times 100 = \text{Degree of dispersion, or variation coefficient (\%)}$$

wherein the average grain size is an arithmetic average and determined by the preceding method.

$$\text{Average grain size} = \frac{\Sigma\, d_i n_i}{\Sigma\, n_i}$$

In the invention, the silver halide emulsion preferably comprises silver iodobromide having an average silver iodide content of 4 to 20 mol %, more preferably 5 to 15 mol %, and may contain silver chloride in such an amount as will not impair the effects of the invention.

The silver halide emulsion used in the invention comprises silver halide grains each having a high silver iodide content phase in its interior portion.

The silver iodide content of this phase is preferablay 15 to 45 mol %, more preferably 20 to 42 mol %, most preferably 25 to 40 mol %.

In such silver halide grain, the high silver iodide content phase is covered with a low silver iodide content phase of which the silver iodide content is smaller than that of the high silver iodide content phase.

The average silver iodide content of the low silver iodide content phase which constitutes the outermost phase is preferably not more than 6 mol %, more preferably 0 to 4 mol %. An intermediate phase of which the silver iodide content is mean between that of the outermost phase and that of the high silver iodide content phase may be provided.

The silver iodide content of the intermediate layer is preferably 10 to 22 mol %, more preferably 12 to 20 mol %.

The difference in silver iodide content between the outermost phase and the intermediate phase and that between the intermediate phase and the high silver iodide content phase are each preferably not less than 6 mol %, more preferably not less than 10 mol %.

In the core of the high silver iodide content phase, between the high silver iodide content phase and the intermediate phase, or between the intermediate phase and the outermost phase, another silver halide phase may be present.

The volume of the outermost phase preferably accounts for 4 to 70 mol %, more preferably 10 to 50 mol %, of the total volume of a grain. The volume of the high silver iodide content phase desirably accounts for 10 to 80%, more desirably 20 to 50%, most desirably 20 to 45%, of the total volume of a grain, and that of the intermediate phase preferably accounts for 5 to 60%, more preferably 20 to 55%, of the total volume of a grain.

Each phase may be a single phase of uniform composition or may consist of a plurality of uniform phases which are arranged to permit a stepwise change of composition. Alternatively, each phase may be a continuous phase in which the composition varies continuously. The combination of these phases is also possible.

In another embodiment, the silver halide emulsion comprises silver halide grains in each of which the silver iodide content varies continuously from the core to the outer surface. In this case, it is preferred that the silver iodide content decrease monotonously from a point with the highest silver iodide content to the outer surface of a grain.

The silver iodide content of the highest silver iodide content point is preferably 15 to 45 mol %, more preferably 25 to 40 mol %.

The silver iodide content of the outer surface of a grain is preferably not more than 6 mol %, more preferably 0 to 4 mol %.

It is preferred that the silver halide emulsion used in the invention satisfy at least one of the following requirements 1 to 4.

1. The average silver iodide content ($J_1$) measured by the fluorescent X-ray spectroscopy and the average silver iodide content ($J_2$) of the surface of a grain measured by the X-ray photoelectron spectrophotometry satisfy the following relationship:

$$J_1 > J_2$$

An explanation will be made on the X-ray photoelectron spectrophotometry.

Prior to the measurement, an emulsion is subjected to the following pretreatment: A pronase solution is added to the emulsion, followed by stirring at 40° C. for one hour to decompose gelatin. Then, silver halide grains are sedimented by centrifugation. After removing supernatant, an aqueous pronase solution is added to decompose gelatin again under the preceding conditions. The emulsion is centrifuged again. After removing supernatant, distilled water is added to re-disperse silver halide grains, followed by centrifugation and removal of supernatant. This rinsing procedures are repeated three times. Then, silver halide grains are re-dispersed in ethanol, followed by applying on a mirror-polished silicon wafer to provide a thin layer.

The X-ray photoelectron spectrophotometry is conducted by using the following apparatus and under the following conditions:

Apparatus: ESCA/SAM$_{560}$ (manufactured by PHI)
X-ray for excitation: Mg-K$\alpha$ ray
X-ray source voltage: 15 KV
X-ray source current: 40 mA
Pass energy: 50 eV To examine the halide composition of the surface, Ag3d, Br3d and I3d3/2 electrons are detected. The composition ratio is calculated from the integration intensity of each peak according to the relative sensitivity coefficient method, using 5.10, 0.81 and 4.592 as the relative sensitivity coefficients of Ag3d, Br3d and I3d3/2, respectively. The composition ratio is expressed in terms of atomic percent.

The average silver iodide content ($J_1$) measured by the preceding fluorescent X-ray spectroscopy and the average value of silver iodide contents($J_3$) measured by the X-ray microanalysis of silver halide crystals at a point away from 80% or more of a grain radius from the center of a grain satisfy the following relationship:

$$J_1 > J_3$$

The X-ray microanalysis comprises the following steps:

Silver halide grains are dispersed on an electron microscopic observation grid of an electron microscope equipped with an energy-dispersing X-ray analyzer. While cooling the grid with liquid nitrogen, the magnification is set so as to have a single grain come into view on a CRT, and then intensities of AgL$\alpha$ ray and IL$\alpha$ ray are added up for a prescribed period of time. A silver iodide content can be calculated with an analytical curve prepared beforehand from the intensity ratio of IL$\alpha$/AgL$\alpha$.

3. In a (420) X-ray diffraction pattern obtained with CuK$\alpha$ ray as a radiation source, signals are present continuously over a diffraction angle of 1.5 degrees or more at a height of the maximum peak height$\times$0.13, preferably at the maximum peak height$\times$0.15. The diffraction angle over which signals are present is preferably 1.8 degrees or more, more preferably 2.0 degrees or more. The expression that "signals are present" mean such a condition that, at the maximum peak height$\times$0.13 or 0.15, the signal intensity is higher than that height.

In still another preferred embodiment of the silver halide emulsion, the (420) X-ray diffraction signal obtained with CuK$\alpha$ ray as a radiation source has two or three peaks, preferably three peaks.

The X-ray diffraction method is known as the method for examining the crystal structure of a silver halide.

Various X rays are employable as a radiation source, but most widely used is CuK$\alpha$ ray with Cu as the target.

Silver iodobromide has a rock-salt structure, of which (420) diffraction signal is observed at a diffraction angle ($2\theta$) of 71 to 74 degrees when CuK$\alpha$ ray is used as a radiation source. The crystal structure of silver iodide is readily examined, since its resolving power is high due to its relatively high and acute signal intensity.

The X-ray diffraction analysis of a photographic emulsion should be conducted by the powder method after removing gelatin therefrom and mixing a standard such as silcon.

The X-ray diffraction analysis can be conducted with reference to Basic Analytical Chemistry Lectures Vol. 24 "X-ray Analysis" (Kyoritsu Shuppan).

4. The relative standard deviation of the silver iodide content of each silver halide grain obtained by the preceding X-ray microanalysis method is not more than 20%, preferably not more than 15%, more preferably not more than 12%.

The relative standard deviation is defined as the product of 100 and the value obtained by dividing the standard deviation of the silver iodide content obtained when the silver iodide contents of at least 100 emulsion grains are measured by the average silver iodide content of said 100 emulsion grains.

The silver halide emulsion used in the invention may comprise either normal crystals such as cubic, tetradecahedral and octadecahedral crystals or twin crystals such as tabular crystals. The combination of these crystals is also possible.

In the case of tabular twin crystals, the projection areas of those having a grain size/grain thickness ratio (wherein the grain size is defined as the diameter of a circle having the same projection area) of 1 to 20 account for preferably not less than 60% of the projection areas of all grains. The grain size/thickness ratio is preferably not less than 1.2 but smaller than 8.0, more preferably not less than 1.5 but smaller than 5.0.

A monodispersed emulsion comprising normal crystals can be prepared by the methods disclosed in Japanese Patent O.P.I. Publication Nos. 177535/1984, 138538/1985, 52238/1984, 14331/1985, 35726/1985, 258536/1985 and 14636/1986.

A monodispersed emulsion comprising twin crystals can be prepared, for example, by the method disclosed in Japanese Patent O.P.I. Publication No. 14636/1986 in which a seed emulsion comprising spherical seed crystals is grown.

For growing silver halide grains, it is preferred that an aqueous silver nitrate solution and an aqueous halide solution be added by the double-jet method.

Iodide may be supplied to a reaction system as silver iodide.

The addition is made preferably at a rate that prohibits the generation of a new nucleus and the widening of grain size distribution due to the Ostwald's ripening. Specifically, such preferable rate is 30 to 100% of a rate that allows a new nucleus to be generated.

As suggested in Summary of the 1981 Annual Meeting of Japanese Photographic Society, p 88, silver halide grains can be grown by adding silver halide fine grains to a grain growth system and dissolving it therein to permit recrystallization.

Silver halide grains are grown at a pAg of 5 to 11, a temperature of 40 to 85° C. and a pH of 1.5 to 12.

In the present invention, a diffusible DIR coupler is contained preferably in the medium-speed elemental layer of the green-sensitive emulsion layer.

As the silver halide emulsion, use can be made of those described in Research Disclosure.

The silver halide emulsion to be used in the invention is subjected to physical ripening, chemical ripening and spectral sensitization.

Additives to be used in preparing a silver halide emulsion include those described in RD Nos. 17643, 18716 and 308119.

Usable additives and the portions of RD at which descriptions are made on them are given below:

| [Additive] | | [RD308119] | [RD17643] | [RD18716] |
|---|---|---|---|---|
| Chemical sensitizer | 996 | III-A | 23 | 648 |
| Spectral sensitizer | 996 | IV-A-A,B,C, D,H,I,J | 23–4 | 648–9 |
| Supersensitizer | 996 | IV-A-E,J | 23–4 | 648–9 |
| Antifoggant | 998 | VI | 24–25 | 649 |
| Stabilizer | 998 | VI | | |

Known photographic additives usable in the invention are also described in the above Research Disclosures.

The type of additives and the portions of RD at which descriptions are made on them are given below:

| [Additive] | | [RD308119] | [RD17643] | [RD18716] |
|---|---|---|---|---|
| Anti-stain agent | 1002 | VII-I | 25 | 650 |
| Color image stabilizer | 1001 | VII-J | 25 | |
| Bleacher | 998 | V | 24 | |
| UV absorber | 1003 | VIII-C, X III C | 25–26 | |
| Light absorber | 1003 | VIII | 25–26 | |
| Light scattering agent | 1003 | VIII | | |
| Filter dye | 1003 | VIII | 25–26 | |
| Binder | 1003 | IX | 26 | 651 |
| Anti-static agent | 1006 | X III | 27 | 650 |
| Hardener | 1004 | X | 26 | 651 |
| Plasticizer | 1006 | XII | 27 | 650 |
| Lubricant | 1006 | XII | 27 | 650 |
| Surfactant/Coating aid | 1005 | XI | 26–17 | 650 |
| Matting agent | 1007 | X VI | | |
| Developing agent (contained in a light-sensitive material) | 1011 | X X B | | |

Various couplers may be contained in the light-sensitive material of the invention, the example of which are described also in the above Research Disclosures.

Couplers and the portions of RD at which descriptions are made on them are given below:

| [Coupler] | | [RD308119] | [RD17643] |
|---|---|---|---|
| Yellow coupler | 1001 | VII-D | VII C-G |
| Magenta coupler | 1001 | VII-D | VII C-G |
| Cyan coupler | 1001 | VII-D | VII C-G |
| Colored coupler | 1002 | VII-G | VII G |
| DIR coupler | 1001 | VII-F | VII F |
| BAR coupler | 1002 | VII-F | |
| Other PUG-releasing couplers | 1001 | VII-F | |
| Alkaline-soluble coupler | 1001 | VII-E | |

These additives can be added by the dispersion method described in RD 308119 XIV.

As the support, use can be made of those described in RD 17643, p28, RD 18716, pp 647 to 648, ard RD 308119, XVII.

The light-sensitive material of the invention may have auxiliary layers such as a filter layer and an intermediate layer, as described in RD 309119, VII-K.

The layers of the light-sensitive material of the invention may be arranged in either conventional layer order or inverted layer order. Unit layer structure is also employable.

The present invention can be applied to color negative films for photography or cinematography, color reversal films for slides or TV, color paper, color positive films and color reversal paper.

The light-sensitive material of the present invention can be developed by ordinary methods described the preceding RD 17643, pp 28-29, RD 18176, p 647 and R1308119, XVIII.

EXAMPLES

The present invention will be described in more detail according to the following examples which should not be construed as limiting the scope of the invention.

In the following examples, the amounts of ingredients are expressed in terms of gram per square meter unless otherwise indicated. The amounts of a silver halide and colloidal silver are the amounts converted to the amount of silver. The amount of a sensitizing dye is indicated in terms of mol per mol silver.

EXAMPLE 1

A multilayer color photographic light-sensitive material (Sample No. 101) was prepared by providing on a cellulose triacetate film support the layers of the following constitutions in sequence from the support:

| | |
|---|---|
| 1st Layer: Anti-halation layer (HC-1) | |
| Black colloidal silver | 0.2 |
| UV absorber (UV-1) | 0.23 |
| High boiling point solvent (Oil-1) | 0.18 |
| Gelatin | 1.4 |
| 2nd Layer: Intermediate layer (IL-1) | |
| Gelatin | 1.3 |
| 3rd Layer: Low-speed red-sensitive emulsion layer (RL) | |
| Silver iodobromide emulsion (average grain size: 0.4 μm) | 1.0 |
| Sensitizing dye (I-40) | $1.8 \times 10^{-5}$ |
| Sensitizing dye (I-6) | $2.8 \times 10^{-4}$ |
| Sensitizing dye (II-29) | $3.0 \times 10^{-4}$ |
| Cyan coupler (C-34) | 0.70 |
| Colored cyan coupler (CC-1) | 0.066 |
| DIR compound (D-25) | 0.03 |
| DIR compound (D-23) | 0.01 |
| High boiling solvent (Oil-1) | 0.64 |
| Gelatin | 1.2 |
| 4th Layer: Medium-speed red-sensitive emulsion layer (RM) | |
| Siliver iodobromide emulsion (average grain size: 0.7 μm) | 0.8 |
| Sensitizing dye (I-40) | $2.1 \times 10^{-5}$ |
| Sensitizing dye (I-6) | $1.9 \times 10^{-4}$ |
| Sensitizing dye (II-29) | $1.9 \times 10^{-4}$ |
| Cyan coupler (C-34) | 0.28 |
| Colored cyan coupler (CC-1) | 0.027 |
| DIR compound (D-25) | 0.01 |
| High boiling point solvent (Oil-1) | 0.26 |
| Gelatin | 0.6 |
| 5th Layer: High-speed red-sensitive emulsion layer (RH) | |
| Silver iodobromide emulsion (average grain size: 0.8 μm) | 1.70 |
| Sensitizing dye (I-40) | $1.9 \times 10^{-5}$ |
| Sensitizing dye (I-6) | $1.7 \times 10^{-4}$ |
| Sensitizing dye (II-29) | $1.7 \times 10^{-4}$ |
| Cyan coupler (C-34) | 0.05 |
| Cyan coupler (C-8) | 0.10 |
| Colored cyan coupler (CC-1) | 0.02 |
| DIR compound (D-25) | 0.025 |
| High boiling point solvent (Oil-1) | 0.17 |
| Gelatin | 1.2 |
| 6th Layer: Intermediate layer (IL-2) | |
| Gelatin | 0.8 |
| 7th Layer: Low-speed green-sensitive emulsion layer (GL) | |
| Silver iodobromide emulsion (average grain size: 0.4 μm) | 1.1 |
| Sensitizing dye ($I_C$-2) | $6.8 \times 10^{-5}$ |
| Sensitizing dye ($I_A$-4) | $6.2 \times 10^{-4}$ |
| Magenta coupler (M-1) | 0.54 |
| Magenta coupler (M-2) | 0.19 |
| Colored magenta coupler (CM-1) | 0.06 |
| DIR compound (D-32) | 0.017 |
| CIR compound (D-23) | 0.01 |
| High boiling point solvent (Oil-2) | 0.81 |
| Gelatin | 1.8 |
| 8th Layer: Medium-speed green-sensitive emulsion layer (GM) | |
| Silver iodobromide emulsion (average grain size: 0.7 μm) | 0.7 |
| Sensitizing dye ($I_A$-20) | $1.9 \times 10^{-4}$ |
| Sensitizing dye ($I_F$-1) | $1.2 \times 10^{-4}$ |
| Sensitizing dye ($I_A$-21) | $1.5 \times 10^{-5}$ |
| Magenta coupler (M-1) | 0.07 |
| Magenta coupler (M-2) | 0.03 |

-continued

| | |
|---|---|
| Colored magenta coupler (CM-1) | 0.04 |
| DIR compound (D-32) | 0.018 |
| High boiling point solvent (Oil-2) | 0.30 |
| Gelatin | 0.8 |
| 9th Layer: High-speed green-sensitive emulsion layer (GH) | |
| Silver iodobromide emulsion (average grain size: 1.0 μm) | 1.7 |
| Sensitizing dye ($I_A$-20) | $1.2 \times 10^{-4}$ |
| Sensitizing dye ($I_F$-1) | $1.0 \times 10^{-4}$ |
| Sensitizing dye ($I_A$-21) | $3.4 \times 10^{-6}$ |
| Magenta coupler (M-1) | 0.09 |
| Magenta coupler (M-3) | 0.04 |
| Colored magenta coupler (CM-1) | 0.04 |
| High boiling point solvent (Oil-2) | 0.31 |
| Gelatin | 1.2 |
| 10th Layer: Yellow filter layer (YC) | |
| Yellow colloidal silver | 0.05 |
| Anti-stain agent (SC-1) | 0.1 |
| High boiling point solvent (Oil-2) | 0.13 |
| Gelatin | 0.7 |
| Formalin scavenger (HS-1) | 0.09 |
| Formalin scavenger (HS-2) | 0.07 |
| 11th Layer: Low-speed blue-sensitive emulsion layer (BL) | |
| Silver iodobromide emulsion (average grain size: 0.4 μm) | 0.5 |
| Silver iodobromide emulsion (average grain size: 0.7 μm) | 0.5 |
| Sensitizing dye (SD-1) | $5.2 \times 10^{-4}$ |
| Sensitizing dye (SD-2) | $1.9 \times 10^{-5}$ |
| Yellow coupler (Y-1) | 0.65 |
| Yellow coupler (Y-2) | 0.24 |
| DIR compound (D-25) | 0.03 |
| High boiling point solvent (Oil-2) | 0.18 |
| Gelatin | 1.3 |
| Formalin scavenger (HS-1) | 0.08 |
| 12th Layer: High-speed blue-sensitive emulsion layer (BH) | |
| Silver iodobromide emulsion (average grain size: 1.0 μm) | 1.0 |
| Sensitizing dye (SD-1) | $1.8 \times 10^{-4}$ |
| Sensitizing dye (SD-2) | $7.9 \times 10^{-5}$ |
| Yellow coupler (Y-1) | 0.15 |
| Yellow coupler (Y-2) | 0.05 |
| High boiling point solvent (Oil-2) | 0.074 |
| Gelatin | 1.3 |
| Formalin scavenger (HS-1) | 0.05 |
| Formalin scavenger (HS-2) | 0.12 |
| 13th Layer: 1st Protective layer (Pro-1) | |
| Finely-grained silver iodobromide emulsion (average grain size: 0.08 μm, AgI content: 1 mol %) | 0.4 |
| UV absorber (UV-1) | 0.07 |
| UV absorber (UV-2) | 0.10 |
| High boiling point solvent (Oil-1) | 0.07 |
| High boiling point solvent (Oil-3) | 0.07 |
| Formalin scavenger (HS-1) | 0.13 |
| Formalin scavenger (HS-2) | 0.37 |
| Gelatin | 1.3 |
| 14th Layer: 2nd Protective layer (Pro-2) | |
| Alkaline-soluble matting agent (average grain size: 2 μm) | 0.13 |
| Polymethyl methacrylate (average grain size: 3 μm) | 0.02 |
| Lubricant (WAX-1) | 0.04 |
| Gelatin | 0.6 |

C-34

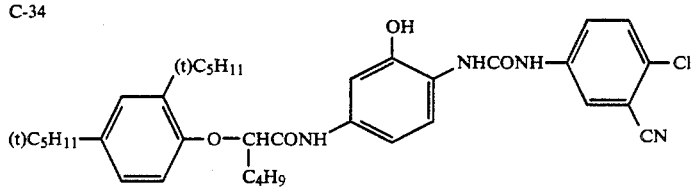

-continued
M-1
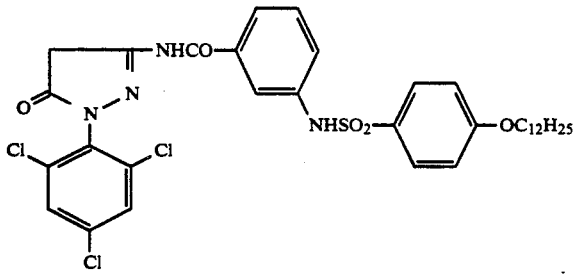
M-2
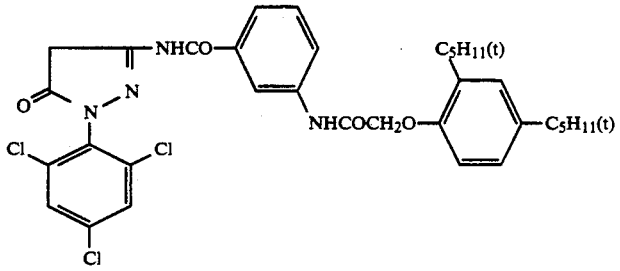
M-3
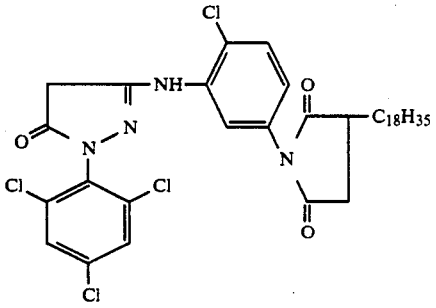
Y-1
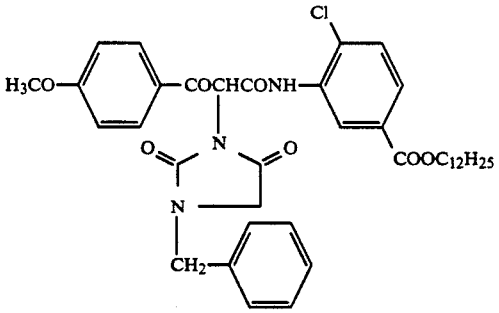
Y-2
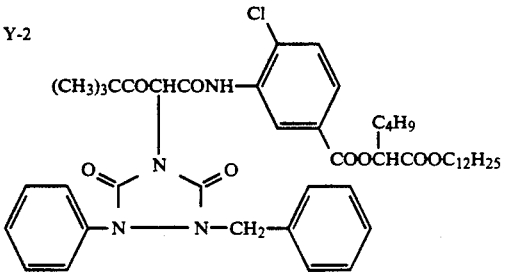

-continued
CC-1
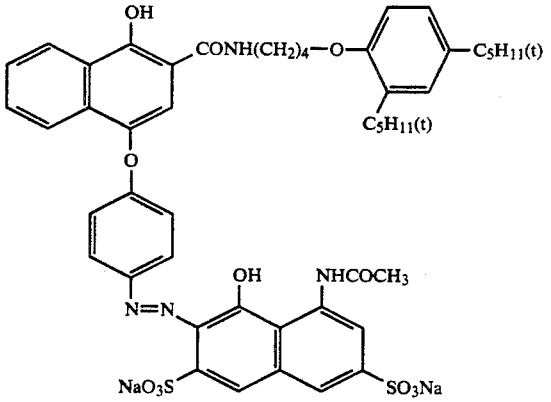
CM-1
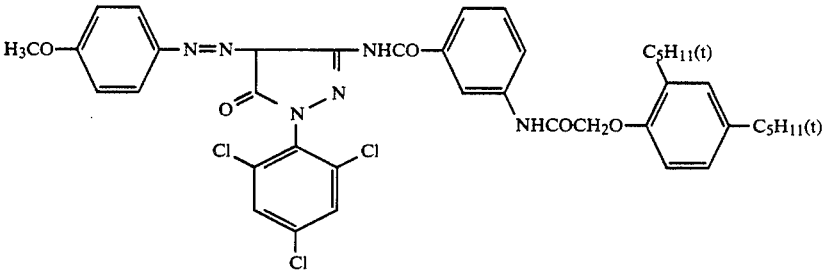
Oil-1
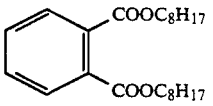
Oil-2
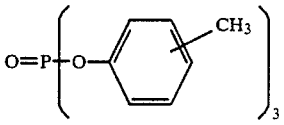
Oil-3
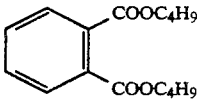
SC-1
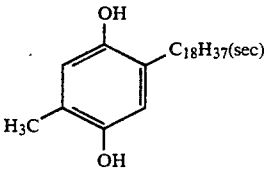

-continued
UV-1
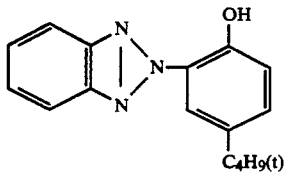
UV-2
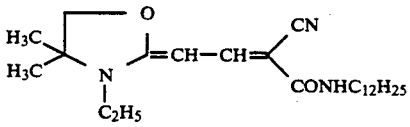
WAX-1
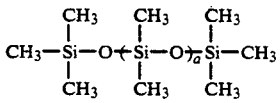
molecular weight MW = 3,000
Su-1
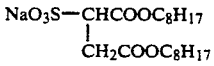
Su-2
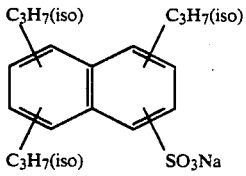
HS-1
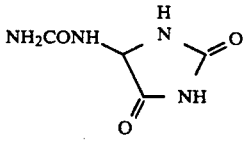
HS-2
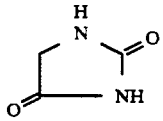
SD-1
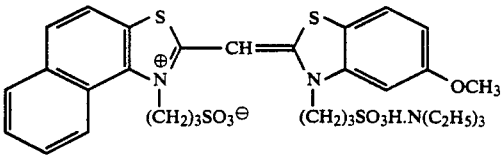

-continued

SD-2

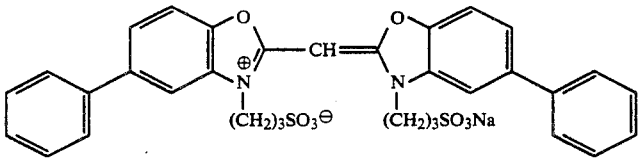

H-1

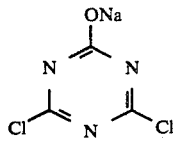

H-2

$(CH_2{=}CHSO_2CH_2)_2O$

ST-1

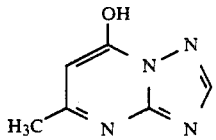

AF-1

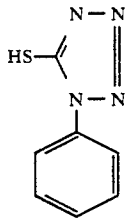

AF-2

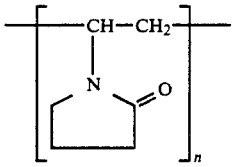

n: polymerization degree

Besides the above ingredients, a coating aid Su-1, a dispersion aid Su-2, a viscosity controlling agent, hardeners H-1 and H-2, a stabilizer ST-1, antifoggants AF-1 and AF-2 (two kinds of AF-2 were employed, one had a weight average molecular weight of 10,000 and the other 1,100,000) were added to each layer.

Here, the grain size is defined as the length of the side of a cube having the same volume.

Each emulsion was subjected to optimum gold and sulfur sensitization.

Sample Nos. 102 to 104 were prepared in the same manner as in the preparation of Sample No. 1, except that the sensitizing dye in the 8th layer was replaced with those shown in Table 3.

TABLE 3

| Sample | Sensitizing dye (mol/mol silver) | | | |
|---|---|---|---|---|
| | $I_A$-20 | $I_P$-1 | $I_A$-21 | $I_C$-2 |
| 102 | $1.9 \times 10^{-4}$ | $1.2 \times 10^{-4}$ | $1.5 \times 10^{-5}$ | $2.0 \times 10^{-5}$ |
| 103 | $1.9 \times 10^{-4}$ | $1.2 \times 10^{-4}$ | $1.5 \times 10^{-5}$ | $8.2 \times 10^{-5}$ |
| 104 | $1.7 \times 10^{-4}$ | $1.1 \times 10^{-4}$ | $1.3 \times 10^{-5}$ | $1.2 \times 10^{-4}$ |

Sample Nos. 105 to 108 were prepared in the same manner as in the preparation of Sample No. 103, except that the constitution and maximum color density of the 8th layer were varied to those shown in Table 4.

TABLE 4

| Constitution | Sample 105 | 106 | 107 | 108 |
|---|---|---|---|---|
| Silver iodobromide emulsion | 0.183 | 1.32 | 1.65 | 2.64 |
| Sensitizing dye $I_A$-20 | $1.9 \times 10^{-4}$ | $1.9 \times 10^{-4}$ | $1.9 \times 10^{-4}$ | $1.9 \times 10^{-4}$ |
| Sensitizing dye $I_F$-1 | $1.2 \times 10^{-4}$ | $1.2 \times 10^{-4}$ | $1.2 \times 10^{-4}$ | $1.2 \times 10^{-4}$ |
| Sensitizing dye $I_A$-21 | $1.5 \times 10^{-5}$ | $1.5 \times 10^{-5}$ | $1.5 \times 10^{-5}$ | $1.5 \times 10^{-5}$ |
| Magenta coupler (M-1) | 0.02 | 0.145 | 0.18 | 0.29 |
| Magenta coupler (M-2) | 0.005 | 0.036 | 0.045 | 0.072 |
| Colored magenta coupler (CM-1) | 0.006 | 0.048 | 0.060 | 0.096 |
| DIR compound (D-46) | 0.003 | 0.022 | 0.027 | 0.043 |
| High boiling point organic solvent (Oil-2) | 0.05 | 0.36 | 0.45 | 0.72 |
| Gelatin | 0.8 | 0.8 | 0.8 | 0.8 |
| Maximum color density of 8th layer | 0.05 | 0.30 | 0.35 | 0.50 |

The properties of Sample Nos. 101 to 109 are summarized in Table 5.

TABLE 5

| Sample | Spectral sensitivity distribution ($S_0$) 560 nm | 570 nm | 580 nm | 590 nm | Maximum color density of the 8th layer | Other properties |
|---|---|---|---|---|---|---|
| 101 | 1 | 0.50 | 0.13 | 0 | 0.25 | — |
| 102 | 1 | 0.76 | 0.34 | 0.14 | 0.25 | — |
| 103 | 1 | 0.60 | 0.21 | 0.3 | 0.25 | — |
| 104 | 1 | 0.82 | 0.42 | 0.17 | 0.25 | — |
| 105 | 1 | 0.76 | 0.34 | 0.14 | 0.05 | — |
| 106 | 1 | 0.76 | 0.34 | 0.14 | 0.30 | — |
| 107 | 1 | 0.76 | 0.34 | 0.14 | 0.35 | — |
| 108 | 1 | 0.76 | 0.34 | 0.14 | 0.50 | — |
| 109 | 1 | 0.76 | 0.34 | 0.14 | 0.25 | * |

*The 9th layer was spectrally sensitized to longer wavelength region

Using each sample, a color rendition chart (manufactured by Macbeth) and 200 scenes were photographed with Z- up 80RC (a compact camera manufactured by Konica Corp) under white light source and Paluc Type PS (3-emissive band type fluorescent lamp manufactured by Matsushita Electronics Co., Ltd.), followed by the preceding processing [P]. The color development was conducted for 3 minutes and 15 seconds.

As to the color rendition chart, the negative image was printed on color paper (manufactured by Konica Corp) to allow gray color photographed simultaneously with other colors to be reproduced. Color reproducibility under respective light sources was evaluated according to five ratings from 1 (worst) to 5 (best). The rating shown in Table 6 was the average (rounded value) of the ratings given by the 10 monitors.

As to the 200 scenes, the images were subjected to printing exposure under normal conditions with NPS-CL-P2000L (manufactured by Konica Corp), followed by paper development (Process CPK-18), to obtain photoprints. The printing yield was obtained by excluding from the obtained photoprints those poor in color and density balance.

The results are shown in Table 6.

TABLE 6

| Sample | Color reproducibility: Under white light source | 3-Emissive band type fluorescent lamp | Printing yield: Under white light source | 3-Emissive band type fluorescent lamp |
|---|---|---|---|---|
| 101 | 5 | 1 | 89 | 74 |
| 102 | 5 | 3 | 90 | 81 |
| 103 | 5 | 5 | 99 | 98 |
| 104 | 5 | 4 | 94 | 87 |
| 105 | 5 | 2 | 91 | 83 |
| 106 | 5 | 4 | 95 | 93 |
| 107 | 5 | 3 | 89 | 80 |
| 108 | 3 | 3 | 85 | 71 |
| 109 | 5 | 5 | 99 | 99 |

As is evident from the results shown in Table 6, the samples (Sample Nos. 102 to 104, 105 to 107, and 109) each had improved color reproducibility under the 3-emissive band type fluorescent lamp. The printing yields of the inventive samples were high not only under the white light source but also under the fluorescent lamp, as compared with Sample No. 108.

EXAMPLE 2

AN experiment was conducted in substantially the same manner as in Example 1, except that the processing procedures were replaced with the following procedures [QP].

Running was performed until the amount of a replenisher become threefold larger than the capacity of a stabilizer tank.

| Processing procedures | Processing [QP]: Processing time | Processing temperature | Amount of replenisher |
|---|---|---|---|
| Color developing | 3 min. 15 sec. | 38° | 540 ml |
| Bleaching | 45 sec. | 38° | 155 ml |
| Fixing | 1 min. 45 sec. | 38° | 500 ml |
| Stabilizing | 90 sec. | 38° | 775 ml |
| Drying | 1 min. | 40–70° | — |

(The amount of a replenisher was the amount per square meter of a light-sensitive material)

The stabilizing was performed by the three-tank counter-current system, in which a replenisher was supplied to the final stabilizing tank, and an overflow was allowed to run into the tank ahead of said final stabilizing tank.

Part of an overflow (275 ml/m$^2$) from the stabilizing tank behind the fixing tank was allowed to run into the stabilization tank.

| Composition of color developer | |
|---|---|
| Potassium carbonate | 30 g |
| Sodium hydrogen carbonate | 2.7 g |
| Potassium sulfite | 2.8 g |
| Sodium bromide | 1.3 g |
| Hydroxylamine sulfate | 3.2 g |
| Sodium chloride | 0.6 g |
| 4-Amino-3-methyl-N-ethyl-N-(β-hydroxyethyl)aniline sulfate | 4.6 g |
| Diethylene triamine pentaacetic acid | 3.0 g |
| Potassium hydroxide | 1.3 g |

Water was added to make the total quantity 1l, and pH was adjusted to 10.01 with potassium hydroxide or 20% sulfuric acid.

| Composition of color developer replenisher | |
|---|---|
| Potassium carbonate | 40 g |
| Sodium hydrogen carbonate | 3 g |
| Potassium sulfite | 7 g |
| Sodium bromide | 0.5 g |
| Hydroxylamine sulfate | 3.2 g |
| 4-Amino-3-methyl-N-ethyl-N-(β-hydroxylethyl)aniline sulfate | 6.0 g |
| Diethylenetriamine pentaacetic acid | 3.0 g |
| Potassium hydroxide | 2 g |

Water was added to make the total quantity 1l, and pH was adjusted to 10.12 with potassium hydroxide or 20% sulfuric acid.

| Composition of bleacher | |
|---|---|
| Ferric diammonium | 0.35 mol |
| 1,3-diaminopropane tetraacetate | 2 g |
| Disodium ethylenediamine tetraacetate | 2 g |
| Ammonium bromide | 150 g |
| Glacier acetic acid | 40 ml |
| Ammonium nitrate | 40 g |

Water was added to make the total quantity 1l, and pH was adjusted to 4.5 with aqueous ammonia or glacier acetic acid.

| Composition of bleacher replenisher | |
|---|---|
| Ferric diammonium 1,3-diaminopropane tetraacetate | 0.40 mol |
| Disodium ethylenediamine tetraacetate | 2 g |
| Ammonium bromide | 170 g |
| Ammonium nitrate | 50 g |
| Glacier acetic acid | 61 ml |

Water was added to make the total quantity 1l, and pH was adjusted to 3.5 with aqueous ammonia or glacier acetic acid. The pH of a liquid in the bleaching tank was maintained by adequate control.

| Compositions of fixer and fixer replenisher | |
|---|---|
| Ammonium thiosulfate | 100 g |
| Ammonium thiocyanate | 150 g |
| Anhydrous sodium bisulfite | 20 g |
| Sodium metabisulfate | 4.0 g |
| Disodium ethylenediamine tetraacetate | 1.0 g |

Water was added to make the total quantity 700 ml, and pH was adjusted to 6.5 with glacier acetic acid and aqueous ammonia.

| Compositions of stabilizer and stabilizer replenisher | |
|---|---|
| 1,2-Benzisothiazoline-3-one | 0.1 g |
| 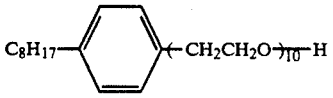 | 2.0 ml |
| (aqueous 50% solution) | |
| Hexamethylene tetramine | 0.2 g |
| Hexahydro-1,3,5-trifluoro-(2-hydroxyethyl)-5-triazine | 0.3 g |

Water was added to make the total quantity 1l, and pH was adjusted to 7.0 with potassium hydroxide and 50% sulfuric acid.

EXAMPLE 3

A multilayer color photographic light-sensitive material (Sample No. 201) was prepared by providing on a cellulose triacetate film support the layers of the following constitutions in sequence from the support:

| Sample No. 201 | |
|---|---|
| 1st layer: Anti-halation layer (HC-1) | |
| Black colloidal silver | 0.2 |
| UV absorber (UV-1) | 0.23 |
| High boiling point solvent (Oil-1) | 0.18 |
| Gelatin | 1.4 |
| 2nd Layer: 1st Intermediate layer (IL-1) | |
| Gelatin | 1.3 |
| 3rd Layer: Low-speed red-sensitive emulsion layer (RL) | |
| Silver iodobromide emulsion (average grain size: 0.4 μm) | 1.0 |
| Sensitizing dye (I-40) | $1.8 \times 10^{-5}$ |
| Sensitizing dye (I-6) | $2.8 \times 10^{-6}$ |
| Sensitizing dye (II-29) | $3.0 \times 10^{-4}$ |
| Cyan coupler (C-34) | 0.70 |
| Colored cyan coupler (CC-1) | 0.066 |
| DIR compound (D-23) | 0.04 |
| High boiling point solvent (Oil-1) | 0.64 |
| Gelatin | 1.2 |
| 4th Layer: Medium-speed red-sensitive emulsion layer (RM) | |
| Silver iodobromide emulsion (average grain size: 0.7 μm) | 0.8 |
| Sensitizing dye (I-40) | $4.0 \times 10^{-5}$ |
| Sensitizing dye (I-6) | $3.6 \times 10^{-4}$ |
| Cyan coupler (C-1) | 0.40 |
| Colored cyan coupler (CC-1) | 0.027 |
| High boiling point solvent (Oil-1) | 0.36 |
| Gelatin | 0.6 |
| 5th Lyer: High-speed red-sensitive emulsion layer (RH) | |
| Silver iodobromide emulsion (average grain size: 0.8 μm) | 1.70 |
| Sensitizing dye (I-40) | $1.9 \times 10^{-5}$ |
| Sensitizing dye (I-6) | $1.7 \times 10^{-4}$ |
| Sensitizing dye (II-29) | $1.7 \times 10^{-4}$ |
| Cyan coupler (C-34) | 0.05 |
| Cyan coupler (C-8) | 0.10 |
| Colored cyan coupler (CC-1) | 0.02 |
| DIR compound (D-23) | 0.025 |
| High boiling point solvent (Oil-1) | 0.17 |
| Gelatin | 1.2 |
| 6th Layer: 2nd Intermediate layer (IL-2) | |
| Gelatin | 0.8 |
| 7th Layer: Low-speed green-sensitive emulsion layer (GL) | |
| Silver iodobromide emulsion (average grain size: 0.4 μm) | 1.1 |
| Sensitizing dye ($I_A$-20) | $5.7 \times 10^{-4}$ |
| Sensitizing dye ($I_F$-1) | $3.6 \times 10^{-4}$ |
| Sensitizing dye ($I_A$-21) | $4.5 \times 10^{-5}$ |
| Magenta coupler (M-1) | 0.54 |
| Magenta coupler (M-2) | 0.19 |
| Colored magenta coupler (CM-1) | 0.06 |
| DIR compound (D-32) | 0.017 |
| DIR compound (D-23) | 0.01 |
| High boiling point solvent (Oil-2) | 0.81 |
| Gelatin | 1.8 |
| 8th Layer: Medium-speed green-sensitive emulsion layer (GM) | |
| Silver iodobromide emulsion (average grain size: 0.7 μm) | 0.7 |
| Sensitizing dye ($I_A$-20) | $1.9 \times 10^{-4}$ |
| Sensitizing dye ($I_F$-1) | $1.2 \times 10^{-4}$ |
| Sensitizing dye ($I_A$-21) | $1.5 \times 10^{-5}$ |
| Magenta coupler (M-1) | 0.07 |
| Magenta coupler (M-2) | 0.03 |
| Colored magenta coupler (CM-1) | 0.04 |
| DIR compound (D-32) | 0.018 |
| High boiling point solvent (Oil-2) | 0.30 |
| Gelatin | 0.8 |
| 9th Layer: High-speed green-sensitive emulsion layer (GH) | |

-continued

| Sample No. 201 | |
|---|---|
| Silver iodobromide emulsion (average grain size: 1.0 μm) | 1.7 |
| Sensitizing dye ($I_A$-20) | $1.2 \times 10^{-4}$ |
| Sensitizing dye ($I_F$-1) | $1.0 \times 10^{-4}$ |
| Sensitizing dye ($I_A$-21) | $3.4 \times 10^{-6}$ |
| Magenta coupler (M-1) | 0.09 |
| Magenta coupler (M-3) | 0.04 |
| Colored magenta coupler (CM-1) | 0.04 |
| High boiling point solvent (Oil-2) | 0.31 |
| Gelatin | 1.2 |
| 10th Layer: Yellow filter layer (YC) | |
| Yellow colloidal silver | 0.05 |
| Anti-stain agent (SC-1) | 0.1 |
| High boiling point solvent (Oil-2) | 0.13 |
| Gelatin | 0.7 |
| Formalin scavenger (HS-1) | 0.09 |
| Formalin scavenger (HS-2) | 0.07 |
| 11th Layer: Low-speed blue-sensitive emulsion layer (BL) | |
| Silver iodobromide emulsion (average grain size: 0.4 μm) | 0.5 |
| Silver iodobromide emulsion (average grain size: 0.7 μm) | 0.5 |
| Sensitizing dye (SD-9) | $5.2 \times 10^{-4}$ |
| Sensitizing dye (SD-10) | $1.9 \times 10^{-5}$ |
| Yellow coupler (Y-1) | 0.65 |
| Yellow coupler (Y-2) | 0.24 |
| DIR compound (D-23) | 0.03 |
| High boiling point solvent (Oil-2) | 0.18 |
| Gelatin | 1.3 |
| Formalin scavenger (HS-1) | 0.08 |
| 12th Layer: High-speed blue-sensitive emulsion layer (BH) | |
| Silver iodobromide (average grain size: 1.0 μm) | 1.0 |
| Sensitizing dye (SD-3) | $1.8 \times 10^{-4}$ |
| Sensitizing dye (SD-2) | $7.9 \times 10^{-5}$ |
| Yellow coupler (Y-1) | 0.15 |
| Yellow coupler (Y-2) | 0.05 |
| High boiling point solvent (Oil-2) | 0.074 |
| Gelatin | 1.3 |
| Formalin scavenger (HS-1) | 0.05 |
| Formalin scavenger (HS-2) | 0.12 |
| 13th Layer: 1st Protective layer (Pro-1) | |
| Finely-grained silver iodobromide emulsion (average grain size: 0.08 um, AgI content: 1 mol %) | 0.4 |
| UV absorber (UV-1) | 0.07 |
| UV absorber (UV-2) | 0.10 |
| High boiling point solvent (Oil-1) | 0.07 |
| High boiling point solvent (Oil-3) | 0.07 |
| Formalin scavenger (HS-1) | 0.13 |
| Formalin scavenger (HS-2) | 0.37 |
| Gelatin | 1.3 |
| 14th Layer: 2nd Protective layer (Pro-2) | |
| Alkaline-soluble matting agent (average grain size: 2 μm) | 0.13 |
| Polymethyl methacrylate (average grain size: 3 μm) | 0.02 |
| Lubricant (WAX-1) | 0.04 |
| Gelatin | 0.6 |

Besides the above ingredients, a coating aid Su-1, a dispersion aid Su-2, a viscosity controlling agent, hardeners H-1 and H-2, a stabilizer ST-1, antifoggants AF-1 and AF-2 (two kinds of AF-2 were employed, one had a weight average molecular weight of 10,000 and the other 1,100,000) were added to each layer.

Here, the average grain size is defined as the length of the side of a cube having the same volume. Each emulsion was subjected to optimum gold and sulfur sensitization.

SD-3

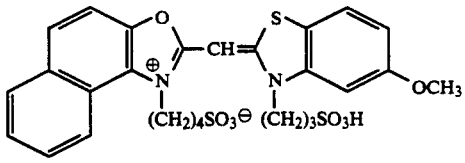

Sample Nos. 202 to 209 were prepared in substantially the same manner as in the preparation of Sample No. 201, except that the constitution of the 4th layer of Sample No. 201 was varied as shown in Table 7. The amount of Oil-1 (high boiling point solvent) was adjusted appropriately according to the amount of C-1 (cyan coupler). The sensitivity at each wavelength and maximum color density of the medium-speed red-sensitive layer were determined by the preceding methods, the results obtained are shown in Table 8.

TABLE 7

| No. | Kind an amount of Sensitizing dye (mol/mol silver) I-6 | I-40 | II-29 | III-5 | Amount of G-1 |
|---|---|---|---|---|---|
| 201 | $3.6 \times 10^{-4}$ | $4.0 \times 10^{-5}$ | 0 | 0 | 0.40 |
| 202 | $2.3 \times 10^{-4}$ | $2.6 \times 10^{-4}$ | $1.3 \times 10^{-4}$ | $1.3 \times 10^{-5}$ | 0.40 |
| 203 | $2.3 \times 10^{-4}$ | $2.6 \times 10^{-5}$ | $1.3 \times 10^{-4}$ | $1.3 \times 10^{-5}$ | 0.30 |
| 204 | $2.3 \times 10^{-4}$ | $2.6 \times 10^{-5}$ | $1.3 \times 10^{-4}$ | $1.3 \times 10^{-5}$ | 0.25 |
| 205 | $2.3 \times 10^{-4}$ | $2.6 \times 10^{-5}$ | $1.3 \times 10^{-4}$ | $1.3 \times 10^{-5}$ | 0.20 |
| 206 | $1.8 \times 10^{-4}$ | $2.0 \times 10^{-5}$ | $1.0 \times 10^{-4}$ | $1.0 \times 10^{-4}$ | 0.30 |
| 207 | $1.8 \times 10^{-4}$ | $2.0 \times 10^{-5}$ | $1.0 \times 10^{-4}$ | $1.0 \times 10^{-4}$ | 0.25 |
| 208 | $1.8 \times 10^{-4}$ | $2.0 \times 10^{-5}$ | $1.0 \times 10^{-4}$ | $1.0 \times 10^{-4}$ | 0.20 |
| 209 | $1.4 \times 10^{-4}$ | $1.6 \times 10^{-5}$ | $8.0 \times 10^{-5}$ | $1.0 \times 10^{-4}$ | 0.30 |

TABLE 8

| No. | Sensitivity relative to S640 $S_{600}$ | $S_{620}$ | $S_{650}$ | $S_{680}$ | Maximum color density |
|---|---|---|---|---|---|
| 201 | 0.73 | 0.85 | 1.11 | 0.73 | 0.43 |
| 202 | 0.61 | 0.95 | 0.63 | 0.10 | 0.43 |
| 203 | 0.61 | 0.95 | 0.63 | 0.10 | 0.31 |
| 204 | 0.61 | 0.95 | 0.63 | 0.10 | 0.24 |
| 205 | 0.61 | 0.95 | 0.63 | 0.10 | 0.19 |
| 206 | 0.60 | 0.94 | 0.65 | 0.21 | 0.31 |
| 207 | 0.60 | 0.94 | 0.65 | 0.21 | 0.24 |
| 208 | 0.60 | 0.94 | 0.65 | 0.21 | 0.19 |
| 209 | 0.73 | 0.94 | 0.59 | 0.12 | 0.31 |

For each of the samples (Sample Nos. 201 to 210), the macbeth color rendition chart was photographed with Z-up80RC (a compact camera manufactured by Konica Corp) under day light (in fine weather) and under Paluc Type PS (a 3-emissive band type fluorescent lamp manufactured by Matsushita Electronics Co., Ltd.), followed by the same processing as that conducted in Example 1 [P].

The obtained image was printed to allow the gray color of the chart to be reproduced with the same density. Color reproducibility was evaluated by 10 panellers according to 5 ratings from 1 (worst) to 5 (best). The rating in Table 9 was the average of the ratings given by the 10 panellers.

TABLE 9

| No. | Color reproducibility Under day light | Under fluorescent lamp |
|---|---|---|
| 201 | 2 | 1 |
| 202 | 3 | 2 |
| 203 | 4 | 3 |
| 204 | 4 | 3 |
| 205 | 5 | 4 |

TABLE 9-continued

| No. | Color reproducibility | |
|---|---|---|
| | Under day light | Under fluorescent lamp |
| 206 | 4 | 4 |
| 207 | 5 | 4 |
| 208 | 5 | 4 |
| 209 | 5 | 4 |

As is evident from the results, the samples of the invention had improved color reproducibility even when exposure was conducted under a fluorescent lamp.

EXAMPLE 4

Sample Nos. 211 to 214 were prepared in substantially the same manner as in the preparation of Sample No. 201, except that the constitution of the 4th layer of Sample No. 201 was varied as shown in Table 10. The sensitivity at each wavelength and maximum color density of the medium-speed red-sensitive layer were determined by the preceding methods. The results obtained are shown in Table 10.

TABLE 10

| No. | Sensitizing dye (mol per mol silver) | | | | Amount of C-1 | DIR compound | | Sensitivity relative to S640 | | | | Maximum density |
|---|---|---|---|---|---|---|---|---|---|---|---|---|
| | I-6 | I-40 | II-29 | III-5 | | | | $S_{600}$ | $S_{620}$ | $S_{660}$ | $S_{680}$ | |
| 201 | $3.6 \times 10^{-4}$ | $4.0 \times 10^{-5}$ | 0 | 0 | 0.40 | — | — | 0.73 | 0.85 | 1.11 | 0.73 | 0.43 |
| 211 | $1.4 \times 10^{-4}$ | $1.6 \times 10^{-5}$ | $8.0 \times 10^{-5}$ | $1.6 \times 10^{-4}$ | 0.40 | D-25 | 0.01 | 0.73 | 0.97 | 0.59 | 0.12 | 0.43 |
| 212 | $1.4 \times 10^{-4}$ | $1.6 \times 10^{-5}$ | $8.0 \times 10^{-5}$ | $1.6 \times 10^{-4}$ | 0.30 | D-25 | 0.01 | 0.73 | 0.97 | 0.59 | 0.12 | 0.31 |
| 213 | $1.4 \times 10^{-4}$ | $1.6 \times 19^{-5}$ | $8.0 \times 10^{-5}$ | $1.6 \times 10^{-4}$ | 0.25 | D-25 | 0.01 | 0.73 | 0.97 | 0.59 | 0.12 | 0.24 |

For each of the samples obtained, photographing of the Macbeth color rendition chart, processing, printing and evaluation were conducted in the same manner as in Example 3.

The results obtained are shown in Table 11.

TABLE 11

| No. | Color reproducibility | |
|---|---|---|
| | Under day light | Under fluorescent lamp |
| 201 | 2 | 1 |
| 211 | 3 | 2 |
| 212 | 5 | 4 |
| 213 | 5 | 5 |

It was confirmed that color purity was further improved by the use of DIR compound.

EXAMPLE 5

Similar results were obtained when Sample Nos. 201 to were processed according to Processing procedures [P] instead of Processing procedures [QP].

EXAMPLE 6

Sample Nos. 301 to 309 were prepared in substantially the same manner as in the preparation of Sample No. 101, except that the cyan couplers in the high-speed red-sensitive emulsion layer (5th layer) were varied as shown in Table 12, wherein Sample No. 301 contained 0.15 g/m$^2$ of C-1 and 0.03 g/m$^2$ of colored coupler (CC-1), which were expressed in mole fraction.

Sample Nos. 301 to 309 were each exposed to white light through an optical wedge, and processed in the same manner as in Example 1.

The relative sensitivity (S) of each sample was measured using white light (W), and from the results, RMS was obtained for each sample.

The results are shown in Table 12.

The 4th layers of the samples had all the maximum color density of not more than 0.35.

Sensitivity was defined as the reciprocal of an exposure amount that gave a minimum density+0.1, and expressed as the value relative to the sensitivity of Sample No. 301 which was set as 100.

RMS was obtained by multiplying by 1,000 times the standard deviation for the variation of a density, which was observed when scanning a portion with a minimum density+0.1 by means of a microdensitometer having a 1800 $\mu m^2$ opening for scanning (slit width: 10 $\mu$m, slit length: 180 $\mu$m). Measurement was conducted for not less than 1,000 samples.

In the RMS measurement, W-26 (a written filter manufactured by Eastman Kodak Co., Ltd.) was attached to the measurement portion of each sample. RMS was expressed as the value relative to that of Sample No. 301 which was set as 100.

TABLE 12

| Sample | 5th Layer (high-speed red-sensitive layer) | | | | | Red-sensitive layer | |
|---|---|---|---|---|---|---|---|
| | 2-Equivalent coupler | | Colored coupler | | C-1 | Relative sensitivity | RMS |
| | Type | Amount | Type | Amount | Amount | (S) | (cyan density: 0.6) |
| 301 | — | — | CC-1 | 20% | 80% | 100 | 100 |
| 302 | C-8 | 40% | CC-1 | 20% | 40% | 170 | 128 |
| 303 | C-8 | 80% | CC-1 | 20% | — | 200 | 134 |
| 304 | C-1 | 80% | CC-1 | 20% | — | 176 | 130 |
| 305 | C-27 | 80% | CC-1 | 20% | — | 180 | 128 |
| 306 | C-8 | 80% | — | — | 20% | 220 | 84 |
| 307 | C-8 | 100% | — | — | — | 252 | 70 |
| 308 | C-1 | 100% | — | — | — | 205 | 75 |
| 309 | C-27 | 100% | — | — | — | 210 | 74 |

As is evident from the results, Sample Nos. 306 to 309 each of which have a two-equivalent coupler and no colored coupler were more improved both in sensitivity and graininess than Sample Nos. 301 to 305.

EXAMPLE 7

Similar results were obtained in an experiment that was conducted in substantially the same manner as in Example 6, except that processing was conducted by the same method as in Example 2.

EXAMPLE 8

Sample Nos. 401 to 408 were prepared in substantially the same manner as in Example 1, except that the amounts of cyan coupler (C-1) and high boiling point solvent (Oil) in the medium-speed red-sensitive elemental emulsion layer (4th layer) and the amount of DIR compound (D-25) in the high-speed red-sensitive elemental emulsion layer (5th layer) were varied as shown in Table 13.

TABLE 13

| | 4th Layer | | 5th Layer | |
|---|---|---|---|---|
| Sample No. | Amount of C-1 | Amount of Oil | Type of DIR | Amount of DIR |
| 401 | 0.32 | 0.3 | D-25 | 0.025 |
| 402 | 0.28 | 0.26 | D-25 | 0.0045 |
| 403 | 0.25 | 0.23 | D-25 | 0.0045 |
| 404 | 0.21 | 0.20 | D-25 | 0.0045 |
| 405 | 0.18 | 0.16 | D-25 | 0.022 |
| 406 | 0.18 | 0.16 | D-25 | 0.013 |
| 407 | 0.18 | 0.16 | D-25 | 0.0045 |
| 408 | 0.32 | 0.3 | — | — |

Sample Nos. 401 to 408 were each exposed to white light through an optical wedge, and processed in the same manner as in Example 1.

The maximum color density of the medium-speed red-sensitive elemental emulsion layer was measured by the preceding method.

The graininess of each sample was evaluated in terms of RMS value, which was obtained by measuring the standard deviation for density variation, which was observed when scanning a portion with a minimum red density+0.5 by means of a microdensitometer having a 1800 $\mu m^2$ opening for scanning (slit width: 10 $\mu$m, slit length: 180 $\mu$m). Measurement was conducted for not less than 1,000 samples. RMS was indicated as the value relative to that of Sample No. 401 which was set as 100.

The sensitivity of each sample was defined as the reciprocal of an exposure amount that gave a minimum density +0.1, and expressed as the value relative to that of Sample No. 401 which was set as 100.

The maximum color density of the medium-speed red-sensitive elemental emulsion layer, graininess and sensitivity of each sample are shown in Table 14.

TABLE 14

| Sample No. | Maximum color density of 4th layer | Relative sensitivity (S) | RMS |
|---|---|---|---|
| 401 | 0.45 | 100 | 100 |
| 402 | 0.40 | 108 | 98 |
| 403 | 0.35 | 108 | 90 |
| 404 | 0.30 | 108 | 88 |
| 405 | 0.25 | 110 | 86 |
| 406 | 0.25 | 112 | 84 |
| 407 | 0.25 | 115 | 82 |
| 408 | 0.45 | 115 | 98 |

As is evident from the results, the samples of the present invention (Sample Nos. 403, 404, 405, 406, and 407) were significantly improved in graininess as compared with the comparative sample (Sample No. 401). Comparison between Sample Nos. 401 and 402 revealed that not only the amount of DIR but also the maximum color density of the medium-speed red-sensitive elemental emulsion layer were the key to improve graininess.

The samples of the invention had higher sensitivity than the comparative sample.

EXAMPLE 9

Similar results were obtained in an experiment that was conducted in substantially the same manner as in Example 8, except that the processing procedures were replaced with those employed in Example 2.

EXAMPLE 10

The samples obtained in Example 8 were evaluated for gradation. For the evaluation, a characteristic curve D (log E) was obtained for each sample. The characteristic curve was obtained by plotting Log E (common logarithm of exposure amount) against density, where Log E was obtained according to the preceding procedures (1) to (4) for obtaining ISO sensitivity.

From the characteristic curve, Dmin (C), the minimum cyan density, was obtained.

The j value defined by the following Formula (3) was obtained from the characteristic curve. That is, $d_0$, log $E_0$, log $E_5$, log Ei (i=0, . . . ,5) and di (i=0, . . . ,5) were obtained, where $d_0$ is a minimum density D min+0.15, log $E_0$ is an exposure that gives $d_0$, log $E_5$ is an exposure at which Δlog E is 2.5, log Ei (i=0, . . . ,5) is exposure points taken at intervals of 0.5 in a range between from log $E_0$ and log $E_5$ and di (i=0, . . . ,) is a density given at each of the preceding exposure points. Then, gi (i =0, . . . ,5), h and j were obtained respectively by the following formulae (1) to (3):

$$gi = \frac{di - di_{-1}}{\log Ei - \log Ei_{-1}} \quad (1)$$

$$h = \frac{d_5 - d_0}{\log E_5 - \log E_0} \quad (2)$$

$$j = gi/h \quad (3)$$

This j value is required to be in the following range:

$$j = 1.00 \pm 0.10 \quad (4)$$

j−1 is designated as ja.

This ja value was obtained for each sample and indicated as the value relative to that of Sample No. 401, which was set at 1.0.

TABLE 15

| Sample No. | ja value |
|---|---|
| 401 | 1.0 |
| 402 | 1.1 |
| 403 | 0.6 |
| 404 | 0.6 |
| 405 | 0.6 |
| 406 | 0.5 |
| 407 | 0.5 |
| 408 | 1.2 |

As is evident from the results shown in Table 15, the ja values of the samples of the invention (Sample Nos. 403, 404, 405, 406, and 407) were smaller than that of Comparative sample (Sample No. 401), and fell within the range defined by (4), proving that the inventive samples had excellent gradation.

EXAMPLE 11

Excellent results were obtained when the samples obtained in Example 9 were evaluated for gradation in the same manner as in Example 10.

EXAMPLE 12

A multilayer color photographic light-sensitive material Sample No. 501 was prepared by providing on a cellulose triacetate film support the layers of the following constitutions in sequence from the support:

| | |
|---|---|
| **1st Layer: Anti-halation layer (HC-1)** | |
| Black colloidal silver | 0.18 |
| UV absorber (UV-1) | 0.29 |
| High boiling point solvent (Oil-1) | 0.23 |
| High boiling point solvent (Oil-2) | 0.011 |
| Colored magenta coupler (CM-3) | 0.011 |
| Gelatin | 1.57 |
| **2nd Layer: 1st Intermediate layer (IL-1)** | |
| Gelatin | 1.27 |
| **3rd Layer: Low-speed red-sensitive emulsion layer (RL)** | |
| Silver iodobromide emulsion (AgI content: 8.1 mol %, shape: octahedral, average grain size: 0.4 μm) | 0.80 |
| Silver iodobromide emulsion (AgI content: 8 mol %, shape: octahedral, average grain size: 0.65 μm) | 1.21 |
| Sensitizing dye (I-40) | $1.3 \times 10^{-5}$ mol per mol silver |
| Sensitizing dye (I-6) | $2.2 \times 10^{-4}$ mol per mol silver |
| Sensitizing dye (II-29) $2.2 \times 10^{-4}$ | mol per mol silver |
| Cyan coupler (C-34) | 1.21 |
| Colored cyan coupler (CC-1) | 0.032 |
| DIR compound (D-25) | 0.05 |
| High boiling point solvent (Oil-1) | 1.04 |
| Gelatin | 2.00 |
| **4th Layer: High-speed red-sensitive emulsion layer (RH)** | |
| Silver iodobromide emulsion (AgI content: 2 mol %, shape: octahedral, average grain size: 0.27 μm) | 0.30 |
| Silver iodobromide emulsion (AgI content: 4 mol %, shape: octahedral, average grain size: 0.65 μm) | 0.54 |
| Silver iodobromide emulsion (Em-A) | 1.61 |
| Sensitizing dye (I-40) | $7.1 \times 10^{-6}$ mol per mol silver |
| Sensitizing dye (I-6) | $1.2 \times 10^{-4}$ mol per mol silver |
| Sensitizing dye (II-29) $1.2 \times 10^{-4}$ | mol per mol silver |
| Cyan coupler (C-34) | 0.05 |
| Cyan coupler (C-8) | 0.19 |
| DIR compound (D-3) | 0.0066 |
| DIR compound (D-25) | 0.0076 |
| High boiling point solvent (Oil-1) | 0.28 |
| Gelatin | 1.37 |
| **5th Layer: 2nd Intermediate layer (IL-2)** | |
| Gelatin | 0.80 |
| High boiling point solvent (Oil-2) | 0.08 |
| SC-2 | 0.071 |
| **6th Layer: Low-speed green-sensitive emulsion layer (GL)** | |
| Silver iodobromide emulsion (AgI content: 8.1 mol %, shape: octahedral, average grain size: 0.4 μm) | 0.69 |
| Silver iodobromide emulsion (AgI content: 8 mol %, shape: octahedral, average grain size: 0.65 μm) | 0.46 |
| Sensitizing dye ($I_C$-2) | $2.7 \times 10^{-5}$ mol per mol silver |
| Sensitizing dye ($I_A$-4) | $2.5 \times 10^{-4}$ mol per mol silver |
| Sensitizing dye ($I_F$-1) | $8.0 \times 10^{-5}$ mol per mol silver |
| Sensitizing dye ($I_A$-21) | $1.9 \times 10^{-5}$ mol per mol silver |
| Sensitizing dye ($I_A$-11) | $1.4 \times 10^{-4}$ mol per mol silver |

-continued

| | |
|---|---|
| Magenta coupler (M-3) | 0.34 |
| Colored magenta coupler (CM-3) | 0.048 |
| DIR compound (D-23) | 0.0025 |
| DIR compound (D-45) | 0.013 |
| DIR compound (D-32) | 0.02 |
| High boiling point solvent (Oil-4) | 0.38 |
| Gelatin | 1.13 |
| **7th Layer: High-speed green-sensitive emulsion layer (GH)** | |
| Silver iodobromide emulsion (AgI content: 8 mol %, %, shape: octahedral, average grain size: 0.65 μm | 0.56 |
| Silver iodobromide emulsion (Em-A) | 2.26 |
| Sensitizing dye ($I_A$-11) | $4.5 \times 10^{-5}$ mol per mol silver |
| Sensitizing dye ($I_A$-20) | $9.6 \times 10^{-5}$ mol per mol silver |
| Sensitizing dye ($I_F$-1) | $8.8 \times 10^{-5}$ mol per mol silver |
| Sensitizing dye ($I_A$-21) | $1.4 \times 10^{-5}$ mol per mol silver |
| Magenta coupler (M-1) | 0.14 |
| Magenta coupler (M-3) | 0.068 |
| Colored magenta coupler (CM-2) | 0.11 |
| DIR compound (D-5) | 0.0015 |
| High boiling point solvent (Oil-2) | 0.57 |
| Gelatin | 1.97 |
| **8th Layer: Yellow filter layer (YC)** | |
| Yellow colloidal silver | 0.05 |
| Anti-stain agent (SC-2) | 0.054 |
| High boiling point solvent (Oil-2) | 0.063 |
| Gelatin | 0.49 |
| Formalin scavenger (HS-1) | 0.08 |
| Formalin scavenger (HS-2) | 0.10 |
| **9th Layer: Low-speed blue-sensitive emulsion layer (BL)** | |
| Silver iodobromide emulsion (AgI content: 8.1 mol %, shape: octahedral, average grain size: 0.4 μm) | 0.226 |
| Silver iodobromide emulsion (AgI content: 8 mol %, shape: octahedral, average grain size: 0.65 μm) | 0.239 |
| Sensitizing dye (SD-4) | $5.5 \times 10^{-4}$ mol per mol silver |
| Sensitizing dye (SD-2) | $5.0 \times 10^{-5}$ mol per mol silver |
| Yellow coupler (Y-1) | 0.99 |
| Yellow coupler (Y-2) | 0.085 |
| DIR compound (D-1) | 0.012 |
| High boiling point solvent (Oil-2) | 0.25 |
| Gelatin | 1.60 |
| Formalin scavenger (HS-1) | 0.12 |
| Formalin scavenger (HS-2) | 0.29 |
| **10th Layer: High-speed blue-sensitive emulsion layer (BH)** | |
| Silver iodobromide emulsion (AgI content: 2 mol %, %, shape: octahedral, average grain size: 0.27 μm) | 0.20 |
| Silver iodobromide emulsion (AgI content: 8 mol %, shape: octahedral, average grain size: 0.65 μm | 0.20 |
| Silver iodobromide emulsion (Em-A) | 0.80 |
| Sensitizing dye (SD-4) | $2.0 \times 10^{-4}$ mol per mol silver |
| Sensitizing dye (SD-2) | $4.8 \times 10^{-5}$ mol per mol silver |
| Yellow coupler (Y-2) | 0.27 |
| High boiling point solvent (Oil-2) | 0.17 |
| Gelatin | 1.22 |
| Formalin scavenger (HS-2) | 0.083 |
| **11th Layer: 1st Protective layer (Pro-1)** | |
| Finely-grained silver iodobromide emulsion (average grain size: 0.08 μm, AgI content: 1 mol %) | 0.4 |
| UV absorber (UV-1) | 0.058 |
| UV absorber (UV-2) | 0.083 |
| High boiling point solvent (Oil-1) | 0.06 |
| High boiling point solvent (Oil-3) | 0.06 |
| Formalin scavenger (HS-1) | 0.047 |
| Formalin scavenger (HS-2) | 0.22 |
| Gelatin | 1.49 |
| **12th Layer: 2nd Protective layer (Pro-2)** | |

-continued

| | |
|---|---|
| Alkaline-soluble matting agent (average grain size: 2 μm) | 0.12 |
| Polymethyl methacrylate (average grain size: 3 μm) | 0.018 |
| Gelatin | 0.55 |

Besides the above ingredients, a coating aid Su-1, a dispersion aid Su-2, a viscosity controller, hardeners H-1 and H-2, a stabilizer ST-1, antifoggants AF-1 and AF-2 (AF-2had a weight average molecular weight of 1,100,000) were added to each layer.

Here, the grain size is defined as the length of the side of a cube having the same volume. Each emulsion was subjected to optimum gold and sulfur sensitization.

Sample Nos. 502 and 503 were prepared in the same manner as in the preparation of Sample No. 501, except that Em-A in the 4th, 7th and 10th layers was replaced with the emulsions shown in Table 16.

TABLE 16

| Sample No. | 4th Layer (high-speed red-senstive layer) | 7th Layer (high-speed blue-sensitive layer) | 10th Layer (high-speed green-sensitive layer) |
|---|---|---|---|
| 501 | Em-A | Em-A | Em-A |
| 502 | Em-B | Em-B | Em-B |
| 503 | Em-1 | Em-1 | Em-1 |

Sample No. 504

A multilayer color photographic light-sensitive material (Sample No. 504) was prepared by providing on a cellulose triacetate film support the layers of the following constitutions in sequence from the support. 1st to 5th Layers: same as the 1st to 5th layers of Sample No. 501

| | |
|---|---|
| 6th Layer: Medium-speed green-sensitive emulsion layer (GL) | |
| Silver iodobromide emulsion (AgI content: 8.1 mol %, %, shape: octahedral, average grain size: 0.4 μm) | 0.98 |
| Silver iodobromide emulsion (AgI content: 2 mol %, shape: octahedral, average grain size: 0.27 μm) | 0.11 |
| Sensitizing dye ($I_C$-2) | $6.8 \times 10^{-5}$ mol per mol silver |
| Sensitizing dye ($I_A$-4) | $6.2 \times 10^{-4}$ mol per mol silver |
| Magenta coupler (M-1) | 0.54 |
| Magenta coupler (M-2) | 0.19 |
| Colored magenta coupler (CM-1) | 0.06 |
| DIR compound (D-32) | 0.017 |
| High boiling point solvent (Oil-2) | 0.81 |
| Gelatin | 1.77 |
| 7th Layer: Medium-speed green-sensitive emulsion layer (GH) | |
| Silver iodobromide emulsion (AgI content: 8 mol %, shape: octahedral, average grain size: 0.65 μm) | 0.66 |
| Sensitizing dye ($I_A$-20) | $1.9 \times 10^{-4}$ mol per mol silver |
| Sensitizing dye ($I_F$-1) | $1.2 \times 10^{-4}$ mol per mol silver |
| Sensitizing dye ($I_A$-21) | $1.5 \times 10^{-5}$ mol per mol silver |
| Sensitizing dye ($I_C$-2) | $8.2 \times 10^{-5}$ mol per mol silver |
| Magenta coupler (M-1) | 0.074 |
| Magenta coupler (M-2) | 0.034 |
| Colored magenta coupler (CM-1) | 0.043 |
| DIR compound (D-32) | 0.018 |
| High boiling point solvent (Oil-2) | 0.30 |
| Gelatin | 0.76 |
| 8th Layer: High-speed green-sensitive emulsion layer (GH) | |
| Silver iodobromide emulsion (Em-A) | 1.66 |
| Sensitizing dye ($I_A$-20) | $1.2 \times 10^{-4}$ mol per mol silver |
| Sensitizing dye ($I_F$-1) | $1.0 \times 10^{-4}$ mol per mol silver |
| Sensitizing dye ($I_A$-21) | $3.4 \times 10^{-6}$ mol per mol silver |
| Sensitizing dye ($I_C$-2) | $2.1 \times 10^{-5}$ mol per mol silver |
| Magenta coupler (M-1) | 0.094 |
| Magenta coupler (M-3) | 0.044 |
| Colored magenta coupler (CM-1) | 0.038 |
| High boiling point solvent (Oil-2) | 0.31 |
| Gelatin | 1.23 |
| 9th Layer: Yellow filter layer (YC) | |
| Yellow colloidal silver | 0.05 |
| Anti-stain agent (SC-1) | 0.1 |
| High boiling point solvent (Oil-2) | 0.125 |
| Gelatin | 1.33 |
| Formalin scavenger (HS-1) | 0.088 |
| Formalin scavenger (HS-2) | 0.066 |
| 10th Layer: Low-speed blue-sensitive emulsion layer (BL) | |
| Silver iodobromide emulsion (AgI content: 2 mol %, shape: octahedral, average grain size: 0.27 μm) | 0.12 |
| Silver iodobromide emulsion (AgI content: 8 mol %, shape: octahedral, average grain size: 0.4 μm) | 0.24 |
| Silver iodobromide emulsion (AgI content: 8.1 mol %, shape: octahedral, average grain size: 0.65 μm) | 0.12 |
| Sensitizing dye (SD-1) | $5.2 \times 10^{-4}$ mol per mol silver |
| Sensitizing dye (SD-2) | $1.9 \times 10^{-5}$ mol per mol silver |
| Yellow coupler (Y-1) | 0.65 |
| Yellow coupler (Y-2) | 0.24 |
| High boiling point solvent (Oil-2) | 0.18 |
| Gelatin | 1.25 |
| Formalin scavenger (HS-1) | 0.08 |
| 11th Layer: High-speed blue-sensitive emulsion layer (BH) | |
| Silver iodobromide (EM-A) | 0.81 |
| Silver iodobromide emulsion (AgI content: 8 mol %, shape: octahedral, average grain size: 0.65 μm) | 0.14 |
| Sensitizing dye (SD-1) | $1.8 \times 10^{-4}$ mol per mol silver |
| Sensitizing dye (SD-2) | $7.9 \times 10^{-5}$ mol per mol silver |
| Yellow coupler (Y-1) | 0.18 |
| High boiling point solvent (Oil-2) | 0.074 |
| Gelatin | 1.30 |
| Formalin scavenger (HS-1) | 0.05 |
| Formalin scavenger (HS-2) | 0.12 |
| 12th Layer: 1st Protective layer (Pro-1) | |
| Finely-grained silver iodobromide emulsion (average grain size: 0.08 μm, AgI content: 1 mol %) | 0.4 |
| UV absorber (UV-1) | 0.07 |
| UV absorber (UV-2) | 0.10 |
| High boiling point solvent (Oil-1) | 0.07 |
| High boiling point solvent (Oil-3) | 0.07 |
| Formalin scavenger (HS-1) | 0.13 |
| Formalin scavenger (HS-2) | 0.37 |
| Gelatin | 1.3 |
| 13th Layer: 2nd Protective layer (Pro-2) | |
| Alkaline-soluble matting agent (average grain size: 2 μm) | 0.13 |
| Polymethyl methacrylate (average grain size: 3 μm) | 0.02 |
| Lubricant (WAX-1) | 0.04 |
| Gelatin | 0.6 |

As in the case of Sample No. 501, a coating aid Su-1, a dispersion aid Su-2, a viscosity controller, hardeners H-1 and H-2, a stabilizer St-1, antifoggants AF-1 and AF-2 (two kinds of AF-2 were employed. One had a weight average molecular weight of 10,000 and the other 1,100,000) were added to each layer besides the above ingredients.

Sample Nos. 505 to 507 were prepared in substantially the same manner as in the preparation of Sample No. 504, except that Em-A in the 4th, 8th and 11th layers was replaced with the emulsions shown in Table 17.

Table 17, showing data on Sample No. 508 which will be explained later, is given below:

TABLE 17

| Sample No. | 4th Layer (high-speed red-sensitive layer) | 8th Layer (high-speed green-sensitive layer) | 11th Layer (high-speed blue-sensitive layer) |
|---|---|---|---|
| 504 | Em-A | Em-A | Em-A |
| 505 | Em-A | Em-A | Em-1 |
| 506 | Em-A | Em-1 | Em-A |
| 507 | Em-1 | Em-1 | Em-1 |
| 508 | Em-1 | Em-1 | Em-1 |

Sample No. 508 was prepared in substantially the same manner as in the preparation of Sample No. 507, except that the composition of the 7th layer was varied as follows:

| 7th Layer of Sample No. 508 | |
|---|---|
| Silver iodobromide emulsion (AgI content: 8 mol %, shape: octahedral, average grain size: 0.65 μm) | 0.47 |
| Sensitizing dye ($I_A$-20) | $1.9 \times 10^{-4}$ mol per mol silver |
| Sensitizing dye ($I_F$-1) | $1.2 \times 10^{-4}$ mol per mol silver |
| Sensitizing dye ($I_A$-21) | $1.5 \times 10^{-5}$ mol per mol silver |
| Sensitizing dye ($I_C$-2) | $8.2 \times 10^{-5}$ mol per mol silver |
| Magenta coupler (M-1) | 0.052 |
| Magenta coupler (M-2) | 0.024 |
| Colored magenta coupler (CM-1) | 0.030 |
| DIR compound (D-32) | 0.013 |
| High boiling point solvent (Oil-2) | 0.22 |
| Gelatin | 0.70 |

Sample No. 509 was prepared by providing on a cellulose triacetate film support the layers of the following constitutions in sequence from the support:

| | |
|---|---|
| 1st and 2nd Layers: same as those of Sample No. 504 | |
| 3rd Layer: Low-speed red-sensitive emulsion layer (RL) | |
| Silver iodobromide emulsion (AgI content: 8.1 mol %, shape: octahedral, average grain size: 0.4 μm) | 0.78 |
| Silver iodobromide emulsion (AgI content2 mol %, shape: octahedral, average grain size: 0.27 μm) | 0.20 |
| Sensitizing dye (I-40) | $1.8 \times 10^{-5}$ mol per mol silver |
| Sensitizing dye (I-6) | $2.8 \times 10^{-4}$ mol per mol silver |
| Sensitizing dye (II-29) | $3.0 \times 10^{-4}$ mol per mol silver |
| Cyan coupler (C-34) | 0.70 |
| Colored cyan coupler (CC-1) | 0.066 |
| DIR compound (D-25) | 0.028 |
| High boiling point solvent (Oil-1) | 0.64 |

-continued

| | |
|---|---|
| Gelatin | 1.18 |
| 4th Layer: Medium-speed red-sensitive emulsion layer (RM) | |
| Silver iodobromide emulsion (AgI content: 8 mol %, shape: octahedral, average grain size: 0.65 μm) | 0.78 |
| Sensitizing dye (I-40) | $2.1 \times 10^{-5}$ mol per mol silver |
| Sensitizing dye (I-6) | $1.9 \times 10^{-4}$ mol per mol silver |
| Sensitizing dye (II-29) | $1.9 \times 10^{-4}$ mol per mol silver |
| Cyan coupler (C-34) | 0.28 |
| Colored cyan coupler (CC-1) | 0.027 |
| DIR compound (D-25) | 0.011 |
| High boiling point solvent (Oil-1) | 0.26 |
| Gelatin | 0.58 |
| 5th Layer: High-speed red-sensitive emulsion layer (RH) | |
| Silver iodobromide emulsion (Em-A) | 1.73 |
| Sensitizing dye (I-40) | $1.9 \times 10^{-5}$ mol per mol silver |
| Sensitizing dye (I-6) | $1.7 \times 10^{-4}$ mol per mol silver |
| Sensitizing dye (II-29) | $1.7 \times 10^{-4}$ mol per mol silver |
| Cyan coupler (C-8) | 0.14 |
| DIR compound (D-25) | 0.025 |
| High boiling point solvent (Oil-1) | 0.17 |
| Gelatin | 1.24 |
| 6th Layer: same as the 5th layer of Sample No. 504 | |
| 7th Layer: same as the 6th layer of Sample No. 504 | |
| 8th Layer: same as the 7th layer of Sample No. 504 | |
| 9th Layer: same as the 8th layer of Sample No. 504 | |
| 10th Layer: same as the 9th layer of Sample No. 504 | |
| 11th Layer: same as the 10th layer of Sample No. 504 | |
| 12th Layer: same as the 11th layer of Sample No. 504 | |
| 13th Layer: same as the 12th layer of Sample No. 504 | |
| 14th Layer: same as the 13th layer of Sample No. 504 | |

Besides the above ingredients, a coating aid Su-1, a dispersion aid Su-2, a viscosity controller, hardeners H-1 and H-2, a stabilizer ST-1, antifoggants AF-1 and AF-2 (two kinds of AF-2 were employed. One had a weight average molecular of 10,000 and the other 1,100,000) were added to each layer.

Sample Nos. 510 to 514 were prepared in substantially the same manner as in the preparation of Sample No. 509, except that Em-A in the 5th, 9th and 12th layers was replaced with the emulsions shown in Table 18.

TABLE 18

| Sample No. | 5th Layer (high-speed red-sensitive layer) | 9th Layer (high-speed green-sensitive layer) | 12th Layer (high-speed blue-sensitive layer) |
|---|---|---|---|
| 509 | Em-A | Em-A | Em-A |
| 510 | Em-B | Em-B | Em-B |
| 511 | Em-C | Em-C | Em-C |
| 512 | Em-1 | Em-1 | Em-1 |
| 513 | Em-2 | Em-2 | Em-2 |
| 514 | Em-3 | Em-3 | Em-3 |
| 515 | Em-3 | Em-3 | Em-3 |
| 516 | Em-3 | Em-3 | Em-3 |

Sample Nos. 515 and 516 was prepared in substantially the same manner as in the preparation of Sample No. 514, except that the compositions of the 4th (the medium-speed red-sensitive layer) and 8th (the medium-speed green-sensitive layer) layers were varied as shown below:

| | |
|---|---|
| 4th Layer of Sample No. 515 | |
| Silver iodobromide emulsion (AgI content: 8 mol %, shape: octahedral, average grain size: 0.65 μm) | 0.59 |
| Sensitizing dye (I-40) | $2.1 \times 10^{-5}$ mol per mol silver |
| Sensitizing dye (I-6) | $1.9 \times 10^{-4}$ mol per mol silver |
| Sensitizing dye (II-29) | $1.9 \times 10^{-4}$ mol per mol silver |
| Cyan coupler (C-34) | 0.22 |
| Colored cyan coupler (CC-1) | 0.020 |
| DIR compound (D-25) | 0.008 |
| High boiling point solvent (Oil-1) | 0.20 |
| Gelatin | 0.56 |
| 8th Layer of Sample No. 515 | |
| Same as the 7th layer of Sample No. 508 | |
| 4th Layer of Sample No. 516 | |
| Silver iodobromide emulsion (AgI content: 8 mol %, shape: octahedral, average grain size: 0.65 μm) | 0.44 |
| Sensitizing dye (I-40) | $2.1 \times 10^{-5}$ mol per mol silver |
| Sensitizing dye (I-6) | $1.9 \times 10^{-4}$ mol per mol silver |
| Sensitizing dye (II-29) | $1.9 \times 10^{-4}$ mol per mol silver |
| Cyan coupler (C-34) | 0.16 |
| Colored cyan coupler (CC-1) | 0.015 |
| DIR compound (D-25) | 0.006 |
| High boiling point solvent (Oil-1) | 0.15 |
| Gelatin | 0.54 |
| 8th Layer of Sample No. 516 | |
| Silver iodobromide emulsion (AgI content: 8 mol %, shape: octahedral, average grain size: 0.65 μm) | 0.32 |
| Sensitizing dye ($I_A$-20) | $1.9 \times 10^{-4}$ mol per mol silver |
| Sensitizing dye ($I_F$-1) | $1.2 \times 10^{-4}$ mol per mol silver |
| Sensitizing dye ($I_C$-2) | $8.2 \times 10^{-5}$ mol per mol silver |
| Magenta coupler (M-1) | 0.036 |
| Magenta coupler (M-2) | 0.017 |
| Colored magenta coupler (CM-1) | 0.021 |
| DIR compound (D-2) | 0.009 |
| High boiling point solvent (Oil-2) | 0.15 |
| Gelatin | 0.72 |

M-4

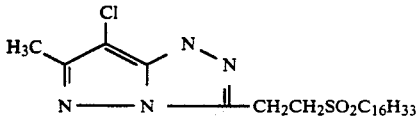

CM-2

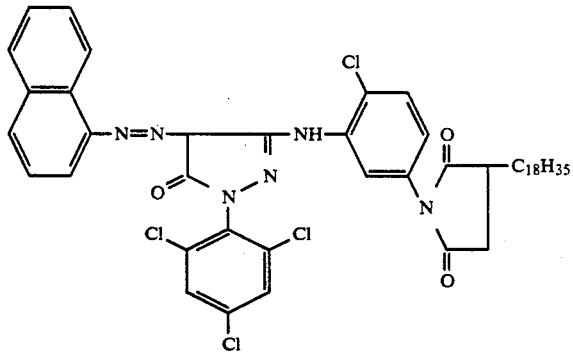

CM-3

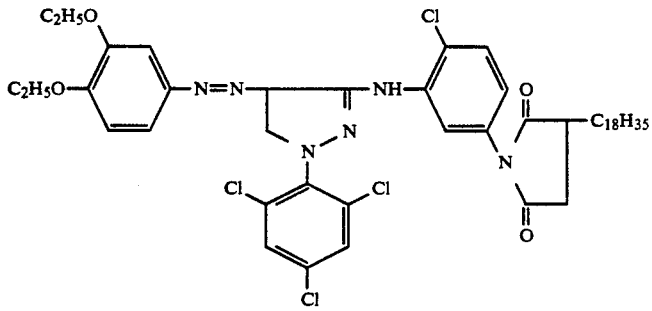

-continued
D-45
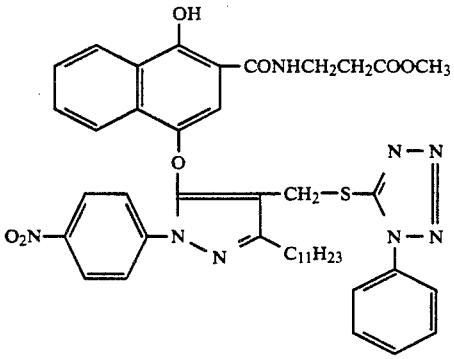
D-46
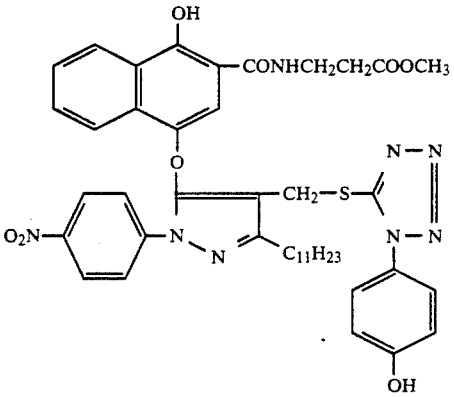
Oil-4
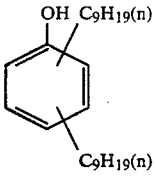
SC-2
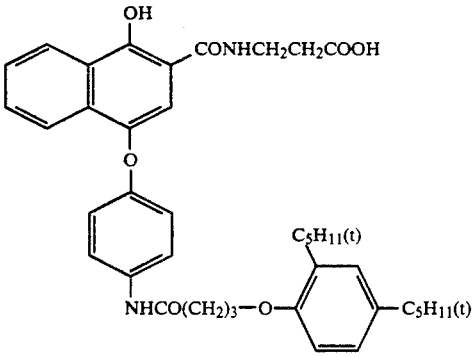

-continued

SD-4

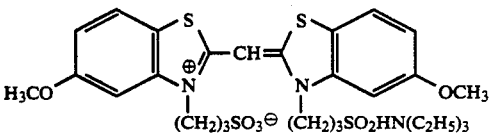

Em-1 to 3, Em-A and B were prepared according to the following procedures:

PREPARATION OF A SPHERICAL SEED EMULSION

According to the method described in Japanese Patent O.P.I. Publication No. 6643/1986, a monodispersed emulsion consisting of spherical seed crystals was prepared from the following Solutions $A_1$ to $D_1$:

| | |
|---|---|
| Solution $A_1$: | |
| Ossein gelatin | 150 g |
| Potassium bromide | 53.1 g |
| Potassium iodide | 24 g |
| Water was added to make the total quantity | 7.2 l. |
| Solution $B_1$: | |
| Silver nitrate | 1500 g |
| Water was added to make the total quantity | 6 l. |
| Solution $C_1$: | |
| Potassium bromide | 1327 g |
| 1-Phenyl-5-mercaptotetrazole (dissolved in methanol) | 0.3 g |
| Water was added to make the total quantity | 3 l. |
| Solution $D_1$: | |
| Aqueous ammonia (28%) | 705 ml |

To Solution $A_1$, which had been stirred vigorously at 40° C., Solutions $B_1$ and $C_1$ were added by the double-jet method over a period of 30 seconds to form nucleus. pBr was in the range of 1.09 to 1.15.

After 1 minute and 30 seconds, Solution $C_1$ was added over a period of 20 seconds, followed by 5-minute ripening. The KBr concentration and the ammonia concentration at the time of ripening were 0.071 mol/l and 0.63 mol/l, respectively.

After adjusting pH to 6.0, desalting and rinsing were performed immediately. Electron microscopic observation revealed that this emulsion was a monodisparsed emulsion consisting of spherical grains with an average grain size of 0.36 μm and a variation coefficient of 18%.

PREPARATION OF Em-1

An emulsion with an average silver iodide content of 7.9% was prepared from the following Solutions $A_2$, $B_{2-1}$, $C_{2-1}$, $B_{2-2}$ and $C_{2-2}$ according to the procedures described below:

| | |
|---|---|
| Solution $A_1$ | |
| Ossein gelatin | 74.1 g |
| Seed emulsion (obtained above) equivalent to | 0.372 mol |
| Water was added to make the total quantity | 4 l. |
| Solution $B_{2-1}$ | |
| Silver nitrate | 591 g |
| Nitric acid (1.38 N) | 15.7 ml |
| Water was added to make the total quantity | 3164 ml. |
| Solution $C_{2-1}$ | |
| Ossein gelatin | 127 g |
| Potassium bromide | 352 g |
| Potassium iodide | 86.7 g |

-continued

| | |
|---|---|
| Water was added to make the total quantity | 3164 ml. |
| Solution $B_{2-2}$ | |
| Silver nitrate | 591 g |
| Nitric acid (1.38 N) | 3.8 ml |
| Water was added to make the total quantity | 925 ml. |
| Solution $C_{2-2}$ | |
| Ossein gelatin | 37 g |
| Potassium bromide | 381 g |
| Potassium iodide | 5.4 g |
| Water was added to make the total quantity | 925 ml. |

In the same apparatus as disclosed in Japanese Patent O.P.I. Publication No. 160128/1987, 6 nozzles were used for each of Solutions $B_2$ and $C_2$ to supply the solution to the lower portion of a stirring spatula.

To solution $A_2$ that had been stirred vigorously at 75° C. at 1,000 rpm, Solutions $B_{2-1}$ and $C_{2-1}$ were added by the double-jet method over a period of 120 minutes and 17 seconds. The flow rate was initially 12.21 ml/min and increased gradually to a final rate of 26.03 ml/min. The addition was continued at a flow rate of 26.03 ml/min for 33 minutes and 11 seconds. During this addition, pAg and pH were adjusted to 8.0 and 2.0, respectively. Nitric acid was used for pH adjustment.

To this solution, Solutions $B_{2-2}$ and $C_{2-2}$ were added by the double-jet method over a period of 22 minutes and 26 seconds. The initial and final flow rates of these solutions were 38.5 ml/min and 44.0 ml/min, respectively. pAg and pH were kept at 8.0 and 2.0, respectively.

After the addition, pH was adjusted to 6.0, and desalting was made in the usual way.

Electron microscopic observation revealed that the emulsion was a monodispersed emulsion consisting entirely of twin crystal grains and having a grain size distribution of 13%. The proportion of grains having two or more parallel twin crystal faces was 85%.

Figure 3:
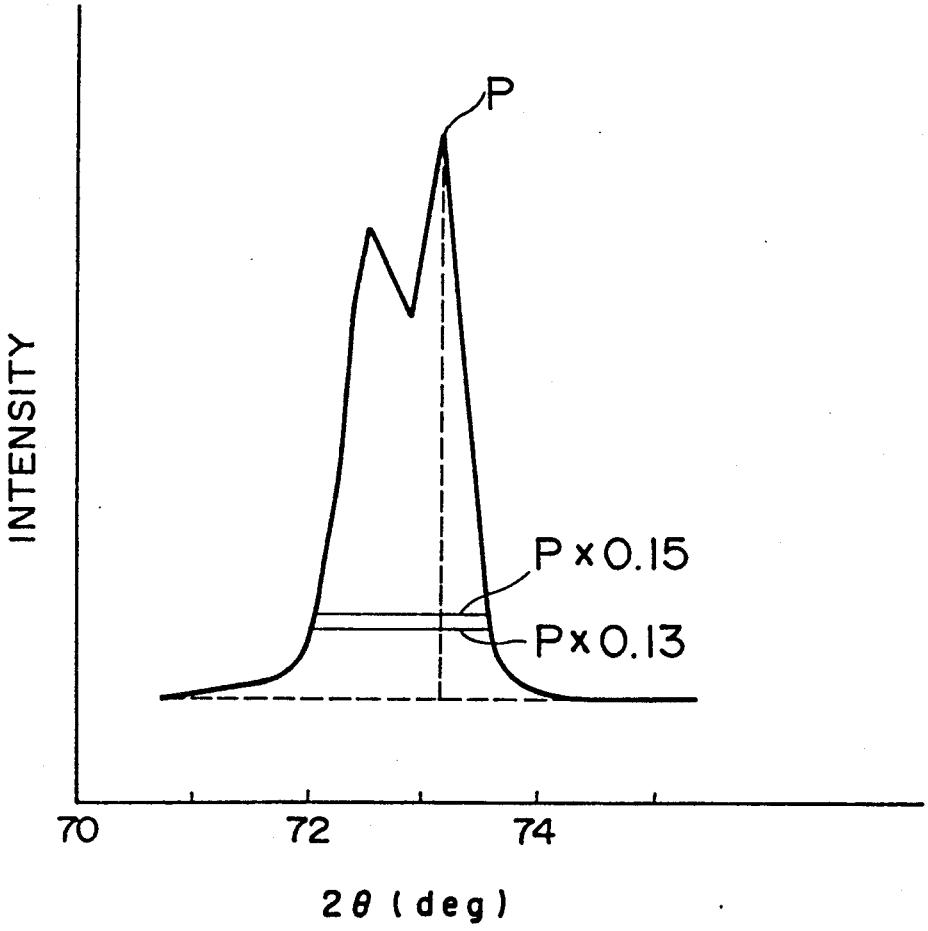
FIGS. 3, 4, 5, 6 and 7 show X-ray diffraction patterns of Em-1, Em-2, Em-3, Em-A and Em-B, respectively.

In the X-ray (Cu Kα ray) diffraction pattern of the (420) face of the silver halide grain in this emulsion, the width of a signal at a point of the maximum peak height×0.13 and that at a point of the maximum peak height×0.15 were 1.60 and 1.50 degrees, respectively. FIG. 3 shows an X-ray diffraction pattern of this emulsion. In this figure, P indicates the maximum peak, P×0.13 indicates a point of the maximum peak height×0.13 and P×0.15 indicates a point of the maximum peak height×0.15 (the same can be applied to the remaining figures).

As to the grains having an even number of twin crystal faces, the average value of the grain diameter/grain thickness ratio was 2.8.

This emulsion was designated as Em-1.

PREPARATION OF EM-2

An emulsion with an average silver iodide content of 8.0 mol % was prepared by the following method:

| | |
|---|---|
| **Solution $A_3$** | |
| Ossein gelatin | 74.1 g |
| Seed emulsion equivalent to | 0.372 mol |
| Water was added to make the total quantity | 4000 ml. |
| **Solution $B_{3-1}$** | |
| Silver nitrate | 193.7 g |
| Nitric acid (1.38 N) | 10.3 ml |
| Water was added to make the total quantity | 2074 ml. |
| **Solution $C_{3-1}$** | |
| Ossein gelatin | 83 g |
| Potassium bromide | 95.0 g |
| Potassium iodide | 56.9 g |
| Water was added to make the total quantity | 2074 ml. |
| **Solution $B_{3-2}$** | |
| Silver nitrate | 943.1 g |
| Silver nitrate (1.38 N) | 6.6 ml |
| Water was added to make the total quantity | 1585 ml. |
| **Solution $C_{3-2}$** | |
| Ossein gelatin | 13.0 g |
| Potassium bromide | 115.4 g |
| Potassium iodide | 28.4 g |
| Water was added to make the total quantity | 326 ml. |
| **Solution $C_{3-3}$** | |
| Ossein gelatin | 50.4 g |
| Potassium bromide | 519.6 g |
| Potassium iodide | 7.32 g |
| Water was added to make the total quantity | 1259 ml. |

An emulsion was prepared by using the preceding apparatus.

To solution $A_3$ that had been stirred vigorously at 75° C. at 1,000 rpm, Solutions $B_{3-1}$ and $C_{3-1}$ were added by the double-jet method. The initial flow rate was 24.2 ml/min, the final flow rate was 50.8 ml/min, and the addition time was 55 minutes and 9 seconds. During the addition, pAg and pH were maintained at 8.0 and 2.0, respectively. Nitric acid was used for pH adjustment.

To this mixture, Solutions $B_{3-2}$ and $C_{3-2}$ were added by the double-jet method. The initial flow rate, the final flow rate and the addition time were 7.98 ml/min, 10.62 ml/min and 35 minutes and 3 seconds, respectively. pAg and pH were maintained at 8.0 and 2.0, respectively.

To this mixture, Solutions $B_{3-2}$ and $C_{3-2}$ were added by the double-jet method. The initial flow rate, the final flow rate and the addition time were 39.09 ml/min, 69.1 ml/min and 24 minutes and 19 seconds, respectively. pAg and pH were maintained at 8.0 and 2.0, respectively. After the addition, pH was adjusted to 6.0, followed by conventional desalting and rinsing.

Electron microscopic examination revealed that this emulsion was a monodispersed emulsion consisting entirely of twin crystal grains and having a grain size distribution of 14%. The proportion of grains having two or more parallel twin crystal faces was 82%.

The average grain diameter/grain thickness ratio of the grains having two or more parallel twin crystal faces was 1.9.

Figure 4:
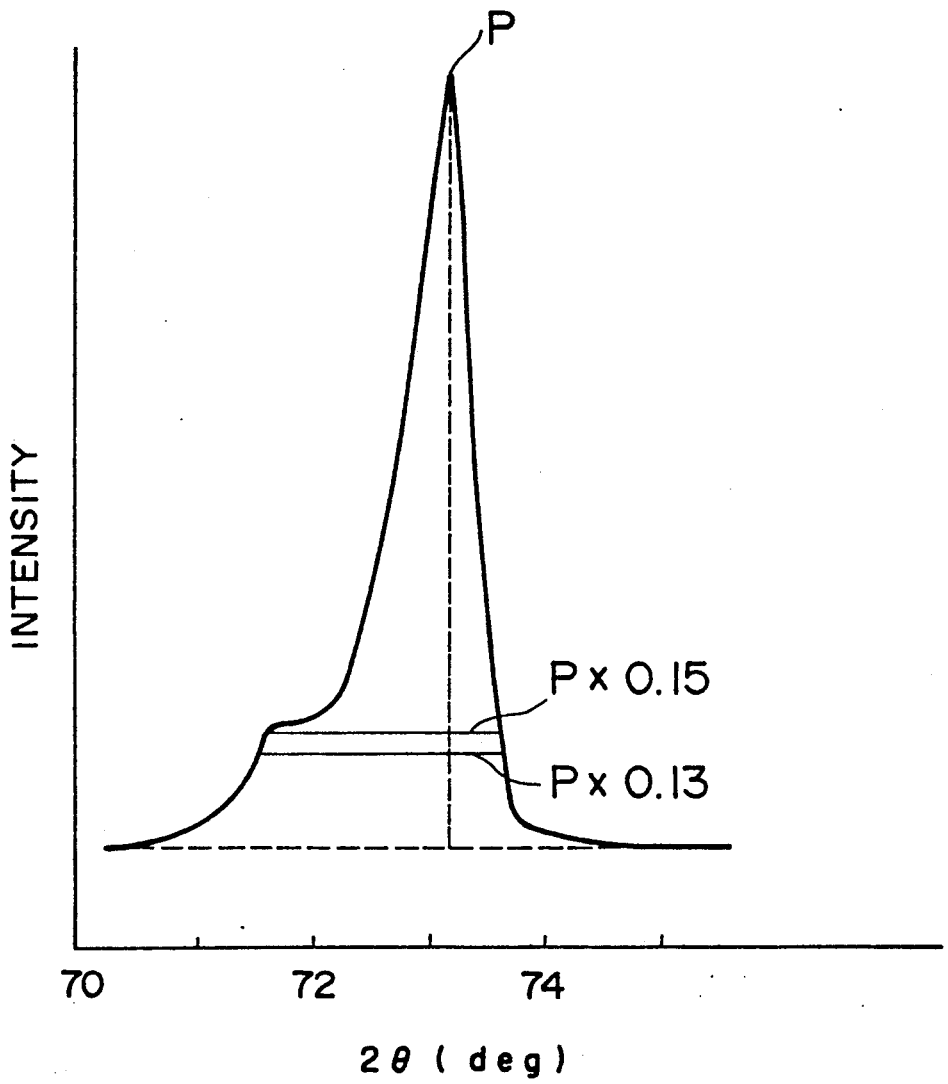

In the X-ray (Cu Kα ray) diffraction pattern of the (420) face of the silver halide grain in this emulsion, the width of a signal at a point of the maximum peak height×0.13 and that at a point of the maximum peak height×0.15 were 2.15 and 2.05 degrees, respectively. FIG. 4 shows an X-ray diffraction pattern of this emulsion.

This emulsion was designated as Em-2.

PREPARATION OF EM-3

An emulsion Em-3 with an average silver iodide content of 10.1% was prepared by using the preceding seed emulsion.

Em-3 was a monodispersed emulsion consisting entirely of twin crystal grains having a grain size distribution of 14%. The proportion of grains having two or more parallel twin crystal faces was 78%.

Figure 5:
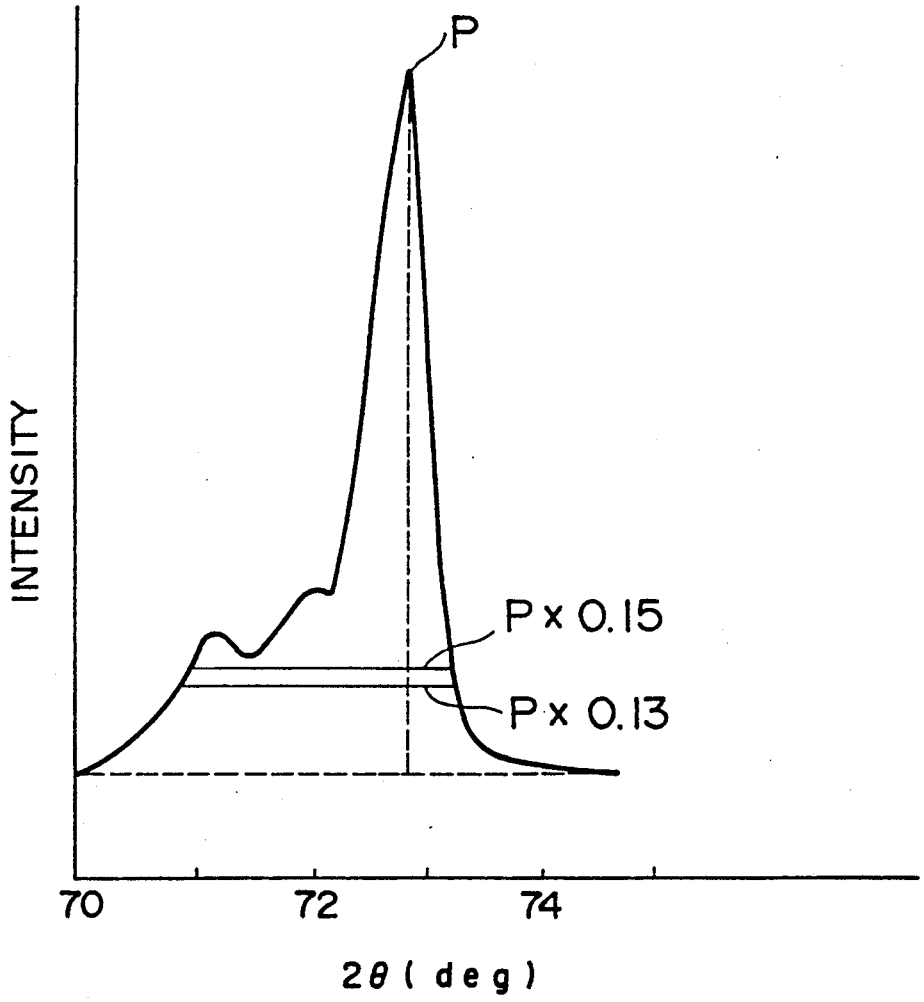

The X-ray diffraction (Cu Kα ray) pattern of the (420) faces of this emulsion had three peaks. The width of a signal at a point of maximum peak height×0.13 and that at a point of maximum peak height×0.15 were 2.38 and 2.28 degrees, respectively. FIG. 5 shows an X-ray diffraction pattern of this emulsion.

The volume proportion of the seed, the interior phase, the intermediate phase and the outermost phase, as well as the silver iodide content of each phase are shown in Table 19.

TABLE 19

| Emulsion | Seed | | Interior phase | | Outermost phase | | Intermediate phase | | Average silver iodide |
|---|---|---|---|---|---|---|---|---|---|
| No. | Vol % | AgI % | Vol % | AgI % | Vol % | AgI % | Vol % | AgI % | content (%) |
| Em-1 | 5 | 1.4 | 49 | 15 | — | — | 46 | 1 | 7.9 |
| Em-2 | 5 | 1.4 | 16 | 30 | 16 | 15 | 62 | 1 | 8.0 |
| Em-3 | 5 | 1.4 | 17 | 35 | 17 | 20 | 61 | 1 | 10.1 |
| Em-A | 5 | 1.4 | 17 | 30 | — | — | 78 | 1 | 6.0 |
| Em-B | 5 | 1.4 | 30 | 38 | — | — | 65 | 1 | 12.1 |

PREPARATION OF EM-A AND EM-B

Emulsions Em-A and Em-B were prepared in substantially the same manner as in the preparation of Em-1 and 2.

The volume proportion of the seed, the interior phase, the intermediate phase and the outermost phase, as well as the silver iodide content of each phase are shown in Table 19.

Each of Em-A and Em-B was a monodispersed emulsion consisting entirely of twin crystals grains with a grain size distribution of 13%.

Analysis on an X-ray diffraction pattern of the (420) face of the grain in these comparative emulsions revealed the following:

Em-A:

Having two peaks.

The width of a signal at a point of the maximum peak height×0.13: 1.00 degree

The width of a signal at a point of the maximum peak height×0.15: 0.93 degree

Em-B:

Having two peaks.

The width of a signal at a point of the maximum peak height×0.13: 1.23 degrees

The width of a signal at a point of the maximum peak height×0.15: 1.13 degrees

Figure 6:
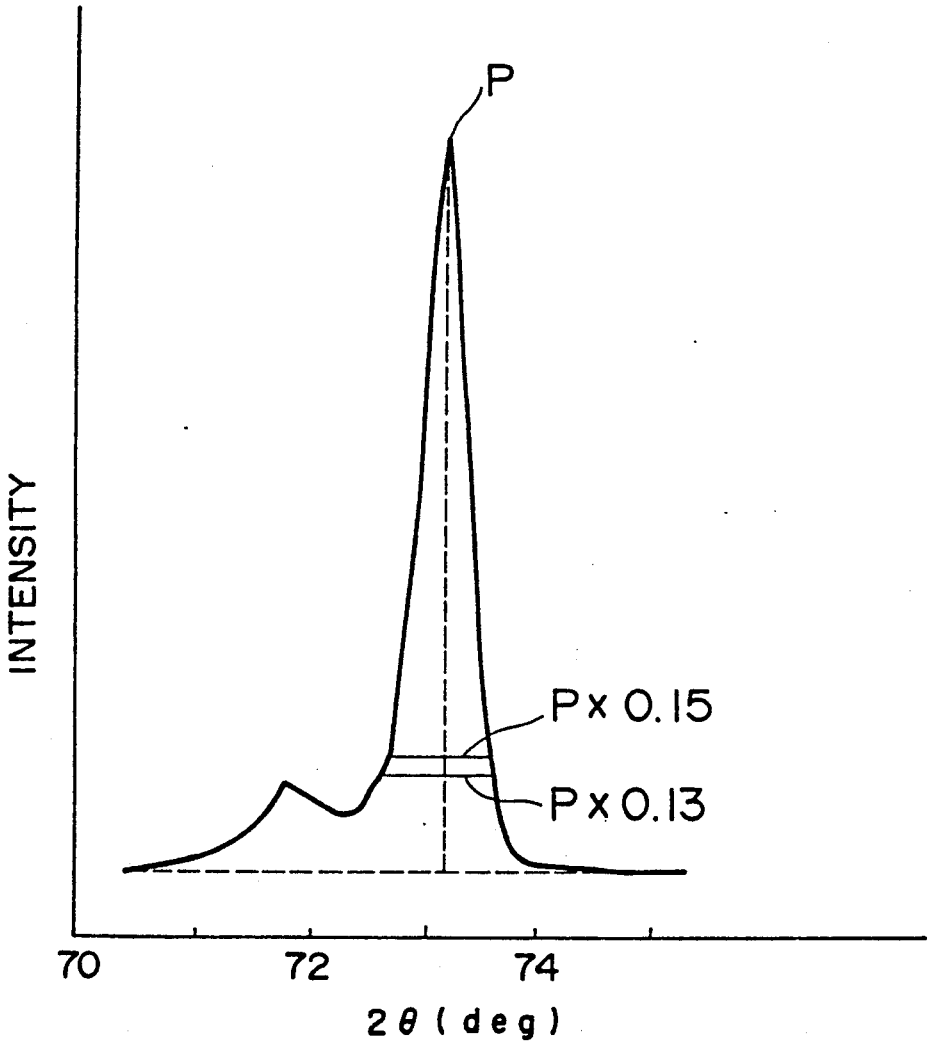
Figure 7:
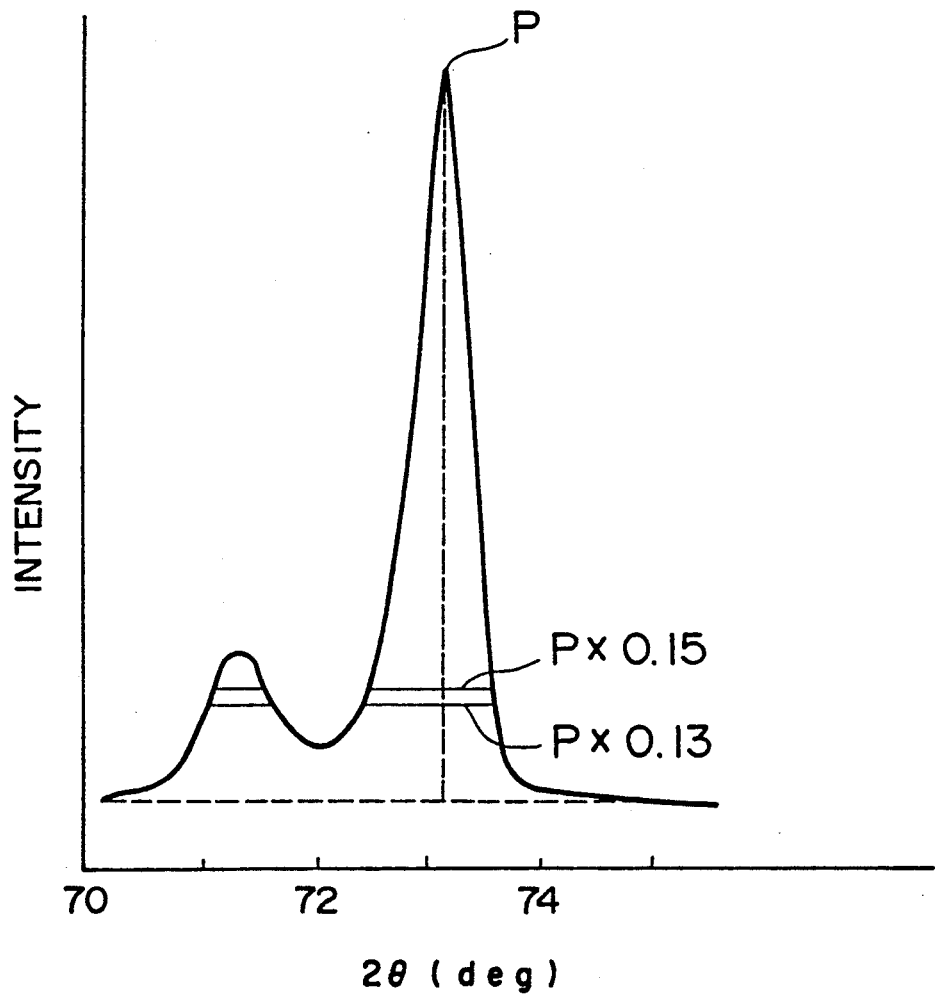

In both cases, the signal was not present continuously over a diffraction angle (28) of 1.50 degrees. FIGS. 6 and 7 show X-ray diffraction patterns of Em-A ;nd Em-B, respectively.

Each of Em-1 to 3 and Em-A and B was chemically sensitized with sodium thiosulfate, chloroauric acid and ammonium thiocyanate.

Sample Nos. 501 to 516 were evaluated for resistance to pressure, graininess, the maximum color density of the medium-speed layer and the ISO speed. The results obtained are shown in Table 20.

The evaluation was performed according to the following procedures:

EVALUATION PROCEDURES

Resistance To Pressure

An unexposed sample was left at 40° C. and RH 70% for 14 hours. Then, at RH 40%, the emulsion layer side of the sample was rubbed with a sapphire needle (0.025 mmϕ, JIS standard: K6718) so that scratches were formed thereon. The load was kept at 10 g and the needle moved at a speed of 600 m/min. The sample was processed in the same manner as in Example 1. Then, a difference in density between the portion having scratches and the scratchless portion was measured by means of a microdensitometer.

Graininess

Graininess was evaluated in terms of RMS granularity, which was obtained by multiplying by 1000 times the standard deviation for the variation of density that was observed when the portion with a fogging density+0.15 was scanned by means of a microdensitometer having a scanning area of 1800 $\mu m^2$ (slit width: 10 $\mu m$, slit length: 130 $\mu m$). Measurement was made for not less than 1000 samples. Wratten filters W-26, W-99 and W-47 (each manufactured by Eastman Kodak, Co., Ltd.) were employed for cyan, magenta and yellow color densities, respectively.

Processing was conducted in the same manner as in Example 1.

TABLE 20

| Sample | Resistance to pressure 1) | | | Graininess 2) | | | Maximum color density of medium-speed layer | | |
|---|---|---|---|---|---|---|---|---|---|
| No. | Cyan | Magenta | Yellow | Cyan | Magenta | Yellow | Red-sensitive layer | Green-sensitive layer | ISO speed |
| 501 | 100 | 100 | 100 | 100 | 100 | 100 | — | — | 390 |
| 502 | 104 | 102 | 105 | 101 | 101 | 102 | — | — | 400 |
| 503 | 97 | 96 | 84 | 92 | 96 | 88 | — | — | 420 |
| 504 | 94 | 95 | 76 | 92 | 89 | 100 | — | 0.46 | 380 |
| 505 | 91 | 88 | 74 | 86 | 84 | 86 | — | 0.45 | 390 |
| 506 | 89 | 74 | 98 | 84 | 72 | 96 | — | 0.46 | 400 |
| 507 | 80 | 73 | 72 | 74 | 62 | 86 | — | 0.46 | 410 |
| 508 | 80 | 71 | 73 | 71 | 50 | 87 | — | 0.32 | 410 |
| 509 | 97 | 98 | 99 | 92 | 94 | 99 | 0.50 | 0.45 | 360 |
| 510 | 103 | 104 | 102 | 93 | 93 | 98 | 0.49 | 0.45 | 380 |
| 511 | 96 | 96 | 98 | 99 | 98 | 104 | 0.48 | 0.46 | 400 |
| 512 | 73 | 74 | 73 | 62 | 60 | 85 | 0.42 | 0.44 | 410 |
| 513 | 72 | 73 | 69 | 60 | 57 | 82 | 0.43 | 0.43 | 440 |
| 514 | 70 | 69 | 68 | 63 | 58 | 81 | 0.41 | 0.43 | 480 |
| 515 | 71 | 68 | 69 | 50 | 49 | 80 | 0.31 | 0.32 | 480 |
| 516 | 71 | 70 | 70 | 43 | 40 | 79 | 0.23 | 0.21 | 480 |

1) The value relative to the density variation of Sample No. 501, which was set at 100. The smaller this value, the higher resistance to pressure.
2) The value relative to the RMS value of Sample No. 1 501, which was set at 100. The smaller this value, the more improved graininess.

As is evident from the results shown in Table 20, the Sample Nos. 505 to 508 and 512 to 516 were improved in graininess and resistance to pressure. In particular, the Sample Nos. 508, 515 and 516 in which the medium-speed emulsion layer had the maximum color density of not more than 0.35 were significantly improved in graininess.

EXAMPLE 13

Sample Nos. 501 to 516 that had been prepared in Example 12 were processed in the same manner as in Example 2, and evaluated in the same manner as in Example 12. Similar results as those obtained in Example 12 were obtained.

EXAMPLE 14

A multilayer color photographic light-sensitive material (Sample No. 601) was prepared by providing on a cellulose triacetate film support the layers of the following constitutions in sequence from the support:

| Sample No. 601 (Comparative) | |
|---|---|
| **1st Layer: Anti-halation layer (HC-1)** | |
| Black colloidal silver | 0.2 |
| UV absorber (UV-1) | 0.23 |
| High boiling point solvent (Oil-1) | 0.18 |
| Gelatin | 1.4 |
| **2nd Layer: 1st Protective layer (IL-1)** | |
| Gelatin | 1.3 |
| **3rd Layer: Low-speed red-sensitive emulsion layer (RL)** | |
| Silver iodobromide emulsion (Em-E) | 1.0 |
| Sensitizing dye (I-40) | $1.8 \times 10^{-5}$ mol per mol silver |
| Sensitizing dye (I-6) | $2.8 \times 10^{-4}$ mol per mol silver |
| Sensitizing dye (II-29) | $3.0 \times 10^{-4}$ mol per mol silver |
| Cyan coupler (C-34) | 0.70 |
| Colored cyan coupler (CC-1) | 0.066 |
| DIR compound (D-25) | 0.03 |
| DIR compound (D-23) | 0.01 |
| High boiling point solvent (Oil-1) | 0.64 |
| Gelatin | 1.2 |
| **4th Layer: Medium-speed red-sensitive emulsion layer (RM)** | |
| Silver iodobromide emulsion (Em-D) | 0.8 |
| Sensitizing dye (I-40) | $2.1 \times 10^{-5}$ mol per mol silver |
| Sensitizing dye (I-6) | $1.9 \times 10^{-4}$ mol per mol silver |
| Sensitizing dye (II-29) | $1.9 \times 10^{-4}$ mol per mol silver |
| Cyan coupler (C-34) | 0.28 |
| Colored cyan coupler (CC-1) | 0.027 |
| DIR compound (D-25) | 0.01 |
| High boiling point solvent (Oil-1) | 0.26 |
| Gelatin | 0.6 |
| **5th Layer: High-speed red-sensitive emulsion layer (RH)** | |
| Silver iodobromide emulsion (Em-C) | 1.70 |
| Sensitizing dye (I-40) | $1.9 \times 10^{-5}$ mol per mol silver |
| Sensitizing dye (I-6) | $1.7 \times 10^{-4}$ mol per mol silver |
| Sensitizing dye (II-29) | $1.7 \times 10^{-4}$ mol per mol silver |
| Cyan coupler (C-34) | 0.05 |
| Cyan coupler (C-8) | 0.10 |

-continued

| Sample No. 601 (Comparative) | |
|---|---|
| Colored cyan coupler (CC-1) | 0.02 |
| DIR compound (D-25) | 0.025 |
| High boiling point solvent (Oil-1) | 0.17 |
| Gelatin | 1.2 |
| 6th Layer: 2nd Intermediate layer (IL-2) | |
| Gelatin | 0.8 |
| 7th Layer: Low-speed green-sensitive emulsion layer (GL) | |
| Silver iodobromide emulsion (Em-E) | 1.1 |
| Sensitizing dye ($I_C$-2) | $6.8 \times 10^{-5}$ mol per mol silver |
| Sensitizing dye ($I_A$-4) | $6.2 \times 10^{-4}$ mol per mol silver |
| Magenta coupler (M-1) | 0.54 |
| Magenta coupler (M-2) | 0.19 |
| Colored magenta coupler (CM-1) | 0.06 |
| DIR compound (D-32) | 0.017 |
| DIR compound (D-23) | 0.01 |
| High boiling point solvent (Oil-2) | 0.81 |
| Gelatin | 1.8 |
| 8th Layer: Medium-speed green-sensitive emulsion layer (GM) | |
| Silver iodobromide emulsion (Em-D) | 0.7 |
| Sensitizing dye ($I_A$-20) | $1.9 \times 10^{-4}$ mol per mol silver |
| Sensitizing dye ($I_F$-1) | $1.2 \times 10^{-4}$ mol per mol silver |
| Sensitizing dye ($I_A$-21) | $1.5 \times 10^{-5}$ mol per mol silver |
| Magenta coupler (M-1) | 0.07 |
| Magenta coupler (M-2) | 0.03 |
| Colored magenta coupler (CM-1) | 0.04 |
| DIR compound (D-2) | 0.018 |
| High boiling point solvent (Oil-2) | 0.30 |
| Gelatin | 0.8 |
| 9th Layer: High-speed green-sensitive emulsion layer (GH) | |
| Silver iodobromide emulsion (Em-C) | 1.7 |
| Sensitizing dye ($I_A$-20) | $1.2 \times 10^{-4}$ mol per mol silver |
| Sensitizing dye ($I_F$-1) | $1.0 \times 10^{-4}$ mol per mol silver |
| Sensitizing dye ($I_A$-21) | $3.4 \times 10^{-6}$ mol per mol silver |
| Magenta coupler (M-1) | 0.09 |
| Magenta coupler (M-3) | 0.04 |
| Colored magenta coupler (CM-1) | 0.04 |
| High boiling point solvent (Oil-2) | 0.31 |
| Gelatin | 1.2 |
| 10th Layer: Yellow filter layer (YC) | |
| Yellow colloidal silver | 0.05 |
| Anti-stain agent (SC-1) | 0.1 |
| High boiling point solvent (Oil-2) | 0.13 |
| Gelatin | 0.7 |
| Formalin scavenger (HS-1) | 0.09 |
| Formalin scavenger (HS-2) | 0.07 |
| 11th Layer: Low-speed blue-sensitive emulsion layer (BL) | |
| Silver iodobromide (Em-D) | 0.5 |
| Silver iodobromide (Em-E) | 0.5 |
| Sensitizing dye (SD-1) | $5.2 \times 10^{-4}$ mol per mol silver |
| Sensitizing dye (SD-2) | $1.9 \times 10^{-5}$ mol per mol silver |
| Yellow coupler (Y-1) | 0.65 |
| Yellow coupler (Y-2) | 0.24 |
| DIR compound (D-1) | 0.03 |
| High boiling point solvent (Oil-2) | 0.18 |
| Gelatin | 1.3 |
| Formalin scavenger (HS-1) | 0.08 |
| 12th Layer: High-speed blue-sensitive emulsion layer (BH) | |
| Silver iodobromide emulsion (Em-C) | 1.0 |
| Sensitizing dye (SD-1) | $1.8 \times 10^{-4}$ mol per mol silver |
| Sensitizing dye (SD-2) | $7.9 \times 10^{-5}$ mol per mol silver |
| Yellow coupler (Y-1) | 0.15 |
| Yellow coupler (Y-2) | 0.05 |
| High boiling point solvent (Oil-2) | 0.74 |
| Gelatin | 1.30 |
| Formalin scavenger (HS-1) | 0.05 |
| Formalin scavenger (HS-2) | 0.12 |
| 13th Layer: 1st Protective layer (Pro-1) | |

-continued

| Sample No. 601 (Comparative) | |
|---|---|
| Finely-grained silver iodobromide emulsion (average grain size: 0.08 μm, AgI content: 1 mol %) | 0.4 |
| UV absorber (UV-1) | 0.07 |
| UV absorber (UV-2) | 0.10 |
| High boiling point solvent (Oil-1) | 0.07 |
| High boiling point solvent (Oil-3) | 0.07 |
| Formalin scavenger (HS-1) | 0.13 |
| Formalin scavenger (HS-2) | 0.37 |
| Gelatin | 1.3 |
| 14th Layer: 2nd Protective layer (Pro-2) | |
| Alkaline-soluble matting agent (average grain size: 2 μm) | 0.13 |
| Polymethyl methacrylate (average grain size: 3 μm) | 0.02 |
| Lubricant (WAX-1) | 0.04 |
| Gelatin | 0.6 |

Besides the above ingredients, a coating aid Su-1, a dispersion aid Su-2, a viscosity controlled, hardeners H-1 and H-2, a stabilizer ST-1, and antifoggants AF-1 and AF-2 (two kinds of AF-2 were employed. One had a weight average molecular weight of 10,000 and the other 1,100,000) were added to each layer.

Sample Nos. 602 to 606 were prepared in substantially the same manner as in the preparation of Sample No. 601, except that the silver halide emulsions in the 3rd, 4th, 5th, 7th, 8th and 9th layers were varied as shown in Table 21. Sample Nos. 607 to 611 were prepared in substantially the same manner as in the preparation of Sample No. 601, except that the provision of the 4th and 8th layers was omitted and that the amounts of the silver halide emulsions in the 3rd, 5th, 7th, and 9th layers were varied as follows:

| (Amounts of silver halide emulsions in Sample Nos. 607 to 611) | |
|---|---|
| 3rd Layer: Low-speed red-sensitive emulsion layer | |
| Silver iodobromide emulsion (see Table 22) | 1.58 |
| Silver iodobromide emulsion (see Table 22) | 1.58 |
| 5th Layer: High-speed red-sensitive emulsion layer | |
| Silver iodobromide emulsion (see Table 22) | 1.93 |
| Silver iodobromide emulsion (see Table 22) | 1.02 |
| 7th Layer: Low-speed green-sensitive emulsion layer | |
| Silver iodobromide emulsion (see Table 22) | 1.02 |
| Silver iodobromide emulsion (see Table 22) | 1.02 |
| 9th Layer: High-speed green-sensitive emulsion layer | |
| Silver iodobromide emulsion (see Table 22) | 2.49 |

TABLE 21

| | Red-sensitive layer | | | Green-sensitive layer | | |
|---|---|---|---|---|---|---|
| Sample No. | Low-speed layer | Medium-speed layer | High-speed layer | Low-speed layer | Medium-speed layer | High-speed layer |
| 601 | Em-E | Em-D | Em-C | Em-E | Em-D | Em-C |
| 602 | Em-H | Em-G | Em-F | Em-H | Em-G | Em-F |
| 603 | Em-6 | Em-5 | Em-4 | Em-6 | Em-5 | Em-4 |
| 604 | Em-E | Em-5 | Em-4 | Em-E | Em-5 | Em-4 |
| 605 | Em-6 | Em-D | Em-4 | Em-6 | Em-D | Em-4 |
| 606 | Em-E | Em-D | Em-4 | Em-E | Em-D | Em-4 |

TABLE 22

| | Red-sensitive layer | | Green-sensitive layer | |
|---|---|---|---|---|
| Sample No. | Low-speed layer | High-speed layer | Low-speed layer | High-speed layer |
| 607 | Em-5<br>Em-6 | Em-4 | Em-5<br>Em-6 | Em-4 |
| 608 | Em-D | Em-4 | Em-D | Em-4 |

TABLE 22-continued

| Sample No. | Red-sensitive layer: Low-speed layer | Red-sensitive layer: High-speed layer | Green-sensitive layer: Low-speed layer | Green-sensitive layer: High-speed layer |
|---|---|---|---|---|
| | Em-E | | Em-E | |
| 609 | Em-G | Em-4 | Em-G | Em-4 |
| | Em-H | | Em-H | |
| 610 | Em-D | Em-C | Em-D | Em-C |
| | Em-E | | Em-E | |
| 611 | Em-G | Em-F | Em-G | Em-F |
| | Em-H | | Em-H | |

Em-4 to 6 and Em-C to H were prepared according to the following procedures:

PREPARATION OF SEED EMULSION

According to the method described in Japanese Patent O.P.I. Publication No. 45437/1975, to 500 ml of an aqueous 2.0% gelatin solution of which the temperature had been risen to 40° C., 250 ml of a 4M (molar concentration)-aqueous $AgNO_3$ solution and 250 ml of a 4M-mixture of an aqueous KBr solution and an aqueous KI solution (Kbr:Kr=98:2, in molar ratio. 4 moles in total) were added over a period of 35 minutes by the controlled double-jet method, while controlling pAg and pH to 9.0 and 2.0, respectively. The pH of the above gelatin solution which contained silver halide grains was adjusted to 5.5 with an aqueous solution of potassium carbonate. Then, 364 ml of an aqueous 5 wt% Demor N solution (manufactured by Kao Atlas Co., Ltd.) as a precipitant and 244 ml of an aqueous 20 wt % magnesium sulfate solution as a polyvalent ion were added to allow precipitation. The solution was then allowed to stand for sedimentation. After decanting the supernatant, 1400 ml of distilled water was added for re-dispersion, and 36.4 ml of an aqueous 20 wt % solution of magnesium sulfate was added for re-precipitation. The solution was allowed to stand for sedimentation, followed by the decanting of the supernatant. Then, 28 g of an aqueous solution containing ossein gelatin was added to make the total quantity of the solution 425 ml, followed by dispersion at 40° C. for 40 minutes, to obtain a silver halide seed emulsion.

Electron microscopic examination revealed that the emulsion was a monodispersed emulsion with an average grain size of 0.116 μm.

PREPARATION OF SEED EMULSION N-2

In the same manner as in the preparation of N-1, a silver iodobromide seed emulsion N-2 with an average grain size of 0.33 μm and a silver iodide content of 2 mol % was prepared.

PREPARATION OF FINELY-GRAINED SILVER IODIDE

A silver iodide fine-grained emulsion to be used for the preparation of the following samples was obtained by the method described below:

To a reactor, an aqueous solution containing 5 wt% of an aqueous silver nitrate solution and one mole of a 3.5 N aqueous potassium iodide solution were added over a period of 30 minutes at a fixed rate, while stirring vigorously at 40° C. During the addition, pAg was maintained at 13.5 in the usual way. The resulting silver iodide emulsion was a mixture of β-AgI and γ-AgI and had an average grain size of 0.06 μm.

(Preparation of Em-4)

Aqueous solution (b-1)

| | |
|---|---|
| Gelatin | 231.9 g |
| 10 vol % methanol solution of the following Compound [I] | 30.0 ml |
| 28% aqueous ammonia | 1056 ml |
| Water was added to make the total quantity 11827 ml. | |

Compound [I]

$$HO(CH_2CH_2O)_m(\overset{\overset{CH_3}{|}}{C}HCH_2O)_{17}(CH_2CH_2O)_nH$$

average molecular weight = 1300

Aqueous solution (b-2)

| | |
|---|---|
| $AgNO_3$ | 1587 g |
| 28% aqueous ammonia | 1295 ml |
| Water was added to make the total quantity 2669 ml. | |

Aqueous solution (b-3)

| | |
|---|---|
| KBr | 1572 g |
| Water was added to make the total quantity 3774 ml. | |

Emulsion solution containing silver iodide fine grains (b-4)

| | |
|---|---|
| Silver iodide finely-grained emulsion | 1499.3 g |
| 4-Hydroxy-6-methyl-1,3,3a-7-tetrazaindene | 5.2 g |
| Aqueous 10% potassium hydroxide solution | 14.75 ml |
| Water was added to make the total quantity 1373 ml. | |

To Solution (b-1) that had been stirred vigorously at 60° C., a 0.407 mol equivalent amount of a seed emulsion was added. pH and pAg were adjusted with acetic acid and an aqueous KBr solution.

Then, with pH and pAg being controlled as shown in Table 23, Solutions (b-2), (b-3) and (b-4 were added by the triple-jet method respectively at the flow rates indicated in Tables 24A, 24B, and 24C.

Thereafter, an aqueous solution of phenylcarbamyl gelatin was added for pH adjustment, permitting the sedimentation and precipitation of the grains, followed by desalting and rinsing. The pH and pAg of the mixture were then adjusted to 5.80 and 8.06(=at 40° C), respectively, to obtain a monodispersed silver iodobromide emulsion with an average grain size of 0.99 μm, an average silver iodide content of 8.0 mol % and a grain size distribution of 11.2%. The relative standard deviation for the silver iodide content was 8.4 %.

This emulsion was designated as Em-4.

The grain structure of Em-4 and the volume ratio of each phase are shown in Table 23.

TABLE 23

| Em-4: Grain growth conditions | | | | | | | | | |
|---|---|---|---|---|---|---|---|---|---|
| Ag (%) | 0 | | 19 | | 39 | | 56 | | 100 |
| pH | 7.0 | → | 7.0 | ↓ | 6.0 | → | 6.0 | → | 6.0 |
| pAg | 7.8 | → | 7.8 | ↓ | 9.7 | | 10.1 | → | 10.1 |

→ keep pH or pAg constant
lower pH or pAg continuously
↓ lower pH or pAg suddenly

TABLE 24A

| Addition pattern of (b-2) | |
|---|---|
| Time (min) | Addition rate (ml/min) |
| 0 | 12.2 |
| 25.6 | 13.0 |
| 42.6 | 12.9 |
| 43.9 | 8.4 |
| 67.5 | 11.0 |
| 97.3 | 14.8 |
| 97.7 | 20.6 |

TABLE 24A-continued

| Addition pattern of (b-2) | |
|---|---|
| Time (min) | Addition rate (ml/min) |
| 105.0 | 22.3 |
| 105.4 | 25.4 |
| 112.3 | 32.1 |
| 112.6 | 35.1 |
| 129.4 | 90.3 |
| 145.7 | 194.2 |
| 145.7 | 200.5 |
| 147.4 | 203.9 |

TABLE 24B

| Addition pattern of (b-3) | |
|---|---|
| Time (min) | Addition rate (ml/min) |
| 0 | 10.9 |
| 25.6 | 11.7 |
| 42.6 | 11.6 |
| 43.9 | 7.6 |
| 97.3 | 13.3 |
| 97.7 | 18.6 |
| 105.0 | 20.0 |
| 105.0 | 36.5 |
| 112.0 | 56.2 |
| 112.3 | 60.6 |
| 121.2 | 106.0 |
| 121.4 | 91.4 |
| 132.4 | 263.3 |
| 132.7 | 141.8 |
| 147.4 | 230.0 |

TABLE 24C

| Addition pattern of (b-4) | |
|---|---|
| Time (min) | Addition rate (ml/min) |
| 0 | 0 |
| 43.9 | 0 |
| 43.9 | 73.6 |
| 51.7 | 80.6 |
| 52.5 | 28.5 |
| 84.3 | 40.4 |
| 84.9 | 11.6 |
| 97.7 | 13.0 |
| 105.0 | 14.1 |
| 105.4 | 16.3 |
| 112.3 | 20.6 |
| 112.6 | 6.2 |
| 130.4 | 17.5 |
| 132.7 | 22.1 |
| 145.7 | 34.4 |

| | | |
|---|---|---|
| **Solution A** | | |
| Ossein gelatin | 214 | g |
| Distilled water | 7070 | ml |
| $NH_4OH$ | 13.6 | mol |
| *Seed emulsion | 0.717 | mol |
| Water was added to make the total quantity | 11300 | ml. |
| **Solution B** | | |
| Ammoniac 3.5 N silver nitrate aqueous solution of which the pH had been lowered to 9 with nitric acid after the formation of ammoniac silver nitrate | 2669 | ml |
| **Solution C** | | |
| 3.5 N aqueous solution of KBr | 3774 | ml |
| **Solution D** | | |
| Silver iodide finely-grained emulsion | 1.0 | mol |
| 4-Hydroxy-6-methyl-1,3,3a-7-tetrazaindene | 4.8 | g |
| Water was added to make the total quantity | 1260 | ml. |
| **Solution E** | | |
| 1.75 N aqueous solution of KBr | Necessary amount | |
| **Solution F** | | |
| Aqueous 56 wt % acetic acid solution | Necessary amount | |

*A silver iodobromide emulsion consisting of grains each containing 2 moles of silver iodide uniformly in its interior portion and having an average grain size (grains size is defined as the length of a cube having the same volume) of 0.33 μm.

With the stirrer described in Japanese Patent Examined Publication Nos. 058288/1983 and 058289/1983, Solutions B, C and D were added to Solution A at 60° C over a period of 114 minutes by the double-jet method, to grow a seed crystal to 0.81 μm. The addition rate of each of Solutions B and C was varied functionally with respect to time so that the growth rate of silver halide grains would not exceed its critical value. Further, the addition rate was adequately controlled to prevent the formation of fine grains other than the growing seed crystals and the polydispersion of grains due the Ostwald's ripening. The ratio (molar ratio) of the addition rate of Solution D (silver iodide emulsion) to that of Solution B was varied functionally with respect to grain size (addition time), as shown in Table 26, thereby to produce an emulsion consisting of core/shell type grains of multilayer structure.

By the use of Solutions E and F, pAg and pH during the growth of crystals were adjusted as shown n Table 26. The measurement of pAg and pH was conducted in the usual manner using silver sulfate electrodes and glass electrodes.

After conventional desalting, gelatin was added for re-dissolution, and distilled water was added to make the total emulsion quantity (10 moles) 4250 ml. The pH and pAg of the emulsion were adjusted at 40° C. to 5.80 and 8.1, respectively. Electron microscopic examination revealed that this emulsion consisted of monodispersed octahedral grains with an average grain size of

TABLE 25

| | 1st phase (seed) | 2nd phase | 3rd phase | 4th phase | 5th phase | 6th phase |
|---|---|---|---|---|---|---|
| Silver iodide content (%) | 2 | 0 | 35 | 10 | 3 | 0 |
| (b-4)/(b-2), addition rate ratio (molar ratio) (%) | 0 | 0 | 100* 35 10 | 10 | 3 | 0 |
| Volume ratio (%) | 3.8 | 9.2 | 15.8 1.8 9.2 4.8 | 6.7 | 58.7 | 5.8 |

*In the case of silver iodobromide with a higher iodide content, an excessive amount of AgI had to be added to obtain a prescribed composition. X-ray diffraction analysis revealed that, according to the present invention, an iodide-rich phase (core) with a silver iodide content of as high as 35 mol % could be obtained by adding an excessive amount of silver iodide at such a rate as would make the ratio (molar ratio) of the addition rate of the silver iodide emulsion to that of the silver ion 100% at the early stage of forming such phase.

PREPARATION OF EM-5

An emulsion (Em-5) was prepared by using the following 6 kinds of solution:

0.81 μm. The relative standard deviation for the silver iodide content was 8.2%.

As is understood the presumed AgI contents shown in Table 26, in the case of silver iodobromide with a higher iodide content, an excessive amount of AgI had to be added to obtain a prescribed composition. X-ray diffraction analysis revealed that, according to the present invention, an iodide-rich phase (core) with a silver iodide content of as high as 35 mol % could be obtained by adding an excessive amount of silver iodide at such a rate as would make the ratio (molar ratio) of the addition rate of the silver iodide emulsion to that of the silver ion 100% at the early stage of forming such phase.

TABLE 26

| | Addition time (min) | Grain size | Flow rate* ratio of Solution D | Presumed** AgI content | pH | pAg |
|---|---|---|---|---|---|---|
| Core | 0.0 | 0.33 | 0 | 0 | 7.0 | 7.80 |
| | 29.0 | 0.43 | 0 | 0 | 7.0 | 7.80 |
| | 29.1 | 0.43 | 100 | 35 | 7.0 | 7.80 |
| | 35.0 | 0.45 | 100 | 35 | 7.0 | 7.80 |
| | 35.0 | 0.45 | 35 | 35 | 7.0 | 7.80 |
| | 59.2 | 0.52 | 35 | 35 | 7.0 | 7.80 |
| | 59.2 | 0.52 | 10 | 35 | 7.0 | 7.80 |
| | 67.3 | 0.55 | 10 | 35 | 7.0 | 7.80 |
| | 69.1 | 0.55 | 10 | 10 | 7.0 | 7.80 |
| | 72.7 | 0.56 | 10 | 10 | 7.0 | 7.80 |
| Shell | 72.7 | 0.56 | 10 | 10 | 6.0 | 9.70 |
| | 78.1 | 0.57 | 10 | 10 | 6.0 | 9.75 |
| | 78.1 | 0.57 | 3 | 3 | 6.0 | 9.75 |
| | 100.1 | 0.67 | 3 | 3 | 6.0 | 10.10 |
| | 112.4 | 0.79 | 3 | 3 | 6.0 | 10.10 |
| | 112.4 | 0.79 | 0 | 0 | 6.0 | 10.10 |
| | 114.3 | 0.81 | 0 | 0 | 6.0 | 10.10 |

*Flow rate ratio of Solution D (mol/min) = $\frac{\text{Flow rate of Solution D (mol/min)}}{\text{Flow rate of Solution B (mol/min)}} \times 100$

**AgI content as a theoretical value presumed from the flow rate ratio.

PREPARATION OF EM-6

An emulsion (Em-6) was prepared according to the following procedures:

| | |
|---|---|
| **Solution (A)** | |
| Gelatin | 236.5 g |
| 28% Aqueous ammonia | 1056 ml |
| 56% Acetic acid | 1570 ml |
| 10% methanol solution of sodium salt of polyisopropylene-polyethyleneoxy-di-succinate | 30 ml |
| Water was added to make the total quantity | 10385 ml. |
| **Solution (B)** | |
| $AgNO_3$ | 1631 g |
| 28% Aqueous ammonia | 1331 ml |
| Water was added to make the total quantity | 2743 ml. |
| **Solution (C)** | |
| KBr | 1572 g |
| Water was added to make the total quantity | 3774 ml. |
| **Solution (D) containing AgI fine grains** | |
| (average grain size: 0.06 μm) | |
| AgI finely-grained mother liquid* (1507 ml/mol AgI) | 1305 ml |
| 4-Hydroxy-6-methyl-1,3,3a,7-tetrazaindene | 5.16 g |
| 10% Aqueous potassium hydroxide solution | 14.63 ml |
| Water was added to make the total quantity | 1409 ml. |
| **Seed emulsion dispersion liquid** | |
| Monodispersed silver iodobromide emulsion (average grain size: 0.116 μm) equivalent to | 95.0 cc 0.129 mol |
| Sodium citrate | 1.39 g |
| $H_2O$ | 1520 ml |

*Obtained by the preceding method.

To Solution (A) that had been stirred vigorously at 60° C., the above-described silver iodobromide emulsion dispersion liquid was added as a seed emulsion. pH and pAg were adjusted with acetic acid and an aqueous KBr solution. Then, with pH and pAg being controlled as shown in Table 27, Solutions (B),(C) and (D) were added by the double-jet method at the flow rates shown in Tables 28A, 28B, 28C.

To the above-obtained mixture, a phenylcarbamyl gelatin solution was added, followed by pH adjustment with acetic acid and an aqueous potassium hydroxide ard desalting. The desalted emulsion was re-dispersed at 50° C., and pAg and pH were adjusted to 8.1 and 5.80, respectively, at 40° C. The resulting emulsion had a volume of 4500 ml and a weight of 6240 g.

The resulting emulsion (Em-6) had an average grain size of 0.47 μm, an average AgI content of 8.2 mol %, and an iodide-rich core with an AgI content of 35 mol %. The standard deviation for the silver iodide content was 9.1%.

TABLE 27

| | Grain growth conditions | | | | |
|---|---|---|---|---|---|
| Ag mol (%) | 0 | | 19 | 39 | 100 |
| pH | 7.0 | → | 7.0 | 6.0 | → 6.0 |
| pAg | 7.8 | → | 7.8 | 9.7 | Uncontrolled |

In the table, Ag (%) means the ratio of the silver amount spent by the middle of the grain growth process to the amount of silver spent by the completion of grain growth process. The symbol → means keeping pH or pAg constant.

TABLE 28A

| Time (min) | Flow rate (ml/min) |
|---|---|
| 0.00 | 9.76 |
| 1.11 | 10.62 |
| 2.48 | 11.45 |
| 6.17 | 12.41 |
| 11.29 | 12.83 |
| 20.20 | 12.76 |
| 23.22 | 8.24 |
| 38.25 | 11.52 |
| 51.24 | 20.45 |
| 54.56 | 22.08 |
| 55.05 | 22.08 |
| 55.06 | 44.88 |
| 57.06 | 58.11 |
| 57.11 | 63.60 |
| 58.15 | 78.05 |
| 63.46 | 151.48 |
| 69.17 | 202.57 |
| 70.19 | 202.57 |

TABLE 28B

| Time (min) | Flow rate (ml/min) |
|---|---|
| 0.00 | 9.28 |
| 1.11 | 10.08 |
| 4.50 | 11.52 |
| 8.12 | 12.02 |
| 22.41 | 12.07 |
| 23.22 | 7.43 |
| 40.04 | 10.73 |
| 51.24 | 19.45 |
| 54.56 | 21.02 |
| 55.05 | 21.02 |
| 55.06 | 47.91 |
| 57.06 | 62.10 |
| 57.11 | 67.15 |
| 58.36 | 89.72 |
| 59.20 | 112.18 |
| 69.17 | 213.81 |

TABLE 28B-continued

| Time (min) | Flow rate (ml/min) |
|---|---|
| 70.19 | 213.81 |

TABLE 28C

| Time (min) | Flow rate (ml/min) |
|---|---|
| 0.00 | 0.00 |
| 23.21 | 0.00 |
| 23.22 | 72.07 |
| 31.31 | 87.02 |
| 31.54 | 30.72 |
| 35.16 | 33.02 |
| 35.37 | 9.51 |
| 51.12 | 12.85 |
| 54.56 | 13.96 |
| 55.05 | 13.96 |
| 55.06 | 28.38 |
| 57.06 | 37.02 |
| 57.11 | 11.24 |
| 59.03 | 17.01 |
| 63.51 | 26.82 |
| 69.25 | 35.91 |
| 69.26 | 0.00 |
| 70.19 | 0.00 |

PREPARATION OF EM-C

A silver iodobromide emulsion Em-C was prepared by using the following aqueous solutions (a-1) to (a-6):

| | |
|---|---|
| Aqueous solution (a-1) | |
| Gelatin | 51.93 g |
| 28% Aqueous ammonia | 88.0 ml |
| 4-Hydroxy-6-methyl-1,3,3a,7-tetrazaindene | 300 mg |
| 56% Acetic acid | 41.0 ml |
| Water was added to make the total quantity | 5827 ml. |
| Aqueous Solution (a-2) | |
| $AgNO_3$ | 1277 g |
| 28% Aqueous ammonia | 1042 ml |
| Water was added to make the total quantity | 2148 ml. |
| Aqueous solution (a-3) | |
| Gelatin | 40 g |
| KBr | 774.7 g |
| KI | 81.34 g |
| 4-Hydroxy-6-methyl-1,3,3a,7-tetrazaindene | 2.06 g |
| Water was added to make the total quantity | 2 l. |
| Aqueous solution (a-4) | |
| $AgNO_3$ | 453.2 g |
| 28% Aqueous ammonia | 369.7 ml |
| Water was added to make the total quantity | 2668 ml. |
| Aqueous solution (a-5) | |
| Gelatin | 60 g |
| KBr | 285.6 g |
| KI | 94.88 g |
| 4-Hydroxy-6-methyl-1,3,3a,7-tetrazaindene | 827 ml. |
| Water was added to make the total quantity | 3 l. |
| Aqueous solution (a-6) | |
| Gelatin | 24 g |
| KBr | 498.3 g |
| KI | 2.09 g |
| 4-Hydroxy-6-methyl-1,3,3a,7-tetrazaindene | 1.24 g |
| Water was added to make the total quantity | 1.2 l. |

To Solution (a-1) that had been stirred vigorously at 50° C., a 0.407 mol equivalent amount of a monodispersed silver iodobromide emulsion with a silver iodide content of 2 mol % and an average grain size of 0.33 μm was added as a seed emulsion. pH and pAg were adjusted with acetic acid and an aqueous KBr solution.

With pH and pAg being controlled, Solutions (a-2) and (a-3) at first, then Solutions (a-4) and (a-5), subsequently Solutions (a-2) and (a-3), and finally Solutions (a-2) and (a-6), were added respectively by the double-jet method.

The pH and pAg of the resulting mixture were adjusted to 6.0 and 10.1, respectively, followed by conventional desalting and rinsing. The pH and pAg of the solution were then adjusted at 40° C. to 6.0 and 7.7, respectively, to obtain a monodispersed emulsion Em-C with an average grain size of 0.99 μm and an average silver iodide content of 8.0 mol %.

The relationship between the ratio of silver amount spent for the grain growth and pH and pAg are shown in Table 29.

TABLE 29

| | Em-C: Grain growth conditions | | | | | |
|---|---|---|---|---|---|---|
| Ag (%) | 0 | | 30 | 45 | | 100 |
| pH | 9.0 | → | 9.0 | | | 8.0 |
| pAg | 8.2 | → | 8.2 | 9.97 | → | 9.97 |

In the table, Ag (%) means the ratio of the amount of silver spent by the middle of the grain growth process to the amount of silver spent by the completion of the grain growth process.

→ keep pH or pAg constant

↘ lower pH or pAg continuously

PREPARATION OF EM-D

By using the following 8 kinds of solution, prepared was a silver iodobromide emulsion Em-B consisting of core/shell type grains having an average grain size of 0.81 μm and an average silver iodide content of 7.16 mol %. In each grain, the silver iodide contents of the core, the intermediate phase and the shell were 15 mol %, 5 mol % and 3 mol %, respectively.

| Solution A-1 | |
|---|---|
| Ossein gelatin | 10.8 g |
| Pronone (10% ethanol solution) | 20.0 ml |
| 4-Hydroxy-6-methyl-1,3,3a,7-tetrazaindene (hereinafter referred to as TAI) | 200 mg |
| Aqueous 56% acetic acid solution | 32.5 ml |
| 28% Aqueous ammonia | 58.7 mg |
| Seed emulsion N-2 equivalent to | 0.4673 mol AgX |

Distilled water was added to make the total quantity 4000 ml.

| Solution B-1 | |
|---|---|
| Ossein gelatin | 40 g |
| KBr | 404.6 g |
| KI | 99.6 g |
| TAI | 1224 mg |

Distilled water was added to make the total quantity 1300 ml.

| Solution C-1 | |
|---|---|
| Ossein gelatin | 20 g |
| KBr | 791.4 g |
| KI | 58.1 g |
| TAI | 2142 mg |

Distilled water was added to make the total quantity 1700 ml.

| Solution D-1 | |
|---|---|
| Ossein gelatin | 15 g |
| KBr | 606.0 g |
| KI | 26.15 g |
| TAI | 1605 mg |

Distilled water was added to make the total quantity of 800 ml.

| Solution E-1 | |
|---|---|
| $AgNO_3$ | 310.4 g |
| 28% Aqueous ammonia | 253 ml |

Distilled water was added to make the total quantity 1827 ml.

| Solution F-1 | |
|---|---|
| $AgNO_3$ | 803.3 g |
| 28% Aqueous ammonia | 655 ml |

Distilled water was added to make the total quantity 1351 ml.

| Solution G-1 |
|---|
| Aqueous 20% KBr solution |
| an amount necessary for pAg adjustment |
| Solution H-1 |
| Aqueous 56% acetic acid solution |
| an amount necessary for pH adjustment |

By using the same stirrer as described in Japanese Patent O.P.I. Publication Nos. 92523/1982 and 92524/1982, Solutions E-1 and B-1 were added at 40° C. by the double-jet method. Simultaneously with the completion of adding Solution B-1, Solutions C-1 and F-1 were added, and simulatneously with the completion of C-1, Solution D-1 was added. pAg, pH and the addition rates of the solutions are shown in Table 30.

pAg and pH were controlled by varying the flow rate of Solutions G-1 and H-1 by means of a roller tube pump.

After conventional desalting and rinsing, 197.4 g of ossein gelatin was dispersed in the aqueous solution, followed by the addition of distilled water to make the total quantity 3000 ml. The pH and pAg of the solution were adjusted to 40° C. to 6.00 and 7.7, respectively.

TABLE 30

| | | | Addition rate of solution (ml/min) | | | | |
|---|---|---|---|---|---|---|---|
| Time (min) | pH | pAg | Solution B-1 | Solution C-1 | Solution D-1 | Solution E-1 | Solution F-1 |
| 0 | 9.00 | 8.40 | | | | | |
| 6.58 | 9.00 | 8.40 | 81.5 | | | 82.8 | |
| 10.13 | 9.00 | 8.40 | 100.1 | | | 101.7 | |
| 15.30 | 9.00 | 8.40 | 123.1 | | | 125.7 | |
| 21.62 | 9.00 | 8.40 | 140.5 | | | 145.2 | |
| 22.07 | 9.00 | 8.40 | | 44.7 | | | 42.8 |
| 24.06 | 8.87 | 8.85 | | 59.2 | | | 52.0 |
| 26.94 | 8.64 | 9.63 | | 197.4 | | | 98.2 |
| 27.11 | 8.62 | 9.71 | | 119.9 | | | 119.3 |
| 29.97 | 8.22 | 9.71 | | 110.4 | | | 109.9 |
| 32.03 | 7.97 | 9.71 | | | 90.1 | | 89.7 |
| 34.92 | 7.70 | 9.71 | | | 68.1 | | 67.8 |
| 37.30 | 7.50 | 9.71 | | | 68.1 | | 67.8 |

PREPARATION OF EM-E

Using the following 7 kinds of solution, a silver iodobromide emulsion (Em-E) consisting of core/shell type grains with an average grain size of 0.47 μm and an average grain size of 8.46 mol % was prepared. In each grain, the silver iodide contents of the core, the intermediate phase and the shell were 15 mol %, 5 mol % and 3 mol %, respectively.

| Solution A | |
|---|---|
| Ossein | 28.6 g |
| 10% Ethanol solution of a sodium salt of polyisopropylene-polyethyleneoxy-disuccinate | 16.5 ml |
| TAI | 247.5 mg |
| 56% Aqueous acetic acid solution | 72.6 ml |
| 28% Aqueous ammonia solution | 97.2 ml |
| Seed emulsion (average grain size: 0.093 μm) equivalent to | 0.1552 mol |

Distilled water was added to make the total quantity 6600 ml.

| Solution B | |
|---|---|
| Ossein gelatin | 13 g |
| KBr | 460.2 g |
| KI | 113.3 g |
| TAI | 665 mg |

Distilled water was added to make the total quantity of 1300 ml.

| Solution C | |
|---|---|
| Ossein gelatin | 17 g |
| KBr | 672.6 g |
| KI | 49.39 g |
| TAI | 870 mg |

Distilled water was added to make the total quantity 1700 ml.

| Solution D | |
|---|---|
| Ossein gelatin | 8 g |
| KBr | 323.2 g |
| KI | 13.94 g |
| TAI | 409 mg |

Distilled water was added to make the total quantity 800 ml.

| Solution E | |
|---|---|
| $AgNO_3$ | 1773.6 g |
| 28% Aqueous ammonia | 1470 ml. |

Distilled water was added to make the total quantity 2983 ml.

| Solution F |
|---|
| 20% Aqueous KBr solution |
| an amount necessary for pAg adjustment |
| Solution G |
| 56% Aqueous acetic acid solution |
| an amount necessary for pH adjustment |

By means of a stirrer, Solutions E and B were added to Solution A at 40° C. by the double-jet method. Simultaneously with the completion of adding Solution B, Solution C was added, and simultaneously with the completion of Solution C, Solution D was added. pAg, pH and the addition rates of Solutions E, B, C and D are shown in Table 31.

pAg and pH were controlled by varying the flow rate of Solutions F and G by means of a roller tube pump.

After completion of adding Solution E, desalting, rinsing and re-dispersion were performed. Then, pH and pAg were adjusted to 6.0 and 7.7, respectively at 40° C.

This emulsion was designated as Em-E.

This emulsion consisted of core/shell type grains with an average grain size of 0.47 μm and an AgI content of 8.46 mol %.

The relative standard deviations for the silver iodide contents of Em-C, Em-D and Em-E were 25%, 23% and 22%, respectively.

TABLE 31

| | | | Grain growth conditions | | | |
|---|---|---|---|---|---|---|
| | | | Addition rate of solution (ml/min) | | | |
| Time (min) | pH | pAg | Solution E-5 | Solution B-5 | Solution C-5 | Solution D-5 |
| 0 | 9.00 | 8.55 | 9.8 | 9.3 | | |
| 7.85 | 8.81 | 8.55 | 30.7 | 29.2 | | |
| 11.80 | 8.63 | 8.55 | 44.9 | 42.7 | | |
| 17.33 | 8.25 | 8.55 | 61.4 | 58.4 | | |
| 19.23 | 8.10 | 8.55 | 63.5 | 60.4 | | |
| 22.19 | 7.88 | 8.55 | 56.6 | 53.8 | | |
| 28.33 | 7.50 | 8.55 | 41.2 | 39.8 | 39.8 | |
| 36.61 | 7.50 | 9.38 | 31.9 | | 34.1 | |
| 40.44 | 7.50 | 9.71 | 30.6 | | 37.1 | |
| 45.14 | 7.50 | 10.12 | 34.6 | | 57.8 | |
| 45.97 | 7.50 | 10.20 | 37.3 | | 36.3 | |
| 57.61 | 7.50 | 10.20 | 57.3 | | 55.8 | 55.8 |
| 63.08 | 7.50 | 10.20 | 75.1 | | | 73.1 |
| 66.63 | 7.50 | 10.20 | 94.0 | | | 91.4 |

According to the following procedures, polydispersed emulsions Em-F, Em-G and Em-H were prepared.

(Preparation of Em-F)

| | |
|---|---|
| Solution A | |
| $H_2O$ | 200 cc |
| KBr | 786 g |
| KI | 2.93 g |
| Ossein gelatin | 3.00 g |
| Solution B | |
| $H_2O$ | 276 cc |
| KBr | 61.3 g |
| Ossein gelatin | 2.00 g |
| Solution C | |
| $H_2O$ | 150 cc |
| $AgNO_3$ | 2.98 g |
| Solution D | |
| $H_2O$ | 287 cc |
| $AgNO_3$ | 570 g |

While stirring at 65° C. at a rotating speed of 320 rpm, Solution C was added to Solution A over a period of one minute. Then, Solutions B and D were added over a period of 90 minutes through a nozzle, followed by conventional desalting.

(Preparation of Em-G)

| | |
|---|---|
| Solution A | |
| $H_2O$ | 455.1 cc |
| Ossein gelatin | 8.0 g |
| Solution B | |
| $H_2O$ | 233.8 cc |
| KBr | 42.5 g |
| KI | 2.30 g |
| Solution C | |
| $H_2O$ | 130 cc |
| Solution D | |
| $H_2O$ | 236.2 cc |
| $AgNO_3$ | 60 g |

While stirring at 55° C. at a rotating speed of 320 rpm, Solution D was added to Solution A over a period of 9 minutes and 30seconds. Ten second after the completion of adding Solution D, Solution B was added over a period of 10 minutes. After the completion of adding Solution C, desalting was conducted in the usual way.

(Preparation of Em-H)

| | |
|---|---|
| Solution A | |
| $H_2O$ | 200 cc |
| KI | 3.52 g |
| Ossein gelatin | 3.00 g |
| Solution B | |
| $H_2O$ | 276 cc |
| KBr | 56.0 g |
| Ossein gelatin | 200 g |
| Acetic acid (56%) | 12.0 cc |
| Solution C | |
| Acetic acid (56%) | 68.0 cc |
| Solution D | |
| $H_2O$ | 14.5 cc |
| $AgNO_3$ | 3.40 g |
| $NH_4OH$ | 2.7 cc |
| Solution E | |
| $H_2O$ | 242.2 cc |
| $AgNO_3$ | 56.60 g |
| $NH_4OH$ | 44.3 cc |

While stirring at 55° C. at a rotating speed of 320 rpm, Solution C was added to Solution A over a period of one minute. Solutions B and E were added through a nozzle over a period of 26 minutes. After neutralization with Solution C, desalting was performed in the usual way. The relative standard deviation for the silver iodide content of Em-F, Em-G and Em-H were 32%, 30% and 33%, respectively.

The afore-mentioned samples 601 to 611 were evaluated for stability against the variation of processing conditions:

PROCESSING STABILITY 1 (CHANGE IN COLOR DEVELOPER TEMPERATURE)

Each sample was exposed to light through an optical wedge and processed at 38° C. in the same manner as in Example 1. Then, each sample was processed in the same manner as in Example 1, except that the processing temperature was varied to 36.5° C. and 39.5° C. Fogging density and sensitivity were evaluated for each sample.

PROCESSING STABILITY 2 (STIRRING)

Each sample was exposed to light through an optical wedge and processed under the following processing conditions (38° C.). The frequency of stirring a color developer was varied from 1 time per second to 1 time per 30 seconds. Fogging density and sensitivity were evaluated for each sample.

The results obtained are shown in Table 32.

| Processing procedures (38° C.) | Processing time |
|---|---|
| Color developing | 3 min 15 sec |
| Bleaching | 6 min 30 sec |
| Rinsing | 3 min 15 sec |
| Fixing | 6 min 30 sec |
| Rinsing | 3 min 15 sec |

The processing liquids had the same compositions as mentioned in Example 1.

As is evident from the results shown in Table 32, the samples 603 to 606 were excellent both in sensitivity and stability against the variation of processing conditions.

TABLE 32

| Sample No. | *1 Red-sensitivity layer: Maximum density (medium layer) | Fog | Sensitivity | Green-sensitive layer: Maximum density (medium layer) | Fog | Sensitivity |
|---|---|---|---|---|---|---|
| 601 | 0.27 | 0.15 | 100 | 0.25 | 0.13 | 100 |
| 602 | 0.28 | 0.12 | 95 | 0.26 | 0.10 | 96 |
| 603 | 0.26 | 0.02 | 149 | 0.25 | 0.02 | 143 |
| 604 | 0.25 | 0.03 | 141 | 0.24 | 0.03 | 137 |
| 605 | 0.26 | 0.04 | 134 | 0.26 | 0.05 | 130 |
| 606 | 0.27 | 0.06 | 130 | 0.26 | 0.07 | 129 |
| 607 | — | 0.05 | 135 | — | 0.05 | 130 |
| 608 | — | 0.07 | 120 | — | 0.08 | 119 |
| 609 | — | 0.09 | 118 | — | 0.09 | 115 |
| 610 | — | 0.20 | 95 | — | 0.18 | 93 |
| 611 | — | 0.18 | 96 | — | 0.17 | 98 |

| Sample No. | Processing stability (change in color developer temperature) *2: Red-sensitivity layer 36.5° C. ΔF | ΔS | 39.5° C. ΔF | ΔS | Green-sensitivity layer 36.5° C. ΔF | ΔS | 39.5° C. ΔF | ΔS | Processing stability (stirring) *3: Red-sensitivity layer ΔF | ΔS | Green-sensitivity layer ΔF | ΔS |
|---|---|---|---|---|---|---|---|---|---|---|---|---|
| 601 | −0.05 | 100 | +0.07 | 100 | −0.04 | 100 | +0.08 | 100 | +0.08 | 100 | +0.07 | 100 |
| 602 | −0.04 | 107 | +0.07 | 110 | −0.06 | 109 | +0.07 | 106 | +0.06 | 99 | +0.07 | 102 |
| 603 | −0.01 | 51 | +0.01 | 49 | −0.01 | 48 | ±0 | 56 | +0.02 | 76 | +0.02 | 77 |
| 604 | −0.01 | 55 | +0.02 | 56 | −0.01 | 53 | +0.01 | 61 | +0.03 | 80 | +0.04 | 85 |
| 605 | −0.02 | 67 | +0.02 | 69 | −0.01 | 72 | +0.02 | 78 | +0.03 | 83 | +0.03 | 84 |
| 606 | −0.01 | 81 | +0.03 | 77 | −0.02 | 84 | +0.04 | 72 | +0.04 | 90 | +0.05 | 95 |
| 607 | −0.03 | 88 | +0.03 | 93 | −0.03 | 90 | +0.02 | 82 | +0.05 | 93 | +0.04 | 99 |
| 608 | −0.04 | 91 | +0.04 | 94 | −0.03 | 92 | +0.04 | 92 | +0.05 | 95 | +0.06 | 100 |
| 609 | −0.04 | 95 | +0.03 | 96 | −0.04 | 95 | +0.04 | 96 | +0.06 | 98 | +0.05 | 99 |
| 610 | −0.04 | 109 | +0.09 | 107 | −0.04 | 100 | +0.09 | 105 | +0.09 | 102 | +0.08 | 107 |
| 611 | −0.04 | 106 | +0.11 | 111 | −0.04 | 99 | +0.12 | 120 | +0.10 | 105 | +0.11 | 103 |

*1 Results obtained at a processing temperature of 38° C. Sensitivity was defined as the reciprocal of an exposure amount that gave a fogging density +0.3, and expressed as the value relative to that of Sample No. 601 which was set as 100.

*2 ΔF = (fog at 36.5° C. or 39.5° C.) − (fog at 38° C.). ΔS = the value relative to (sensitivity at 36.5° C. or 39.5° C.) − (sensitivity at 38° C.) of Sample No. 601 that was set at 100.

*3 ΔF = (fog at 1 time/sec) − (fog at 1 time/30 sec). ΔS = the value relative to (sensitivity at 1 time/sec) − (sensitivity at 1 time/30 sec) of Sample No. 601 that was set at 100.

*The smaller the absolute value of ΔF or ΔS, the higher processing stability.

EXAMPLE 15

Sample Nos. 601 to 611 were processed under the same conditions as in Example 2, and evaluated for stability against the variation of processing conditions in the same manner as in Example 14. Similar results to those obtained in Example 14 were obtained.

EXAMPLE 16

For Sample Nos. 601 to 611, resistance to heat and humidity was evaluated according to the following procedures:

HEAT RESISTANCE

Each sample was stored at 65° C. and RH 40% for 3 days.

HUMIDITY RESISTANCE

Each sample was stored at 23° C. and RH 80% for one week.

These samples, together with the samples that had not been stored at such deteriorating conditions, were each exposed to light through an optical wedge, and processed under the same conditions as mentioned in Example 14. Storage stability was evaluated by comparing these two groups on fogging and sensitivity.

The results obtained are shown in Table 33.

TABLE 33

| Sample No. | Resistance to heat (65° C., 40%, 3 days): Red-sensitive layer ΔF | ΔS | Green-sensitive layer ΔF | ΔS | Resistance to humidity (23° C., 80%, 7 days): Red-sensitive layer ΔF | ΔS | Green-sensitive layer ΔF | ΔS |
|---|---|---|---|---|---|---|---|---|
| 601 | 0.13 | 100 | 0.15 | 100 | 0.16 | 100 | 0.14 | 100 |
| 602 | 0.15 | 110 | 0.14 | 113 | 0.15 | 107 | 0.16 | 106 |
| 603 | 0.02 | 43 | 0.02 | 38 | 0.03 | 40 | 0.02 | 39 |
| 604 | 0.04 | 49 | 0.03 | 45 | 0.05 | 45 | 0.04 | 46 |
| 605 | 0.04 | 47 | 0.04 | 48 | 0.07 | 50 | 0.06 | 53 |
| 606 | 0.06 | 56 | 0.07 | 60 | 0.08 | 61 | 0.06 | 69 |
| 607 | 0.07 | 90 | 0.08 | 97 | 0.10 | 80 | 0.09 | 83 |
| 608 | 0.08 | 95 | 0.09 | 99 | 0.11 | 91 | 0.10 | 88 |
| 609 | 0.10 | 99 | 0.11 | 104 | 0.11 | 93 | 0.12 | 95 |
| 610 | 0.18 | 113 | 0.21 | 115 | 0.22 | 118 | 0.19 | 120 |

TABLE 33-continued

| Sample No. | Resistance to heat (65° C., 40%, 3 days) Red-sensitive layer ΔF | ΔS | Green-sensitive layer ΔF | ΔS | Resistance to humidity (23° C., 80%, 7 days) Red-sensitive layer ΔF | ΔS | Green-sensitive layer ΔF | ΔS |
|---|---|---|---|---|---|---|---|---|
| 611 | 0.20 | 116 | 0.19 | 119 | 0.21 | 119 | 0.22 | 123 |

ΔF = (fog after aging) − (fog before aging)
ΔS = the value relative to (sensitivity after aging) − (sensitivity before aging) of Sample No. 601 that was set at 100.
*The smaller ΔF or ΔS, the higher storage stability.

As is evident from the results shown in Table 33, the samples 603 to 606 were improved in resistance to heat and humidity.

What is claimed is:

1. A silver halide color photographic light sensitive material comprising a support having provided thereon a red-sensitive silver halide emulsion layer, a green-sensitive silver halide emulsion layer, and a blue-sensitive silver halide emulsion layer, wherein at least said green-sensitive silver halide emulsion layer is a three-layer structure comprising a low-speed elemental emulsion layer, a medium-speed elemental emulsion layer, and a high-speed elemental emulsion layer arranged in sequence from the side facing said support, said medium-speed elemental emulsion layer of the green-sensitive layer having a maximum color density of not more than 0.35 and the following spectral sensitivity distribution;

$$0.55S_{560}<S_{570}<.120S_{560},$$

$$0.20S_{560}<S_{580}<0.60S_{560}, \text{ and}$$

$$S_{580}<0.30_{560}$$

wherein S represents the sensitivity in a specific wavelength region, which is defined as the reciprocal of an exposure amount required to obtain a minimum density+0.1 at the subscripted wavelength (in nm).

2. A photographic material of claim 1, wherein said spectral sensitivity distribution is $$0.65S_{560}<S_{570}<1.85S_{560},$$

$$0.25S_{560}<S_{580}<0.40S_{560}, \text{ and}$$

$$S_{590}<0.15S_{560}.$$

3. A photographic material of claim 1, wherein said medium-speed emulsion layer contains a sensitizing dye represented by Formulae [$I_A$] to [$I_F$]:

formula [$I_A$]

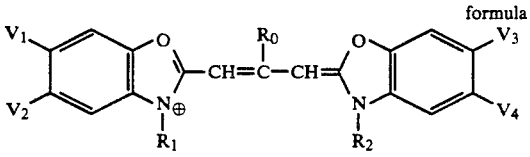

$(M_1\oplus)n_1$ wherein $R_1$ and $R_2$ each represent an alkyl group, an alkenyl group or an aralkyl group, provided that at least one of $R_1$ and $R_2$ is substituted with a sulfo or carboxy group; $R_0$ represents an alkyl group, a phenyl group or an aralkyl group; $V_1$ to $V_4$ each represent a hydrogen atom, an alkyl group, a halogen atom, an alkoxy group, a hydroxy group or an aryl group; $M_1\oplus$ represents a cation; and $n_1$ represents 0 or 1, and when the compound forms an intramolecular salt, $n_1$ represents 0;

Formula [$I_B$]

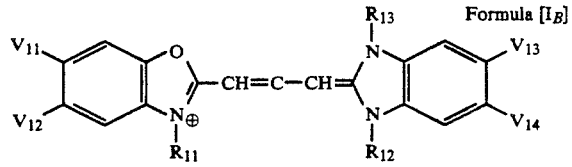

$(M_{11}\oplus)n$ wherein $R_{11}$ and $R_{12}$ have the same meaning as $R_1$ and $R_2$; $R_{13}$ represents an alkyl group, an alkenyl group, an aralkyl group or aryl group; $V_{11}$ and $V_{12}$ each have the same definition as $V_1$ to $V_4$l; $V_{13}$ and $V_{14}$ each represent a hydrogen atom, a halogen atom, a carbamoyl group, an alkoxycarbonyl group, an aryloxycarbonyl group, an acyl group, a sulfonyl group, a sulfamoyl group, a trifluoromethyl group or a cyano group; and $M_{11}\oplus$ and $n_{11}$ respectively have the same meaning as $M_1\oplus$ and $n_1$;

Formula [$I_C$]

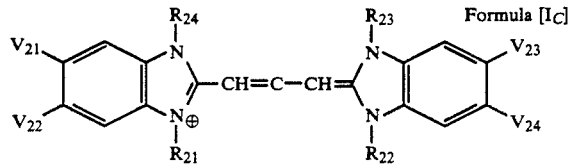

$(M_{21}\oplus)n_{21}$ wherein $R_{21}$ and $R_{22}$ each have the same definition as $R_1$ and $R_2$; $R_{23}$ and $R_{24}$ each have the same definition as $R_{13}$; $V_{21}$ to $V_{24}$ each have the same definition as $V_{13}$ and $V_{14}$; and $M_{21}\oplus$ and $n_{21}$ respectively have the same definition as $M_1\oplus$ and $n_1$;

Formula [$I_D$]

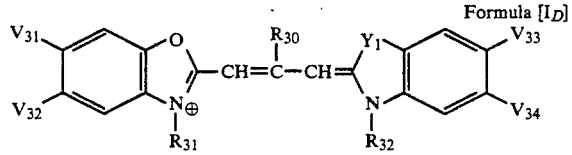

$(M_{31}\oplus)n_{31}$ wherein $R_{30}$ has the same definition as $R_0$; $R_{31}$ and $R_{32}$ each have the same definition as $R_1$ and $R_2$: $V_{31}$ to $V_{34}$ each have the same definition as $V_1$ to $V_4$; $M_{31}\oplus$ and $n_{31}$ respectively have the same definition as $M_1\oplus$ and $n_1$; and $Y_1$ represents a sulfur atom or a selenium atom;

Formula [$I_E$]

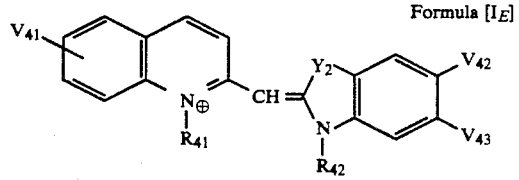

$(M_{41}\oplus)n_{41}$ wherein $R_{41}$ and $R_{42}$ each have the same definition as $R_1$ and $R_2$; $V_{41}$ to $V_{43}$ each have the same definition as $V_1$ to $V_4$; $Y_2$ represents a sulfur atom or a selenium atom; $M_{41}\oplus$ and $n_{41}$ respectively have the same meaning as $M_1\oplus$ and $n_1$;

Formula [$I_F$]

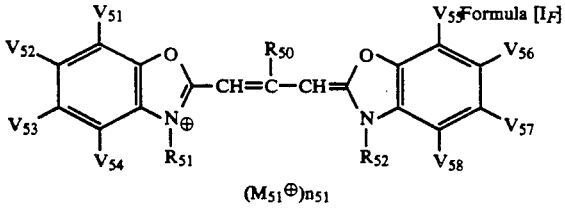

wherein $R_{50}$ has the same definition as $R_0$; $R_{51}$ and $R_{52}$ each have the same definition as $R_1$ and $R_2$; $V_{51}$ to $V_{58}$ each represent a hydrogen atom, an alkyl group, an alkoxy group, a halogen atom, a hydroxy group or an aryl group, provided that at least one pair selected $V_{51}$ and $V_{52}$, $V_{52}$ and $V_{53}$, $V_{53}$ and $V_{54}$, $V_{55}$ and $V_{56}$, $V_{56}$ and $V_{57}$, and $V_{57}$ and $V_{58}$ forms a condensed-benzene-ring by linkage; and $M_{51}\oplus$ and $n_{51}$ respectively have the same definition as $M_1\oplus$ and $n_1$.

4. A photographic material of claim 1, wherein at least one of said high-speed elemental emulsion layers contains a DIR compound which allows a development inhibitor or a compound capable of releasing a development inhibitor to be split off upon a reaction with an oxidized product of a color developing agent.

5. A photographic material of claim 1, wherein at least one of said emulsion layers comprises silver halide twinned crystal grains which are monodispersed and each of which have a high silver iodide-containing phase in the interior portion of the grain, wherein the average silver iodide content of the grains is larger than the average silver iodide content of the surface of the grain.

6. A photographic material of claim 1, wherein said crystal grains provide an X-ray diffraction pattern having a signal which is present continuously over a diffraction angle of 1.5 degree or more at a height of the maximum signal peak height $\times 0.13$ when a diffraction pattern of a (420) face of said crystal grains is measured with an X-ray diffractometer using CuKα ray as a radiation source.

7. A photographic material of claim 1, wherein at least one of said emulsion layers comprises silver halide grains, wherein said grains each have a core/shell structure in which a high silver iodide content phase is covered with a low silver iodide content phase of which the silver iodide content is smaller than that of the high silver iodide content phase; and a relative standard deviation of silver iodide content of each grain is not more than 20%.

8. A silver halide color photographic light sensitive material comprising a support having provided thereon a red-sensitive silver halide emulsion layer, a green-sensitive silver halide emulsion layer and a blue-sensitive emulsion layer, wherein at least said red-sensitive silver halide emulsion layer is a three-layer structure comprising a low-speed elemental emulsion layer, a medium-speed elemental emulsion layer and a high-speed elemental emulsion layer arranged in sequence form a side facing said support, said medium-speed elemental emulsion layer of the red-sensitive layer having a maximum color density of not more than 0.35 and the following spectral sensitivity distribution:

$$0.50S_{640}<S_{600}<0.90S_{640},$$

$$0.70S_{640}<S_{620}<1.20S_{640},$$

$$0.40S_{640}<S_{660}<0.90S_{640},$$

and $S_{680}<0.40S_{640}$ wherein S represents the reciprocal of an exposure amount required to obtain a minimum density+0.1 at the subscripted wavelength (in nm).

9. A photographic material of claim 8, wherein said spectral sensitivity distribution is $$0.60S_{640}<S_{600}<0.80S_{640},$$

$$0.80S_{640}<S_{620}<1.10S_{640},$$

$$0.50S_{640}<S_{660}<0.70S_{640}, \text{ and}$$

$$0.05S_{640}<S_{680}<0.30S_{640}.$$

10. A photographic material of claim 8, wherein said medium-speed emulsion layer contains a sensitizing dye represented by Formula (I) and at least one of the sensitizing dyes represented by Formula (II) and (III):

Formula (I)

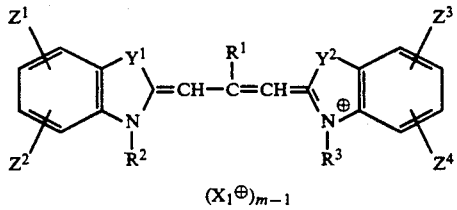

wherein $R^1$ represents a hydrogen atom, an alkyl group or an aryl group; $R^2$ and $R^3$ each represent an alkyl group; $Y^1$ and $Y^2$ each represent a sulfur atom or a selenium atom; $Z^1$, $Z^2$, $Z^3$ and $Z^4$ each represent a hydrogen atom, a halogen atom, a hydroxy group, an alkoxy group, an amino group, an acyl group, an acylamino group, an acyloxy group, aryloxy group, an alkoxycarbonyl group, an aryloxycarbonyl group, an alkoxycarbonylamino group, a sulfonyl group, a carbamoyl group, an aryl group, an alkyl group or a cyano group, and $Z^1$ and $Z^2$ and/or $Z^3$ and $Z^4$ may combine with each other to form a ring; $X_1\oplus$ represents an cation; and m represents an integer of 1 or 2, and when the sensitizing dye form an intramolecular salt, m is 1;

Formula (II)

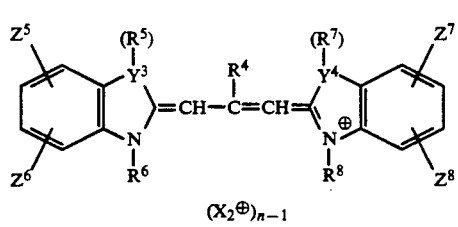

wherein $R^4$ represents a hydrogen atom, an alkyl group or an aryl group; $R^5$, $R^6$, $R^7$ and $R^8$ each represent an alkyl group; $Y^3$ and $Y^4$ each represent a nitrogen atom, an oxygen atom, a sulfur atom or a selenium atom, and the sensitizing dye does not contain $R^5$ when $Y^3$ is an oxygen atom, a sulfur atom or a selenium atom, and $Y^3$ and $Y^4$ cannot be nitrogen atoms simultaneously; $Z^5$, $Z^6$, $Z^7$ and $Z^8$ each represent a hydrogen atom, a halogen atom, a hydroxy group, an alkoxy group, an amino group, an acylamino group, an acyloxy group, an aryloxy group, an alkoxycarbonyl group, an aryloxycarbonyl group, an alkoxycarbonylamino group, a carbamoyl group, an aryl group, an aryl group, a cyano group, or a sulfonyl group; $Z^5$ and $Z^6$ and/or $Z^7$ and $Z^8$ may combine with each other to form a ring; $X_2\oplus$ represents an cation; n represents an integer of 1 or 2, and when the sensitizing dye form an intramolecular salt, n is 1;

Formula (III)

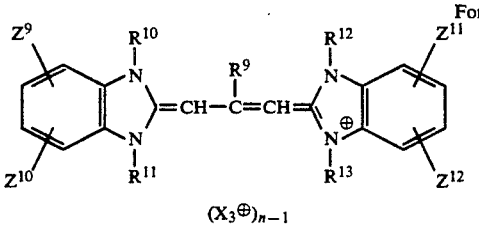

wherein $R^9$ represents a hydrogen atom, an alkyl group or an aryl group; $R^{10}$, $R^{11}$, $R^{12}$ and $R^{13}$ each represent an alkyl group; $Z^9$, $Z^{10}$, $Z^{11}$ and $Z^{12}$ each represent a hydrogen atom, a halogen atom a hydroxy group, an alkoxy group, an amino group, an acyl group, an acylamino group, an acyloxy group, an aryloxy group, an alkoxycarbonyl group, an aryloxycarbonyl group, an alkoxycarbonylamino group, a carbamoyl group, an aryl group, an alkyl group, a cyano group or a sulfonyl group; $Z^9$ and $Z^{10}$ and/or $Z^{11}$ and $Z^{12}$ may combine with each other to form a ring; $X_3\oplus$ represents a cation; and n represents an integer of 1 or 2, and when the sensitizing dye forms an intramolecular salt, n is 1.

11. The photographic material of claim 8 wherein said red-sensitive high-speed emulsion layer contains at least one two-equivalent cyan coupler represented by one of Formula ($C_2$-II), ($C_2$-III), and ($C_2$-IV);

Formula [$C_2$-II]

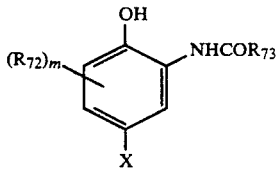

-continued

Formula [$C_2$-III]

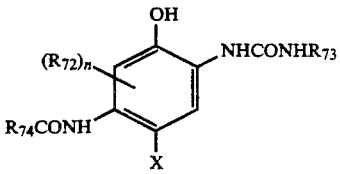

Formula [$C_2$-IV]

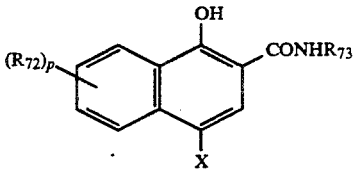

wherein X represents a group capable of being split off when a dye is formed by a coupling reaction between a coupler and an oxidized product of an aromatic primary amine color developing agent, $R_{72}$ represents hydrogen, halogen, alkyl, cycloalkyl, aryl, or a heterocyclic group; $R_{73}$ represents hydrogen, alkyl, cycloalkyl, aryl, or a heterocyclic group; $R_{74}$ represents alkyl, cycloalkyl, aryl, or a heterocyclic group; m is 1 to 3; l n is 1 or 2; p is 1 to 5, provided $R_{72}$ may be either identical or different when m, n and p are each not less than 2.

12. A photographic material of claim 8 wherein at least one of said high-speed elemental emulsion layers contains a DIR compound which allows a development inhibitor or a compound capable of releasing a development inhibitor to be split off upon a reaction with an oxidized product of a color developing agent.

13. The photographic material of claim 8 wherein at least one of said emulsion layers comprises silver halide twinned crystal grains which are monodispersed and each of which has a high silver iodide-containing phase in an interior portion of the grain, wherein the average silver iodide content of the grains is larger than the average silver iodide content of the surface of the grain.

14. The photographic material of claim 13 wherein said crystal grains provide an X-ray diffraction pattern having a signal which is present continuously over a diffraction angle of at least 1.5° at a height of 0.13 times the maximum signal peak height when a diffraction pattern of a (420) face of said crystal grains is measured with an X-ray diffractometer using $CuK_\alpha$ rays as a radiation source.

15. The photographic material of claim 8 wherein at least one of said emulsion layers comprises silver halide grains, wherein said grains each have a core/shell structure in which a high silver iodide content phase is covered by a low silver iodide content phase; a relative standard deviation of silver iodide content of each grain being not more than 20 percent.

* * * * *